US007878270B2

(12) United States Patent
Lee et al.

(10) Patent No.: US 7,878,270 B2
(45) Date of Patent: Feb. 1, 2011

(54) METHODS AND APPARATUS FOR DRILLING, COMPLETING AND CONFIGURING U-TUBE BOREHOLES

(75) Inventors: Dean Lee, Katy, TX (US); Richard Thomas Hay, Spring, TX (US); Nesto Humberto Gil, Edmonton (CA); Kyler Tebbutt, Edmonton (CA); Rodney A. Schnell, Calgary (CA); Joe E. Hess, Wasilla, AK (US); Tracy Lorne Grills, Airdrie (CA); Barry Gerard Ryan, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/723,021

(22) Filed: Mar. 12, 2010

(65) Prior Publication Data

US 2010/0224415 A1 Sep. 9, 2010

Related U.S. Application Data

(63) Continuation of application No. 11/280,324, filed on Nov. 17, 2005, now abandoned.

(60) Provisional application No. 60/629,747, filed on Nov. 19, 2004.

(51) Int. Cl.
*E21B 7/04* (2006.01)

(52) U.S. Cl. ..... 175/61; 175/62; 166/380; 166/117.5

(58) Field of Classification Search ..... 166/298, 166/313, 380, 382, 55.1, 50, 117.5, 117.6, 166/169, 242.5, 242.6; 175/61, 62
See application file for complete search history.

(56) References Cited

U.S. PATENT DOCUMENTS

| | | | |
|---|---|---|---|
| 3,104,295 | A | 9/1963 | Bender et al. |
| 3,386,508 | A | 6/1968 | Bielstein et al. |
| 3,406,766 | A | 10/1968 | Keller |
| 3,518,840 | A | 7/1970 | Valentine |

(Continued)

FOREIGN PATENT DOCUMENTS

| | | | |
|---|---|---|---|
| CA | 1174276 | A1 | 9/1984 |

(Continued)

OTHER PUBLICATIONS

"U.S. Appl. No. 11/280,324, Notice of Allowance mailed Dec. 14, 2009".

(Continued)

*Primary Examiner*—Daniel P Stephenson
(74) *Attorney, Agent, or Firm*—Schwegman, Lundberg & Woessner, P.A.

(57) ABSTRACT

A borehole network including first and second end surface locations and at least one intermediate surface location interconnected by a subterranean path, and a method for connecting a subterranean path between a first borehole including a directional section and a second borehole including a directional section. A directional drilling component is drilled in at least one of the directional sections to obtain a required proximity between the first and second boreholes. An intersecting component is drilled, utilizing magnetic ranging techniques, from one directional section to provide a borehole intersection between the first and second boreholes, thereby connecting the subterranean path.

19 Claims, 17 Drawing Sheets

U.S. PATENT DOCUMENTS

| | | | |
|---|---|---|---|
| 3,704,749 | A | 12/1972 | Estes et al. |
| 3,892,270 | A | 7/1975 | Lindquist |
| 3,964,553 | A | 6/1976 | Basham et al. |
| 4,016,942 | A | 4/1977 | Wallis, Jr. et al. |
| 4,248,302 | A | 2/1981 | Churchman |
| 4,323,848 | A | 4/1982 | Kuckes |
| 4,372,398 | A | 2/1983 | Kuckes |
| 4,390,067 | A | 6/1983 | Willman |
| 4,410,051 | A | 10/1983 | Daniel et al. |
| 4,443,762 | A | 4/1984 | Kuckes |
| 4,456,065 | A | 6/1984 | Heim et al. |
| 4,458,945 | A | 7/1984 | Ayler et al. |
| 4,502,010 | A | 2/1985 | Kuckes |
| 4,515,213 | A | 5/1985 | Rogen et al. |
| 4,529,939 | A | 7/1985 | Kuckes |
| 4,593,770 | A | 6/1986 | Hoehm, Jr. |
| 4,621,698 | A | 11/1986 | Pittard et al. |
| 4,682,421 | A | 7/1987 | van Dongen et al. |
| 4,700,142 | A | 10/1987 | Kuckes |
| 4,791,373 | A | 12/1988 | Kuckes |
| 4,845,434 | A | 7/1989 | Kuckes et al. |
| 4,933,640 | A | 6/1990 | Kuckes |
| 5,002,137 | A | 3/1991 | Dickinson et al. |
| 5,074,365 | A | 12/1991 | Kuckes |
| 5,103,177 | A | 4/1992 | Russell et al. |
| 5,165,490 | A | 11/1992 | Nosaka |
| 5,218,301 | A | 6/1993 | Kuckes |
| 5,258,755 | A | 11/1993 | Kuckes |
| 5,305,212 | A | 4/1994 | Kuckes |
| 5,318,122 | A | 6/1994 | Murray et al. |
| 5,343,152 | A | 8/1994 | Kuckes |
| 5,388,648 | A | 2/1995 | Jordan, Jr. |
| 5,402,851 | A | 4/1995 | Balton |
| 5,435,069 | A | 7/1995 | Nicholson |
| 5,449,048 | A | 9/1995 | Thigpen et al. |
| 5,450,902 | A | 9/1995 | Matthews |
| 5,485,089 | A | 1/1996 | Kuckes |
| 5,512,830 | A | 4/1996 | Kuckes |
| 5,513,710 | A | 5/1996 | Kuckes |
| 5,515,931 | A | 5/1996 | Kuckes |
| 5,520,247 | A | 5/1996 | Meyling et al. |
| 5,579,829 | A | 12/1996 | Comeau et al. |
| 5,582,248 | A | 12/1996 | Estes |
| 5,589,775 | A | 12/1996 | Kuckes |
| 5,655,605 | A | 8/1997 | Matthews |
| 5,657,826 | A | 8/1997 | Kuckes |
| 5,676,212 | A | 10/1997 | Kuckes |
| 5,725,059 | A | 3/1998 | Kuckes et al. |
| 5,787,997 | A | 8/1998 | Hartmann |
| 5,806,194 | A | 9/1998 | Rodney et al. |
| 5,923,170 | A | 7/1999 | Kuckes |
| RE36,569 | E | 2/2000 | Kuckes |
| 6,095,262 | A | 8/2000 | Chen |
| 6,199,633 | B1 | 3/2001 | Longbottom |
| 6,202,746 | B1 | 3/2001 | Vandenberg et al. |
| 6,234,259 | B1 | 5/2001 | Kuckes et al. |
| 6,244,361 | B1 | 6/2001 | Comeau et al. |
| 6,263,965 | B1 | 7/2001 | Schmidt et al. |
| 6,269,892 | B1 | 8/2001 | Boulton et al. |
| 6,296,066 | B1 | 10/2001 | Terry et al. |
| 6,466,020 | B2 | 10/2002 | Kuckes et al. |
| 6,581,699 | B1 | 6/2003 | Chen et al. |
| 6,617,854 | B2 | 9/2003 | Mercer et al. |
| 6,736,222 | B2 | 5/2004 | Kuckes et al. |
| 6,749,026 | B2 | 6/2004 | Smith et al. |
| 6,769,499 | B2 | 8/2004 | Cargill et al. |
| 2002/0130663 | A1 | 9/2002 | Kuckes et al. |
| 2002/0164212 | A1 | 11/2002 | Moss |
| 2003/0010534 | A1 | 1/2003 | Chen et al. |
| 2004/0168808 | A1 | 9/2004 | Smith |
| 2005/0241834 | A1 | 11/2005 | McGlothen et al. |
| 2006/0124360 | A1 | 6/2006 | Lee et al. |

FOREIGN PATENT DOCUMENTS

| | | | |
|---|---|---|---|
| CA | 1175106 | A1 | 9/1984 |
| CA | 1183207 | A1 | 2/1985 |
| CA | 2187487 | A1 | 6/1997 |
| CA | 2279539 | C | 12/2000 |
| CN | 1143992 | | 2/1997 |
| GB | 2114752 | A | 8/1983 |
| GB | 2118305 | A | 10/1983 |
| GB | 2132769 | A | 7/1984 |
| WO | WO-9845733 | A1 | 10/1998 |
| WO | WO-9849424 | A1 | 11/1998 |
| WO | WO-9919751 | A1 | 4/1999 |
| WO | WO-0111191 | A1 | 2/2001 |
| WO | WO-2006053434 | A1 | 5/2006 |

OTHER PUBLICATIONS

"Chinese Application Serial No. 200580046436.3 Office Action Mailed Jan. 12, 2010", 10 pgs.

"European Application Serial No. 05810850.7 , Extended European Search Report Mailed, Jan. 28, 2010", 10 Pages.

"International Search Report dated Mar. 7, 2006 provided by the Canadian Intellectual Property Office as ISA in International Application PCT/CA2005/001751", 5 pgs.

"Written Opinion dated Mar. 7, 2006 provided by the Canadian Intellectual Property Office as ISA in International Application PCT/CA2005/001751", 7 pgs.

Clark, Toby D.G., et al., "Space Weather Services for the Offshore Drilling Industry", *British Geological Survey*, 3 pgs.

Grills, Tracy L., "Magnetic Ranging Technologies for Drilling Steam Assisted Gravity Drainage Well Pairs . . . ", *SPE/Petroleum Society of CIP/CH0A79005,* 8 pgs.

Kuckes, A. F., et al., "New Electromagnetic Surveying/Ranging Method for Drilling Parallel Horizontal Twin Wells", *SPE Paper 27466*, (1996), 6 pgs.

Lukas, Andrew, et al., "The Practicality of Drilling Very Long Pipelines under Hazardous Terrain . . . ", *presented at Institution of Civil Engineers*, London, UK, (2004), 16 pgs.

Marker, Roy, et al., "Anaconda: Joint Development Project Leads to Digitally Controlled Composite Coiled Tubing Drilling System", *SPE Paper 60750*, (2000), 9 pgs.

Russell, J. P., et al., "Reduction of Well-Bore Positional Uncertainty . . . ", *SPE Paper 30452*, (1995), 16 pgs.

Smith, Maurice, "Anadarko Digs Deep to Circumvent a Treacherous Gorge Crossing", *New Technologies Magazine*, (Dec. 2004), 5 pgs.

Williamson, H.S., "Accuracy Prediction for Directional Measurement While Drilling", *SPE Drill. & Completion*, vol. 15, No. 4, (Dec. 2000), 221-233.

Wolf, C J.M., et al., "Borehole Position Uncertainty—Analysis of Measuring Methods . . . ", *SPE 9223, Journal of Petroleum Technology*, (1981), 12 pgs.

METHODS AND APPARATUS FOR DRILLING, COMPLETING AND CONFIGURING U-TUBE BOREHOLES

This application is a continuation application of U.S. patent application Ser. No. 11/280,324, filed Nov. 17, 2005 now abandoned, which claims the benefit of U.S. Provisional Application Ser. No. 60/629,747, filed Nov. 19, 2004, which applications are incorporated herein by reference in their entirety and made a part hereof.

FIELD OF INVENTION

Methods and apparatus for drilling U-tube boreholes, for completing U-tube boreholes, and for configuring U-tube boreholes.

BACKGROUND OF THE INVENTION

There is a need in a variety of situations to drill, intersect and connect two boreholes together where the intersection and connection is done below ground. For instance, it may be desirable to achieve intersection between boreholes when drilling relief boreholes, drilling underground passages such as river crossings, or when linking a new borehole with a producing wellbore. A pair of such intersected and connecting boreholes may be referred to as a "U-tube borehole".

For example, Steam Assisted Gravity Drainage ("SAGD") may be employed in two connected or intersecting boreholes, in which the steam is injected at one end of the U-tube borehole and production occurs at the other end of the U-tube borehole. More particularly, the injection of steam into one end of the U-tube borehole reduces the viscosity of hydrocarbons which are contained in the formations adjacent to the borehole and enables the hydrocarbons to flow toward the borehole. The hydrocarbons may then be produced from the other end of the U-tube borehole using conventional production techniques. Specific examples are described in U.S. Pat. No. 5,655,605 issued Aug. 12, 1997 to Matthews and U.S. Pat. No. 6,263,965 issued Jul. 24, 2001 to Schmidt et. al.

Other potential applications or benefits of the creation of a U-tube borehole include the creation of underground pipelines to carry fluids, which include liquids and/or gases, from one location to another where traversing the surface or the sea floor with an above ground or conventional pipeline presents a relatively high cost or a potentially unacceptable impact on the environment.

Such situations may exist where the pipeline is required to traverse deep gorges on land or on the sea floor. Further, such situations may exist where the pipeline is required to traverse a shoreline with high cliffs or sensitive coastal marine areas that can not be disturbed. In addition, going across bodies of water such as lake beds, river basins or harbors may be detrimental to the environment in the event of breakage of an above ground or conventional pipeline. In sensitive areas, conventional above ground pipelines would simply not be acceptable because of the environmental risk. Further, locating the pipeline below the lake bed or sea floor provides an extra level of security against leakage.

River crossing drilling rigs are presently utilized to perform such drilling on a routine basis around the world. Conventional river crossing drilling requires that the borehole enter at one surface location and drill back to surface at the second location. Since most of these holes are relatively short there is less concern about drag and the effects of gravity as the drilling rig typically has ample push to achieve the goal over such a short interval. However, concerns regarding drag and the effects of gravity increase with the length of the borehole.

Further, conventional river crossing drilling rigs tend to have a limited reach. In some instances, there is simply not enough lateral reach to drill down and then exit back up at the surface on the other side of the obstacle that is trying to be avoided. Also, in the event that the borehole enters into a pressurized formation, exiting on the other side at the surface presents safety issues as no well control measures, such as a blow-out preventer ("BOP") and cemented casing, are present at the exit point.

Thus, one clear benefit of using two surface locations instead of one is that the effective distance possible between the two locations can be at least doubled as torque and drag limitations can be maximized for reach at both surface locations. Further, necessary well control and safety measures may be provided at each surface location.

Further, in some areas of the world, such as offshore of the east coast of Canada, icebergs have rendered seabed pipelines impractical in some places since the iceberg can gouge long trenches in the sea floor as it floats by, thus tearing up the pipeline. This essentially means that a gravity based structure, such as that utilized in Hibernia, must be utilized to protect the well and the interconnecting pipe from being hit by the iceberg at a massive cost.

Therefore, there is a need for a method for drilling relatively long underground pipelines by drilling from two separate or spaced apart surface locations and then intersecting the boreholes at a location beneath the surface in order to connect the two surface locations together.

In order to permit the drilling of a U-tube borehole or underground pipeline, careful control must be maintained during the drilling of the boreholes, preferably with respect to both the orientation of the intersecting borehole relative to the target borehole and the separation distance between the intersecting and target boreholes, in order to achieve the desired intersection. This control can be achieved using magnetic ranging techniques.

Magnetic ranging is a general term which is used to describe a variety of techniques which use magnetic field measurements to determine the relative position (i.e., relative orientation and/or separation distance) of a borehole being drilled relative to a target such as another borehole or boreholes.

Magnetic ranging techniques include both "passive" techniques and "active" techniques. In both cases, the position of a borehole being drilled is compared with the position of a target such as a target borehole or some other reference such as ground surface. A discussion of both passive magnetic ranging techniques and active magnetic ranging techniques may be found in Grills, Tracy, "Magnetic Ranging Techniques for Drilling Steam Assisted Gravity Drainage Well Pairs and Unique Well Geometries—A Comparison of Technologies", SPE/Petroleum Society of CIM/CHOA 79005, 2002.

Passive magnetic ranging techniques, sometimes referred to as magnetostatic techniques, typically involve the measurement of residual or remnant magnetism in a target borehole using a measurement device or devices which are placed in a borehole being drilled.

An advantage of passive magnetic ranging techniques is that they do not typically require access into the target borehole since the magnetic field measurements are taken of the target borehole "as is". One disadvantage of passive magnetic ranging techniques is that they do require relatively accurate knowledge of the local magnitude and direction of the earth's magnetic field, since the magnetic field measurements which are taken represent a combination of the magnetism inherent in the target borehole and the local values of the earth's magnetic field. A second disadvantage of passive magnetic ranging techniques is that they do not provide for control over the magnetic fields which give rise to the magnetic field measurements.

Active magnetic ranging techniques commonly involve the measurement, in one of a target borehole or a borehole being drilled, of one or more magnetic fields which are created in the other of the target borehole or the borehole being drilled.

A disadvantage of active magnetic ranging techniques is that they do typically require access into the target borehole in order either to create the magnetic field or fields or to make the magnetic field measurements. One advantage of active magnetic ranging techniques is that they offer full control over the magnetic field or fields being created. Specifically, the magnitude and geometry of the magnetic field or fields can be controlled, and varying magnetic fields of desired frequencies can be created. A second advantage of active magnetic ranging techniques is that they do not typically require accurate knowledge of the local magnitude and direction of the earth's magnetic field because the influence of the earth's magnetic field can be cancelled or eliminated from the measurements of the created magnetic field or fields.

As a result, active magnetic ranging techniques are generally preferred where access into the target borehole is possible, since active magnetic ranging techniques have been found to be relatively reliable, robust and accurate.

One active magnetic ranging technique involves the use of a varying magnetic field source. The varying magnetic field source may be comprised of an electromagnet such as a solenoid which is driven by a varying electrical signal such as an alternating current in order to produce a varying magnetic field. Alternatively, the varying magnetic field source may be comprised of a magnet which is rotated in order to generate a varying magnetic field.

In either case, the specific characteristics of the varying magnetic field enable the magnetic field to be distinguished from other magnetic influences which may be present due to residual magnetism in the borehole or due to the earth's magnetic field. In addition, the use of an alternating magnetic field in which the polarity of the magnetic field changes periodically facilitates the cancellation or elimination from measurements of constant magnetic field influences such as residual magnetism in ferromagnetic components, such as tubing, casing or liner, positioned in the borehole or the earth's magnetic field.

The varying magnetic field may be generated in the target borehole, in which case the varying magnetic field is measured in the borehole being drilled. Alternatively, the varying magnetic field may be generated in the borehole being drilled, in which case the varying magnetic field is measured in the target borehole.

The varying magnetic field may be configured so that the "axis" of the magnetic field is in any orientation relative to the borehole. Typically, the varying magnetic field is configured so that the axis of the magnetic field is oriented either parallel to the borehole or perpendicular to the borehole.

U.S. Pat. No. 4,621,698 (Pittard et al) describes a percussion boring tool which includes a pair of coils mounted at the back end thereof. One of the coils produces a magnetic field parallel to the axis of the tool and the other of the coils produces a magnetic field transverse to the axis of the tool. The coils are intermittently excited by a low frequency generator. Two crossed sensor coils are positioned remote of the tool such that a line perpendicular to the axes of the sensor coils defines a boresite axis. The position of the tool relative to the boresite axis is determined using magnetic field measurements obtained from the sensor coils of the magnetic fields produced by the coils mounted in the tool.

U.S. Pat. No. 5,002,137 (Dickinson et al) describes a percussive action mole including a mole head having a slant face, behind which slant face is mounted a transverse permanent magnet or an electromagnet. Rotation of the mole results in the generation of a varying magnetic field by the magnet, which varying magnetic field is measured at the ground surface by an arrangement of magnetometers in order to obtain magnetic field measurements which are used to determine the position of the mole relative to the magnetometers.

U.S. Pat. No. 5,258,755 (Kuckes) describes a magnetic field guidance system for guiding a movable carrier such as a drill assembly with respect to a fixed target such as a target borehole. The system includes two varying magnetic field sources which are mounted within a drill collar in the drilling assembly so that the varying magnetic field sources can be inserted in a borehole being drilled. One of the varying magnetic field sources is a solenoid axially aligned with the drill collar which generates a varying magnetic field by being driven by an alternating electrical current. The other of the varying magnetic field sources is a permanent magnet which is mounted so as to be perpendicular to the axis of the drill collar and which rotates with the drill assembly to provide a varying magnetic field. The system further includes a three component fluxgate magnetometer which may be inserted in a target borehole in order to make magnetic field measurements of the varying magnetic fields generated by the varying magnetic field sources. The position of the borehole being drilled relative to the target is determined by processing the magnetic field measurements derived from the two varying magnetic field sources.

U.S. Pat. No. 5,589,775 (Kuckes) describes a method for determining the distance and direction from a first borehole to a second borehole which includes generating, by way of a rotating magnetic field source at a first location in the second borehole, an elliptically polarized magnetic field in the region of the first borehole. The method further includes positioning sensors at an observation point in the first borehole in order to make magnetic field measurements of the varying magnetic field generated by the rotating magnetic field source. The magnetic field source is a permanent magnet which is mounted in a non-magnetic piece of drill pipe which is located in a drill assembly just behind the drill bit. The magnet is mounted in the drill pipe so that the north-south axis of the magnet is perpendicular to the axis of rotation of the drill bit. The distance and direction from the first borehole to the second borehole are determined by processing the magnetic field measurements derived from the rotating magnetic field source.

Thus, there remains a need in the industry for a drilling method for connecting together at least two boreholes to provide or form at least one U-tube borehole. Further, there is a need for methods for completion of the U-tube borehole and methods for transferring material through the U-tube borehole or production of the U-tube borehole. Finally, there is a need for methods and for well configurations for interconnecting a plurality of the U-tube boreholes, preferably primarily below ground, to provide a network of U-tube boreholes capable of being produced or transferring material therethrough.

SUMMARY OF THE INVENTION

The present invention relates to drilling methods for connecting together at least two boreholes to provide or form at least one U-tube borehole.

The present invention also relates to methods for completion of a U-tube borehole and to methods for transferring material through the U-tube borehole or production of materials from the U-tube borehole. Further, the U-tube borehole may be utilized as a conduit or underground pathway for the placement or extension of underground cables, electrical wires, natural gas or water lines or the like therethrough.

Finally, the present invention relates to methods and configurations for interconnecting a plurality of U-tube boreholes, both at surface and below ground, to provide a network of U-tube boreholes capable of being utilized in a desired manner, such as the production of materials therefrom, the transference of material therethrough or the extension of underground cables, wires or lines therethrough. Preferably, the various methods and configurations for connecting or interconnecting the U-tube boreholes includes one or more underground connections such that an underground, trenchless pipeline or conduit or a producing/injecting well may be created over a relatively large span or area.

For the purpose of this specification, a U-tube borehole is a borehole which includes two separate surface locations and at least one subterranean path which connects the two surface locations. A U-tube borehole may follow any path between the two surface locations. In other words, the U-tube borehole may be "U-shaped" but is not necessarily U-shaped.

Drilling a U-Tube Borehole

A U-tube borehole may be drilled using any suitable drilling apparatus and/or method. For example, a U-tube borehole may be drilled using rotary drilling tools, percussive drilling tools, jetting tools etc. A U-tube borehole may also be drilled using rotary drilling techniques in which the entire drilling string is rotated, sliding drilling techniques in which only selected portions of the drill string are rotated, or combinations thereof.

Steering of the drill string during drilling may be accomplished by using any suitable steering technology, including steering tools associated with downhole motors, rotary steerable tools, or coiled tubing orientation devices in conjunction with positive displacement motors, turbines, vane motors or other bit rotation devices. U-tube boreholes may be drilled using jointed drill pipe, coiled tubing drill pipe or composite drill pipe. Rotary drilling tools for use in drilling U-tube boreholes may include roller cone bits or polycrystalline diamond (PDC) bits. Combinations of apparatus and/or methods may also be used in order to drill a U-tube borehole. Drill strings incorporating the drilling apparatus may include ancillary components such as measurement-while-drilling (MWD) tools, non-magnetic drill collars, stabilizers, reamers, etc.

A U-tube borehole may be drilled as a single borehole from a first end at a first surface location to a second end at a second surface location. Alternatively, a U-tube borehole may be drilled as two separate but intersecting boreholes.

For example, a U-tube borehole may be drilled as a first borehole extending from the first end at the first surface location and a second borehole extending from the second end at the second surface location. The first borehole and the second borehole may then intersect at a borehole intersection to provide the U-tube borehole.

The aspects of the invention which relate to the completion of U-tube boreholes and to the configuration of boreholes which include one or more U-tube boreholes are not dependent upon the manner in which the U-tube boreholes are drilled. In other words, the completion apparatus and/or methods and the configurations may be utilized with any U-tube borehole, however drilled.

The aspects of the invention which relate to the drilling of U-tube boreholes are primarily directed at the drilling of a first borehole and a second borehole toward a borehole intersection in order to provide the U-tube borehole. The first borehole and the second borehole may be drilled either sequentially or simultaneously. In either case, one of the boreholes may be described as the target borehole and the other of the boreholes may be described as the intersecting borehole.

The drilling of a U-tube borehole according to the invention includes a directional drilling component and an intersecting component. The purpose of the directional drilling component is to get the target borehole and the intersecting borehole to a point where they are close enough in proximity to each other to facilitate the drilling of the intersecting component. The purpose of the intersecting component is to create the borehole intersection between the target borehole and the intersecting borehole. The required proximity between the target borehole and the intersecting borehole is dependent upon the methods and apparatus which will be used to perform the intersecting component and is also dependent upon the accuracy with which the locations of the target borehole and the intersecting borehole can be determined.

The intersecting component typically involves drilling only in the intersecting borehole. The directional drilling component may involve drilling in both the target borehole and the intersecting borehole or may involve drilling only in the intersecting borehole.

For example, if the target borehole is drilled before the intersecting borehole, the directional drilling component will typically involve drilling only in the intersecting borehole in order to obtain the required proximity between the target borehole and the intersecting borehole. If, however, the target borehole and the intersecting borehole are drilled simultaneously, the directional drilling component may involve drilling in both the target borehole and the intersecting borehole, since the boreholes must be simultaneously drilled relative to each other to prepare the intersecting borehole for the drilling of the intersecting component. In either case, the success of the drilling of the directional drilling component is dependent upon the accuracy with which the locations of the target borehole and the intersecting borehole can be determined.

The U-shaped borehole may follow any azimuthal path or combination of azimuthal paths between the first surface location and the second surface location. Similarly, the U-shaped borehole may follow any inclination path between the first surface location and the second surface location.

For example, either or both of the target borehole and the intersecting borehole may include a vertical section and a directional section. The vertical section may be substantially vertical or may be inclined relative to vertical. The directional section may be generally horizontal or may be inclined at any angle relative to the vertical section. The inclinations of both the vertical section and the directional section relative to vertical may also vary over their lengths. Alternatively, either or both of the target borehole and the intersecting borehole may be comprised of a slanted borehole which does not include a vertical section.

The directional drilling component of drilling the U-tube borehole is performed in the directional sections of the target borehole and/or the intersecting borehole. The intersecting component of drilling the U-tube borehole is performed after the directional sections of the target borehole and the intersecting borehole have been completed. A distal end of the directional section of the target borehole defines the end of the directional section of the target borehole. Similarly, a distal end of the directional section of the intersecting borehole defines the end of the directional section of the intersecting borehole.

In situations where the distance between the first surface location and the second surface location is relatively large, the target borehole and/or the intersecting borehole may be characterized as "extended reach" boreholes. In these circumstances, either or both of the target borehole and the intersecting borehole may be comprised of an "extended reach profile" in which the vertical section of the borehole is relatively small (or is eliminated altogether) and the directional section is generally inclined at a relatively large angle relative to vertical.

The borehole intersection between the target borehole and the intersecting borehole may be comprised of a physical connection between the boreholes so that one borehole physically intersects the other borehole. Alternatively, the borehole intersection may be provided solely by establishing fluid communication between the boreholes without physically connecting them.

Fluid communication between the boreholes may be achieved through many different mechanisms. As a first example, fluid communication may be achieved by positioning the two boreholes in a relatively permeable formation so that gas and liquid can pass between the boreholes through the formation. As a second example, fluid communication can be achieved by creating fractures or holes in a relatively non-permeable formation between the boreholes using a perforation gun, a sidewall drilling apparatus, or similar device. As a third example, fluid communication can be achieved by washing away or dissolving a formation between the boreholes. For salt formations, water may be used to dissolve the formation. For carbonate formations such as limestone, acid solutions may be used to dissolve the formation. For loose sand or tar sand formations, water, steam, solvents or a combination thereof can be used to wash away or dissolve the formation. These techniques may be used in conjunction with slotted liners or screens located in one or both of the boreholes in order to provide borehole stability.

If the borehole intersection between the boreholes is to be achieved without physically connecting the boreholes, then the formation between the boreholes at the site of the intended borehole intersection should facilitate some technique such as those listed above for achieving fluid communication between the boreholes and thus provide the borehole intersection.

Completing a U-Tube Borehole

The U-tube borehole may be completed using conventional or known completion techniques and apparatus. Thus, for instance, at least a portion of either or both of the target and intersecting boreholes may be cased, and preferably cemented, using conventional or known techniques. Casing and cementing of the borehole may be performed prior to or following the intersection of the target and intersecting boreholes.

Thus, any conventional or known casing string may be extended through one or both of the target and intersecting boreholes, from a surface location towards a distal location for a desired distance. Similarly, at least a portion of either or both of the target and intersecting boreholes may be cemented back to the surface location between the casing string and the surrounding formation.

Following the making of the borehole intersection, a continuous open hole interval is provided between the target and intersecting boreholes, and particularly between the cased portions thereof. If desired, the borehole intersection may be expanded or opened up utilizing a conventional bore hole opener or underreamer. Further, if desired, the borehole intersection may be left as an open hole. However, preferably, the borehole intersection, and in particular the open hole interval, is completed in a manner which is suitable for the intended functioning or use of the U-tube borehole and which is compatible with the surrounding formation.

Various alternative methods and apparatus are described herein for completion of the open hole interval or borehole intersection. For illustrative purposes only, the methods and apparatus are described with reference to a "liner." However, with respect to the description of the completion methods and apparatus, the reference to a "liner" is understood herein as including or comprising any and all of a tubular member, a conduit, a pipe, a casing string, a liner, a slotted liner, a coiled tubing, a sand screen or the like provided to conduct or pass a fluid or other material therethrough or to extend a cable, wire, line or the like therethrough, except as specifically noted. Further, a reference to cement or cementing of a borehole includes the use of any hardenable material or compound suitable for use downhole.

Thus, for instance, the open hole interval may be completed by the installation of a liner which is extended through and positioned therein using conventional or known techniques. The liner therefore preferably extends across the open hole interval linking the cased portions of each of the target and intersecting boreholes. Further, once a liner or like structure is extended through the open hole interval, the open hole interval may be cemented, where feasible and as desired.

More particularly, the liner may be inserted from either the first surface location through the target borehole or the second surface location through the intersecting borehole for placement in the open hole interval. Further, the liner may be either pushed or pulled through the boreholes by conventional techniques and apparatus for the desired placement in the open hole interval or borehole intersection.

One or both of the opposed ends of the liner may be comprised of a conventional or known liner hanger for hanging or attaching the liner with one or both of the target or intersecting boreholes. Further, one or both of the opposed ends of the liner may be comprised of a conventional or known seal arrangement or sealing assembly in order to permit the end of the liner to be sealingly engaged with one or both of the target and intersecting boreholes and to prevent the entry of sand or other materials from the formation. Alternatively, one or both of the opposed ends of the liner may be extended to the surface. Thus, rather than extending only across the open hole interval, the liner may extend from one or both of the first and second surface locations and across the open hole interval.

As discussed above, a single liner may be utilized to complete the open hole interval or borehole intersection. However, alternatively, the liner may be comprised of two compatible liner sections which are connected, mated or coupled downhole to provide the complete liner. In this instance, preferably, a first liner section and a second liner section are run or inserted from the target borehole and the intersecting borehole to mate, couple or connect at a location within the U-tube borehole.

More particularly, in this instance, the first liner section includes a distal connection end for connection, directly or indirectly, with a distal connection end of the second liner section. The other opposed end of each of the first and second liner sections may include a conventional or known liner hanger for hanging or attaching the liner section with its respective target or intersecting borehole. Further, the end of each of the first and second liner sections opposed to the distal connection end may include a conventional or known seal arrangement or sealing assembly in order to permit the end of the liner section to be sealingly engaged with its respective target or intersecting borehole. Alternately, the end of the liner section opposed to the distal connection end, of one or both of the first and second liner sections, may be extended to the surface.

Each of the distal connection ends of the first and second liner sections may be comprised of any compatible connector, coupler or other mechanism or assembly for connecting, coupling or engaging the liner sections downhole in a manner permitting fluid communication or passage therebetween such that a flow path may be defined therethrough from one liner section to the other. Further, one or both of the distal connection ends may be comprised of a connector, coupler or other mechanism or assembly for sealingly connecting, coupling or engaging the liner sections. However, alternately, the connection between the liner sections may be sealed following the coupling, connection or engagement of the distal connection ends.

In a preferred embodiment, the distal connection ends of the first and second liners are shaped, configured or adapted such that one is receivable within the other. Thus, one of the first and second distal connection ends is comprised of a female connector or receptacle, while the other of the first and second distal connection ends is comprised of a compatible male connector or stinger adapted and configured for receipt within the female connector. Either or both of the female and male connectors may be connected, attached or otherwise affixed or fastened in any manner, either permanently or removably, with the respective distal connection end. Alternatively, either or both of the female and male connectors may be integrally formed with the respective distal connection end.

The female connector may be comprised of any tubular structure or tubular member capable of defining a fluid passage therethrough and which is adapted and sized for receipt of the male connector therein. Similarly, the male connector may also be comprised of any tubular structure or tubular member capable of defining a fluid passage therethrough and which is adapted and sized for receipt within the female connector. A leading edge of the male connector may be shaped or configured to assist or facilitate the guiding of the male connector within the female connector.

Further, the connection between the female and male connector is preferably sealed. Thus, each of the male and female connectors may be sized, shaped and configured such that the leading section or portion of the male connector may be closely received within the female connector. Further, a sealing assembly or compatible sealing structure may be associated with one or both of the female and male connectors. Alternatively, the connection may be sealed by cementing the connection following the receipt of the male connector within the female connector.

Further, any suitable latching mechanism or latch assembly may be provided between the male and female connector to retain the male connector in position within the female connector. The latching mechanism or latch assembly is preferably associated with each of the female connector and the male connector such that the latching mechanism engages as the male connector is passed within the female connector. More particularly, the female connector preferably provides an internal profile or contour for engagement with a compatible or matching external profile or contour provided by the male connector.

In a further embodiment, the distal connection ends are not shaped, configured or adapted such that one is receivable within the other. Rather, a bridging member, tubular member or pipe section is provided for extending between the distal connection ends of the first and second liner sections. Preferably, a bridge pipe is used to connect between the adjacent distal connection ends of the first and second liner sections. The bridge pipe may be comprised of any tubular member or structure capable of straddling or bridging the space or gap between the adjacent distal connection ends of the first and second liner sections and which provides a fluid passage therethrough.

The bridge pipe may be placed in position between the distal connection ends of the first and second liner sections using any suitable running or setting tool for placing the bridge pipe in the desired position downhole. Where desired, the bridge pipe may also be retrievable. Further, the bridge pipe may be retained in position using any suitable mechanism for latching or seating the bridge pipe within the distal connection ends of the liner sections.

Preferably, the bridge pipe is sealed with one or both of the distal connection ends. Thus, a sealing assembly or compatible sealing structure may be associated with one or both ends of the bridge pipe. Alternatively, a sealing assembly or compatible sealing structure may be associated with one or both the distal connection ends of the first and second liner sections. As a further alternative, the connection between the bridge pipe and the first and second liner sections may be sealed by cementing the connection following the placement of the bridge pipe.

Configurations of U-Tube Boreholes

The drilling and completion methods and apparatus described herein may be used to provide a series of interconnected U-tube boreholes or a network of U-tube boreholes, which may be referred to herein as a borehole network. The borehole network may be desirable for the purpose of creating an underground, trenchless pipeline or subterranean path or passage or for the purpose of creating a producing/injecting well over a great span or area, particularly where the connection occurs beneath the ground surface.

In a preferred embodiment, the borehole network comprises: (a) a first end surface location; (b) a second end surface location; (c) at least one intermediate surface location located between the first end surface location and the second end surface location; and (d) a subterranean path connecting the first end surface location, the intermediate surface location, and the second end surface location.

The borehole network is comprised of at least one intermediate surface location. However, preferably, the borehole network is comprised of a plurality of intermediate surface locations. Each intermediate surface location may be located at any position relative to the first and second end surface locations. However, preferably, each intermediate surface location is located within a circular area defined by the first end surface location and the second end surface location. Where the borehole network comprises a plurality of intermediate surface locations, all of the intermediate surface locations are preferably located within a circular area defined by the first end surface location and the second end surface location.

The U-tube boreholes forming the borehole network may be drilled and connected together in any order to create the desired series of U-tube boreholes. However, in each case, the adjacent U-tube boreholes are preferably connected downhole or below the surface by a lateral junction. A combined or common surface borehole extends from the lateral junction to the surface. In other words, each of the adjacent U-tube boreholes is preferably extended to the surface via the combined surface borehole.

Thus, the borehole network preferably extends between two end surface locations and includes one or more intermediate surface locations. Each intermediate surface location preferably extends from the surface via a combined surface borehole to a lateral junction.

Accordingly, in the preferred embodiment, the borehole network is further comprised of a surface borehole extending between the subterranean path and the intermediate surface location. Further, the subterranean path is preferably comprised of a pair of lateral boreholes which connect with the surface borehole. As well, the borehole network is preferably further comprised of a lateral junction for connecting the surface borehole and the pair of lateral boreholes.

Each of the end surface locations may be associated or connected with a surface installation such as a surface pipeline or a refinery or other processing or storage facility. More particularly, the borehole network preferably further comprises a surface installation associated with the first end surface location, for transferring a fluid to the borehole network. In addition, the borehole network preferably further comprises a surface installation associated with the second end surface location, for receiving a fluid from the borehole network.

Depending upon the particular configuration of the borehole network, the surface borehole may or may not permit fluid communication therethrough to the intermediate surface location associated therewith. In other words, fluids may be produced from the borehole network to the surface at one or more intermediate surface locations through the surface borehole. Alternately, the surface borehole of one or more intermediate surface locations may be shut-in by a packer, plugged or sealed in a manner such that fluids are simply communicated from one U-tube borehole to the next through the lateral junction provided therebetween.

Thus, depending upon the desired configuration of the borehole network, the borehole network may be further comprised of a sealing mechanism for sealing the intermediate surface location from the subterranean path.

Further, depending upon the desired configuration of the borehole network, the borehole network may be further comprised of a pump associated with the intermediate surface location, for pumping a fluid through the subterranean path. As well, the borehole network may be further comprised of a pump located at the intermediate surface location, for pumping a fluid through the subterranean path.

Alternatively, or in addition, the borehole network may be further comprised of a pump located in the surface borehole, for pumping a fluid through the subterranean path. In a further alternative, the borehole network may be further comprised of a pump located in one of the pair of lateral boreholes, for pumping a fluid through the subterranean path.

In each of these alternative instances, any downhole pump may be utilized for pumping the fluid through the subterranean path. However, preferably, the pump is an electrical submersible pump. Any compatible power source may be provided for the electrical submersible pump. Further, the power source may be positioned at any location within the borehole network suitable for providing the necessary power to the pump.

For instance, the borehole network may be further comprised of a power source located at the intermediate surface location, for providing electrical power to the electrical submersible pump. Alternatively, the borehole network may be further comprised of a power source located at one of the first end surface location or the second end surface location, for providing electrical power to the electrical submersible pump.

BRIEF DESCRIPTION OF DRAWINGS

Embodiments of the invention will now be described with reference to the accompanying drawings, in which:

FIG. 7, consisting of FIG. 7A and FIG. 7B, is a longitudinal section drawing of a connector for use in connecting two liner sections, according to a preferred embodiment of the invention, wherein

FIG. 8, consisting of FIG. 8A and FIG. 8B, is a longitudinal section drawing of a variation of the connector of FIG. 7, wherein

FIG. 9, consisting of FIG. 9A and FIG. 9B, is a longitudinal section drawing of a connector for use in connecting two liner sections, according to a preferred embodiment of the invention, wherein

FIG. 11, consisting of FIG. 11A and FIG. 11B, is a schematic depiction comparing an above-ground pipeline with a U-tube borehole pipeline in an environmentally sensitive area, wherein

DETAILED DESCRIPTION

Figure 1A:
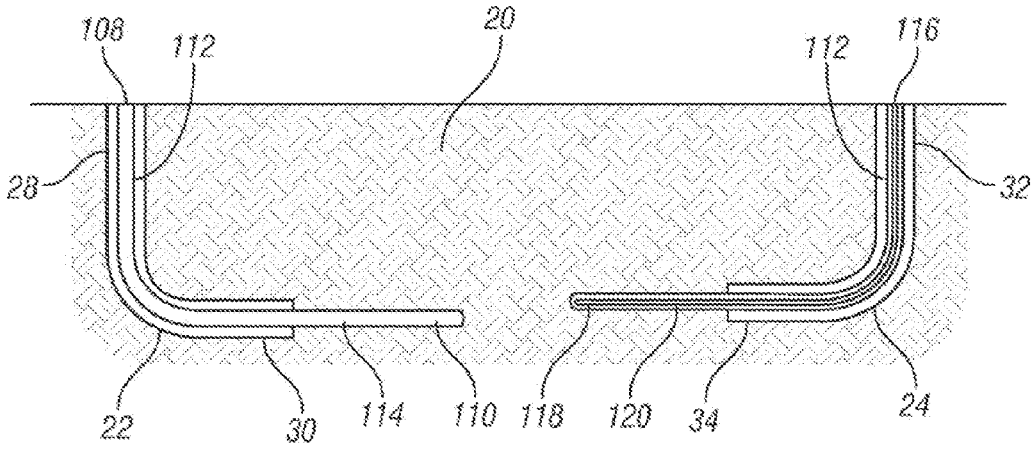
FIG. 1, consisting of FIGS. 1A through 1D, is a schematic depiction of the basic steps involved in drilling and completing a U-tube borehole according to a preferred embodiment of the invention.

The invention relates to the drilling of U-tube boreholes, to the completion of U-tube boreholes, to configurations of U-tube boreholes, and to production from and transferring of material through U-tube boreholes. Further, the invention relates to the utilization of the U-tube borehole as a conduit or underground pathway for the placement or extension of underground cables, electrical wires, natural gas or water lines or the like therethrough.

FIGS. 1A through 1D depict the drilling and a basic completion of a U-tube borehole. FIGS. 2 through 5 and FIGS. 7 through 9 depict different methods and apparatus for use in completing U-tube boreholes. FIG. 6 and FIGS. 10 through 13 depict different applications for U-tube boreholes and different configurations of U-tube boreholes.

1. Drilling Method

FIGS. 1A through 1D depict schematically the drilling and a basic completion of a U-tube borehole (20) according to a preferred embodiment of the invention. Referring to FIG. 1 generally, a first borehole is a target borehole (22) and a second borehole is an intersecting borehole (24). As depicted in FIG. 1, the target borehole (22) has been drilled before the intersecting borehole (24). In the preferred embodiment depicted in FIGS. 1A through 1D, a "toe to toe" borehole intersection is contemplated.

FIG. 1A depicts the drilling of the directional drilling component, which involves drilling only in the directional section of the intersecting borehole (24). In the directional drilling component, the intersecting borehole (24) is drilled toward the target borehole (22). The directional drilling component involves the use of conventional borehole surveying and directional drilling methods and apparatus, as well as surveying and drilling methods adapted specifically for use in the practice of the invention. These methods and apparatus will be described in detail below.

Figure 1B:
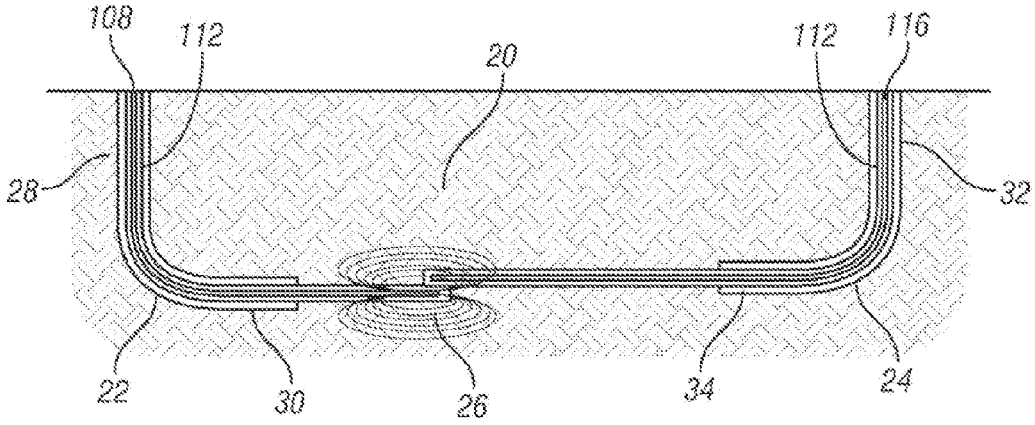

FIG. 1B depicts the drilling of the intersecting component, which involves drilling only in the directional section of the intersecting borehole (24). The drilling of the intersecting component involves the use of methods and apparatus for enabling the relatively accurate determination of the relative positions of the target borehole (22) and the intersecting borehole (24). The drilling of the intersecting component also involves the use of drilling methods specifically adapted for use in the practice of the invention. These methods and apparatus will be described in detail below.

Figure 1C:
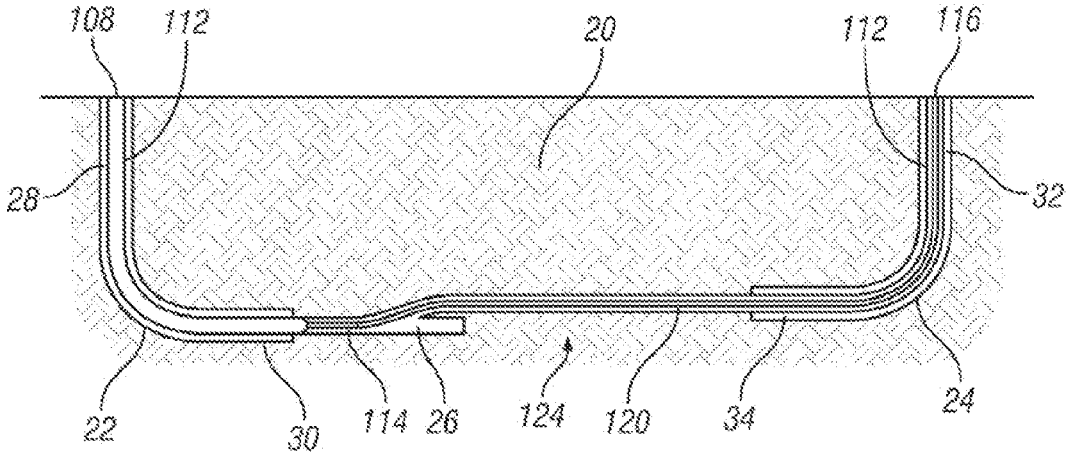

FIG. 1C depicts the U-tube borehole (20) after the drilling of the intersecting component, including the target borehole (22), the intersecting borehole (24) and a borehole intersection (26).

Referring to FIG. 1A, the drilling of the directional drilling component will now be described in detail.

As depicted in FIG. 1A, the target borehole (22) includes a vertical section (28) and a directional section (30). The directional section (30) is drilled from the vertical section (28) along a desired azimuthal path and a desired inclination path using methods and apparatus known in the art. The determination of azimuthal direction during drilling may be accomplished using a combination of one or more magnetic instruments such as magnetometers and one or more gravity instruments such as inclinometers or accelerometers. The determination of inclination direction during drilling may be accomplished using one or more gravity instruments. Magnetic instruments and gravity instruments may be associated with an MWD tool which is included in the drill string.

Alternatively, the determination of azimuthal direction and inclination direction may be accomplished using one or more gyroscope tools, magnetic instruments and/or gravity instruments which are lowered within the drill string in order to provide the necessary measurements as needed.

The drilling of the target borehole (22) is preferably preceded by a local magnetic declination survey, in order to provide for calibration of magnetic instruments for use at the specific geographical location of the target borehole (22). Local magnetic field measurements can also be used to determine the local magnetic field dip angle and the local magnetic field strength, which can also provide useful data for calibrating magnetic instruments.

In order to obtain greater accuracy in the azimuthal path and the inclination path, the use of magnetic instruments and gravity instruments in the drill string may be supplemented with gyroscope surveys made during the course of the drilling of the target borehole (22).

For example, a gyroscope survey may be performed in the target borehole (22) shortly after the commencement of the directional section of the target borehole (22) in order to enable the confirmation or calibration of data received from magnetic instruments and gravity instruments. Additional gyroscope surveys may be performed in the target borehole (22) at desired intervals during the drilling of the directional section (30) in order to provide for further confirmation or calibration. It may, however, be desirable to limit the number of gyroscope surveys, since drilling must be interrupted to permit the gyroscope instrumentation to be inserted in the borehole and removed from the borehole for each gyroscope survey performed.

Greater accuracy with respect to the azimuthal path of the target borehole (22) may also be obtained through the use of in-field referencing (IFR) techniques and/or interpolated in-field referencing (IIFR) techniques.

IFR and IIFR techniques are described in Russell, J. P., Shields, G. and Kerridge, D. J., Reduction of Well-Bore Positional Uncertainty Through Application of a New Geomagnetic In-Field Referencing Technique, Society of Petroleum Engineers (SPE), Paper 30452, 1995 and Clark, Toby D. G., Clarke, Ellen, Space Weather Services for the Offshore Drilling Industry, British Geological Survey, Undated.

At any location, the total magnetic field may be expressed as the vector sum of the contributions from three main sources: (a) the main field generated in the earth's core; (b) the crustal field from local rocks; and (c) a combined disturbance field from electrical currents flowing in the upper atmosphere and magnetosphere (due, for example, to solar activity), which also induce electrical currents in the sea and the ground.

Published magnetic declination values for a particular location typically consider only the main field generated in the earth's core. As a result, published magnetic declination values are often significantly different from actual local magnetic declination values.

In-field referencing (IFR) involves measuring the local magnetic field at, or close to, a drilling site in order to determine the actual local magnetic declination value at the drilling site. Unfortunately, while in-field referencing (IFR) may account for momentary anomalies (i.e., spikes) in the local magnetic field, IFR does not necessarily account for temporary anomalies (i.e., lasting several days) in the local magnetic field which may affect actual local magnetic declination values unless a fixed magnetic measurement device is maintained at, or close to, the drilling site so that the temporary anomalies can be tracked over time. Momentary and temporary anomalies in the local magnetic field may be due to magnetic disturbances in the atmosphere and magnetosphere or may be due to crustal anomalies.

Interpolated in-field referencing (IIFR) potentially obviates the need for providing a fixed magnetic measurement device at the drilling site in order to account for temporary anomalies. Instead, close to the drilling site, but sufficiently remote to avoid significant interference, a series of "spot" or "snap shot" measurements of the absolute values of magnetic field intensity and direction are made. These measurements are used to establish base-line differences between the measurements made close to the drilling site and measurements made at one or more fixed locations which may be several hundreds of kilometers from the drilling site. An estimate of the actual magnetic field intensity and direction at the drilling site can then be made at any time by using data from the fixed locations and the base line information. Interpolated in-field referencing (IIFR) therefore involves interpolation of data from one or more fixed locations to determine the actual magnetic declination value at the drilling site.

The use of in-field referencing (IFR) techniques and/or interpolated in-field referencing (IIFR) techniques facilitate the calibration of magnetic instruments before and/or during drilling the target borehole (22) to account for differences between published magnetic declination values and actual local magnetic declination values and to account for momentary and temporary anomalies in the local magnetic field.

For example, an initial calibration of magnetic instruments to be used in drilling the target borehole (22) can be performed before drilling commences. Magnetic field monitoring using IFR and/or IIFR techniques may also be performed during drilling of the target borehole (22) in order to obtain greater accuracy in the use of magnetic instruments.

For these purposes, one or more magnetic monitoring stations may be established in the geographical area of the U-tube borehole (20) before and/or during drilling the target borehole (22). By monitoring the local magnetic field, drilling personnel are able to correct or calibrate data obtained from magnetic instruments which may have been influenced by momentary or temporary anomalies in the local magnetic field. By maintaining a fixed magnetic measuring station in the geographical area of the U-tube borehole or by using IIFR techniques, the effects of temporary anomalies can be minimized further.

Alternatively, if the directions of the azimuthal path and the inclination path of the target borehole (22) are not critical, the target borehole (22) may be drilled with relatively less control over the paths being exerted during drilling. In this case, the target borehole (22) may be surveyed following drilling using either gyroscopic instruments, magnetic instruments, gravity instruments, or a combination thereof in order to obtain a relatively accurate determination of the azimuthal path and the inclination path of the target borehole (22) on an "as-drilled" basis.

The directional section (30) of the target borehole (22) should extend at least to the planned borehole intersection (26). Preferably, the target borehole (22) will overlap for a distance past the planned borehole intersection (26) in order to facilitate drilling of the intersecting component of the U-tube borehole (20).

The overlap distance may be any distance which will facilitate drilling of the intersecting component without unnecessarily extending the length of the target borehole (22). The length of the overlap will depend upon an offset distance between the target borehole (22) and the intersecting borehole (24) at the beginning of drilling of the intersecting component and upon the accuracy with which the locations of the target borehole (22) and the intersecting borehole (24) have been determined. The overlap distance will also depend upon the survey techniques and apparatus which are used for drilling the intersecting component.

As a result, in some applications an overlap distance of 1 meter may be sufficient. In preferred embodiments, the amount of overlap of the target borehole (22) relative to the planned borehole intersection (26) is between about 1 meter and about 150 meters.

The target borehole (22) may be provided with a casing or liner before the drilling of the intersecting component of the U-tube borehole (20) if potential collapse of the target borehole (22) is a concern. If a casing or liner is provided, a length of the distal portion of the directional section (30) of the target borehole (22) should either be left without a casing or a liner or should be provided with a casing or liner which is constructed of a material which can easily be drilled through to facilitate completion of the borehole intersection (26).

The length of this distal portion should be sufficient to facilitate completion of the borehole intersection (26) without encountering a casing or liner which is constructed of a material which is difficult to drill through. This will avoid deflection of the drill bit and resulting inability to complete the borehole intersection (26), particularly at relatively low angles of incidence or approach between the intersecting borehole (24) and the target borehole (22).

As depicted in FIG. 1A, the intersecting borehole (24) includes a vertical section (32) and a directional section (34). The directional section (34) is drilled from the vertical section (28) along a desired azimuthal path and a desired inclination path in similar manner as described above with respect to the target borehole (22). The end of the directional section (34) of the intersecting borehole (24) defines the end of the directional drilling component and defines the beginning of the intersecting component of the U-tube borehole (20).

The desired azimuthal path and the desired inclination path of the intersecting borehole (24) will be determined by the location of the target borehole (22) and the planned location of the borehole intersection (26).

The goal in drilling the directional drilling component of the U-tube borehole (20) is to control the azimuthal path and the inclination path of the intersecting borehole (24) relative to the azimuthal path and the inclination path of the target borehole (22) so that the distance between the target borehole (22) and the intersecting borehole (24) at the end of the directional drilling component is within the range of the methods and apparatus which are to be used in the drilling of the intersecting component. The planning of the directional drilling component should also consider the accuracy with which the locations of the target borehole (22) and the intersecting borehole (24) can be determined using the methods and apparatus described above. As the accuracy with which the locations of the boreholes (22, 24) can be determined increases, the goal of the directional drilling component becomes more easy to achieve.

For example, if the distance between the target borehole (22) and the intersecting borehole (24) at the end of the directional drilling component is outside of the effective range of the methods and apparatus which are to be used in the drilling of the intersecting component, and the combined uncertainty in the positions of the target borehole (22) and the intersecting borehole (24) is very large, it may be difficult or impossible to ascertain which direction to drill in order to move within the effective range of the chosen methods and apparatus. This raises the possibility of a wrong guess and a resulting waste of time and drilling resources.

The end of the directional drilling component as it relates to the intersecting borehole (24) is preferably reached before the borehole intersection (26) is reached. In other words, the directional section (34) of the intersecting borehole (24) preferably ends before the planned borehole intersection (26). The distance between the end of the directional section (34) of the intersecting borehole (24) and the planned borehole intersection (26) should be sufficient to enable the effective use of the methods and apparatus which are used during the intersecting component and should be sufficient to provide a relatively smooth intersection or transition between the target borehole (22) and the intersecting borehole (24).

Preferably the directional section (34) of the intersecting borehole (24) is drilled to provide a discontinuity, radius or bend before the end of the directional section (34). The purpose of this discontinuity, radius or bend is to provide a convenient sidetrack location for sidetracking from the intersecting borehole (24) and thus make a second attempt at performing the intersecting component in the event that the target borehole (22) is missed during the first attempt. The orientation of the discontinuity, radius or bend is preferably upward so that sidetracking from the intersecting borehole (24) may be assisted by gravity.

The location of the discontinuity, radius or bend is preferably spaced back from the end of the directional section (34) of the intersecting borehole (24) by an amount sufficient to facilitate a sidetrack operation and subsequent performance of the intersecting component from the sidetrack borehole. This location will be dependent upon the formations traversed by the intersecting borehole (24) and will be dependent upon the accuracy with which the locations of the target borehole (22) and the intersecting borehole (24) can be determined, since the location of the discontinuity, radius or bend should take into account the measurement errors.

The intersecting borehole (24) may be provided with a casing or liner before the drilling of the intersecting component of the U-tube borehole (20) if potential collapse of the intersecting borehole (24) is a concern. If a casing or liner is provided, the distal portion of the directional section (34) of the intersecting borehole (24) should either be left without a casing or a liner or should be provided with a casing or liner which is constructed of a material which can easily be drilled through to facilitate completion of the borehole intersection (26).

Referring to FIG. 1B and FIG. 1C, the drilling of the intersecting component will now be described in detail.

The drilling of the intersecting component may be performed using any suitable methods and apparatus which can provide the required amount of accuracy for completing the borehole intersection (26).

Preferably the drilling of the intersecting component is performed using ranging methods and apparatus such as magnetic ranging methods and apparatus, acoustic ranging methods and apparatus or electromagnetic ranging methods and apparatus.

In preferred embodiments the drilling of the intersecting component is performed using active magnetic ranging methods and apparatus such as those described in Grills, Tracy L., Magnetic Ranging Technologies for Drilling Steam Assisted Gravity Drainage Well Pairs and Unique Well Geometries—A Comparison of Technologies, Society of Petroleum Engineers (SPE), Paper 79005, 2002. Any active and passive magnetic ranging apparatus and methods, including those referenced in SPE Paper 79005, may be adapted for use in completing the borehole intersection (26) in accordance with the invention.

In preferred embodiments, the drilling of the intersecting component may be performed either using the magnetic ranging methods and apparatus described in U.S. Pat. No. 5,485,089 (Kuckes) and Kuckes, A. F., Hay, R. T., McMahon, Joseph, Nord, A. G., Schilling, D. A. and Morden, Jeff, New Electromagnetic Surveying/Ranging Method for Drilling Parallel Horizontal Twin Wells, Society of Petroleum Engineers (SPE), Paper 27466, 1996 (collectively referred to hereafter as the "Magnetic Guidance Tool" or "MGT" system), or using the magnetic ranging methods and apparatus described in U.S. Pat. No. 5,589,775 (Kuckes) (referred to hereafter as the "Rotating Magnet Ranging System" or "RMRS").

Both the MGT system and the RMRS exhibit inherent advantages and disadvantages. As a result, in some applications the MGT system may be the preferred choice while in other applications the RMRS may be the preferred choice. The advantages of the MGT system and the RMRS may potentially be combined by utilizing a magnetic ranging system which includes some of the features of both the MGT system and the RMRS. As a result, although the MGT system and the RMRS represent current preferred methods and apparatus for use in completing the borehole intersection (26), they should be considered only to be exemplary magnetic ranging systems for the purpose of the invention.

The MGT system involves the placement in the target borehole (22) of a magnet comprising a relatively long solenoid which is oriented with the magnet poles aligned parallel to the target borehole (22) and which is energized with a varying electrical current to provide a varying magnetic field emanating from the target borehole (22). The magnetic field is sensed in the intersecting borehole (24) by a magnetic instrument which is associated with the MWD in the drill string. The magnetic instrument used for the MGT system may be comprised of a three-axis magnetometer or of any other suitable instrument or combination of instruments.

The RMRS involves the integration into the drill string which is drilling the intersecting borehole (24) of a magnet comprising a magnet assembly which is oriented with the magnet poles transverse to the drill string axis. The magnet assembly is rotated with the drill string during drilling of the intersecting borehole (24) to provide an alternating magnetic field emanating from the intersecting borehole (24). The magnetic field is sensed in the target borehole (22) by a magnetic instrument which is lowered into the target borehole (22). The magnetic instrument used for the RMRS may be comprised of a three-axis magnetometer or of any other suitable instrument or combination of instruments.

Referring to FIG. 1, the axis of the directional section (34) of the intersecting borehole (24) at the distal end of the directional section (34) and the axis of the directional section (30) of the target borehole (22) in the vicinity of the intended borehole intersection (26) are preferably not coaxial. In other words, it is preferable that the target borehole (22) not be approached "head-on" in completing the borehole intersection (26).

Instead, it is preferable that there be some amount of offset between the axes of the target borehole (22) and the intersecting borehole (24) at the commencement of the drilling of the intersecting component. The offset may be in any relative direction between the boreholes (22, 24). Preferably but not essentially, the axes of the target borehole (22) and the intersecting borehole (24) are generally or substantially parallel at the commencement of the drilling of the intersecting component.

As depicted in FIG. 1, the directional section (34) of the intersecting borehole (24) is offset so that it is above and in the same vertical plane as the directional section (30) of the target borehole (22). This, however, may increase the likelihood of collapse of the target borehole (22) during completion of the borehole intersection (26). Alternatively, the intersecting borehole (24) may be offset horizontally from the target borehole (22), offset below the target borehole (22) or offset in any other direction relative to the target borehole (22).

One reason for providing an offset between the axes of the boreholes (22, 24) at the commencement of the drilling of the intersecting component is to maximize the effectiveness of the ranging technique which is utilized. For example, both the MGT system and the RMRS generate a magnetic field which can be more effectively sensed or measured at particular locations or orientations relative to the magnetic field. These locations or orientations may be referred to as "sweet spots" for the ranging apparatus.

Generally, the sweet spots for a particular ranging apparatus are located where the direction of the magnetic field is at an oblique angle relative to the apparatus. In the case of the MGT system and the RMRS, the shapes of the magnetic fields are very similar, but are oriented at 90 degrees relative to each other. The reason for this is that the solenoid for the MGT system is oriented with its magnetic poles parallel to the axis of the target borehole (22), while the rotating magnet for the RMRS is oriented with its magnetic poles transverse to the axis of the intersecting borehole (24).

Referring to FIG. 1B, there is depicted a typical magnetic field which would be generated by an MGT apparatus in the target borehole (22). As can be seen from FIG. 1B, the sweet spots within the magnetic field will be located at the four corners of the magnetic field where the magnetic field is neither parallel or perpendicular to the target borehole (22).

It can therefore be seen that for both the MGT system and the RMRS, providing an offset between the axes of the boreholes (22, 24) at the commencement of the drilling of the intersecting component will enable the ranging measurements to be taken within or near to the sweet spots by effectively positioning the magnetic instrument within or near the sweet spots of the magnetic field as the intersecting component is being drilled.

The positioning of the magnetic instrument in the sweet spots of the magnetic field can be maintained as the intersecting component is being drilled by periodically adjusting the position of the solenoid in the target borehole (22) (in the case of the MGT system) and the magnetic instrument in the target borehole (22) (in the case of the RMRS) while the intersecting component is being drilled. This periodical adjustment can be effected by manipulating the solenoid or the magnetic instrument, as the case may be, with a wireline, a tubular string, a downhole tractor, a surface tractor, or any other suitable method or apparatus.

For example, the solenoid or the magnetic instrument, as the case may be, may be connected with a composite coil tubing string, which is preferably neutrally buoyant, and manipulated with a downhole tractor, as is described in U.S. Pat. No. 6,296,066 (Terry et al). The use of a neutrally buoyant tubular string allows for a farther reach within the target borehole (22) than if the tubular string is not neutrally buoyant.

A second reason for providing an offset between the axes of the boreholes (22, 24) at the commencement of the drilling of the intersecting component is to minimize the effects of error and uncertainty in the relative positions of the boreholes (22, 24).

For example, it may be desirable, when faced with potentially large error or uncertainty in the relative positions of the boreholes (22, 24), to provide an offset which is sufficiently large to ensure that the intersecting borehole (24) is on a known side of the target borehole (22) despite the magnitude of the error or uncertainty. This will provide a known direction to steer towards in order to close the gap between the boreholes (22, 24) even where the distance between the boreholes (22, 24) is initially outside of the effective range of the chosen ranging method and apparatus. The desired amount of the offset should be selected with consideration being given of the effective range of the ranging method and apparatus and the length of the overlap of the target borehole (22) and the intersecting borehole (24) which will be required in order to close the offset gap and complete the borehole intersection (26).

The effects of error or uncertainty in borehole surveying can be managed to some extent in the drilling of the directional component of the U-tube borehole (20). For example, lateral error is generally far greater than vertical error, in some instances by a factor of ten. This phenomenon may be taken into account in evaluating positional data from borehole surveys. In addition, the drilling apparatus may be provided with sensors for determining formation type, which together with geological indicators and seismic survey data can be used to more accurately determine the position of the boreholes (22, 24), particularly in the vertical direction. This is especially true where the formations are oriented substantially horizontally.

Preferably the intersecting component of the U-tube borehole (20) is drilled such that a relatively smooth transition is created between the target borehole (22) and the intersecting borehole (24) throughout the borehole intersection (26).

It has been found that good results can be achieved if the gauge of the drill bit or equivalent tool which is used to drill the intersecting component is smaller than the size of the target borehole (22), since a smaller gauge drill bit will tend to be more flexible and will tend to intersect the target borehole (22) more easily. Once the borehole intersection (26) is completed, a hole opener such as a larger gauge drill bit or a reamer can be passed through the borehole intersection (26) in order to enlarge the borehole intersection (26) to "full gauge" relative to the target borehole (22) and the intersecting borehole (24).

It has also been found that good results can be achieved if the intersecting component of the U-tube borehole (20) is drilled as an "S-shape" curve (i.e., a curve with two opposing radiuses or doglegs), so that the shape of the borehole intersection (26) can be described as a "reverse sidetrack" configuration. The use of an S-shape curve facilitates a relatively smooth approach to the target borehole (22) from the intersecting borehole (24) and a relatively smooth transition between the target borehole (22) and the intersecting borehole (24) at the borehole intersection (26). The goal in completing the borehole intersection (26) is to approach the target borehole (22) at an angle which is neither so small that the borehole intersection becomes inordinately long and uneven or so large that the drilling apparatus used to complete the borehole intersection (26) passes entirely through the target borehole (22) without providing a usable borehole intersection (26).

The use of an S-shaped curve is advantageous where the target borehole (22) and the intersecting borehole (24) are substantially parallel at the commencement of drilling of the intersecting component. In some circumstances, including circumstances where the boreholes (22, 24) are not substantially parallel at the commencement of drilling of the intersecting component, a single radius curve may be appropriate for completing the borehole intersection (26). In other circumstances, the drilling of the intersecting component may result in a curve with more than two radii.

The S-shaped curve may have any configuration which will facilitate the borehole intersection (26). Preferably the severity of the two radii is not greater than that which will provide a relatively smooth transition between the target borehole (22) and the intersecting borehole (24). Preferably the two radii are approximately equal in curvature and in length so that the S-shaped curve can span the offset between the target borehole (22) and the intersecting borehole (24) as smoothly as possible. For example, the radii may each have an curvature of about one degree per ten meters so that the length of the borehole intersection (26) will depend upon the amount of the offset between the target borehole (22) and the intersecting borehole (24).

Preferred embodiments of the drilling of the intersecting component of a U-tube borehole (20) to provide a borehole intersection (26), using each of an MGT and an RMRS magnetic ranging technique, is described below. In both embodiments, a first magnetic device comprising one of a magnet or a magnetic instrument is placed in the target borehole (22) and a second magnetic device, comprising the other of the magnet or the magnetic instrument, is incorporated into the drill string. In the embodiment using the MGT magnetic ranging technique, the magnet is comprised of a solenoid which may be energized with varying current in order to provide a varying magnetic field. In the embodiment using the RMRS magnetic ranging technique, the magnet is comprised of a magnet assembly which may be rotated with the drill string in order to provide a varying magnetic field.

In a preferred embodiment where the ranging method and apparatus is comprised of the MGT system, the intersecting component of a "toe to toe" U-tube borehole (20) may be drilled as follows.

As a preliminary requirement, the offset between the target borehole (22) and the intersecting borehole (24) prior to commencing the intersecting component should be no greater than the effective range of the MGT system. As a result, the offset should preferably be less than about 25 to about 30 meters.

First, a magnet comprising an MGT solenoid is placed in the target borehole (22) toward the end of the portion of the target borehole (22) which overlaps the intended borehole intersection (26), such that the solenoid will be within range of the magnetic instrument, such as a three-axis magnetometer, contained within the drill string which is located in the intersecting borehole (24). The length of the overlap of the target borehole (22) and the position of the MGT solenoid within the overlap portion of the target borehole (22) should take into consideration the distance between the drill bit and the magnetic instrument contained in the drill string.

Second, an initial magnetic ranging survey is performed by energizing the solenoid at least twice with reversed polarities and sensing the magnetic fields with the magnetic instrument in the drill string in order to obtain data representing the relative positions of the solenoid and the magnetic instrument at the commencement of drilling of the intersecting component.

Third, the drilling of a first radius section is commenced toward the target borehole (22), using initial steering coordinates as indicated by the initial magnetic ranging survey, preferably using a drill bit which has a smaller gauge than the directional section (30) of the target borehole (22).

Fourth, the solenoid is moved within the target borehole (22) to a new position which will facilitate a further magnetic ranging survey. Preferably the new position of the solenoid will position the solenoid such that the magnetic instrument in the drill string will be within or near to one of the sweet spots of the magnetic field generated by the solenoid.

Fifth, a further magnetic ranging survey is performed by energizing the solenoid at least twice with reversed polarities of a varying electrical current in order to obtain data representing the new relative positions of the solenoid and the magnetic instrument, following which steering adjustments may be made as indicated by the further magnetic ranging survey.

Sixth, the steps of moving the solenoid within the target borehole (22) and performing a further magnetic ranging survey are repeated as necessary or desirable in order to facilitate further steering adjustments to guide the drilling of the first radius section.

Seventh, when the first radius section has traversed approximately one half of the offset between the target borehole (22) and the intersecting borehole (24), a second radius section is commenced in order to complete the borehole intersection (26). The steps of moving the solenoid within the target borehole (22) and performing a further magnetic ranging survey may be repeated prior to commencing the drilling of the second radius section in order to generate initial steering coordinates for the drilling of the second radius section.

Eighth, the steps of moving the solenoid within the target borehole (22) and performing a further magnetic ranging survey are repeated as necessary or desirable in order to facilitate steering adjustments to guide the drilling of the second radius section.

Ninth, the target borehole (22) is intersected by the intersecting borehole (24) to provide the borehole intersection (26).

Tenth, the borehole intersection (26) between the target borehole (22) and the intersecting borehole (24) is cleaned and enlarged to full gauge by passing a hole opener through the borehole intersection (26) in order to finish the drilling of the borehole intersection (26).

In a preferred embodiment where the ranging method and apparatus is comprised of the RMRS, the intersecting component of the U-tube borehole (20) may be drilled as follows.

As a preliminary requirement, the offset between the target borehole (22) and the intersecting borehole (24) prior to commencing the intersecting component should be no greater than the effective range of the RMRS. As a result, the offset should preferably be less than about 70 meters.

First, a magnetic instrument, such as a three axis magnetometer, is placed in the target borehole (22). The magnetic instrument may be placed within or outside of a portion of the target borehole (22) which overlaps the intended borehole intersection (26).

Second, an RMRS magnet assembly, is incorporated into the drill string which is drilling the intersecting component, preferably near to the drill bit, and more preferably within or immediately behind the drill bit. Since the magnet assembly in the RMRS embodiment may be closer to the drill bit than is the magnetic instrument in the MGT embodiment, the overlap portion of the target borehole (22) may not be as important in the practice of the RMRS embodiment than it is in the practice of the MGT embodiment.

Third, an initial magnetic ranging survey is performed by generating a varying magnetic field with the magnet assembly (by rotating the drill string) and sensing the magnetic field with the magnetic instrument in the target borehole (22) in order to obtain data representing the relative positions of the magnet assembly and the magnetic instrument at the commencement of drilling of the intersecting component.

Fourth, the drilling of a first radius section is commenced toward the target borehole (22) using initial steering coordinates as indicated by the magnetic ranging survey, preferably using a drill bit which has a smaller gauge than the directional section (30) of the target borehole (22).

Fifth, the magnetic instrument is moved within the target borehole (22) to a new position which will facilitate a further magnetic ranging survey. Preferably the new position of the magnetic instrument will position the magnetic instrument such that the magnetic instrument will be within or near to one of the sweet spots of the magnetic field generated by the magnet assembly as the drill string rotates.

Sixth, a further magnetic ranging survey is performed by rotating the drill string in order to obtain data representing the new relative positions of the magnet assembly and the magnetic instrument, following which steering adjustments may be made as indicated by the further magnetic ranging survey.

Seventh, the steps of moving the magnetic instrument within the target borehole (22) and performing a further magnetic ranging survey are repeated as necessary or desirable in order to facilitate steering adjustments to guide the drilling of the first radius section.

Eighth, when the first radius section has traversed approximately one half of the offset between the target borehole (22) and the intersecting borehole (24), a second radius section is commenced in order to complete the borehole intersection (26). The steps of moving the magnetic instrument within the target borehole (22) and performing a further magnetic ranging survey may be repeated prior to commencing the drilling of the second radius section in order to generate initial steering coordinates for the drilling of the second radius section.

Ninth, the steps of moving the magnetic instrument within the target borehole (22) and performing a further magnetic ranging survey are repeated as necessary or desirable in order to facilitate steering adjustments to guide the drilling of the second radius section.

Tenth, the target borehole (22) is intersected by the intersecting borehole (24) to provide the borehole intersection (26).

Eleventh, the borehole intersection (26) between the target borehole (22) and the intersecting borehole (24) is cleaned and enlarged to full gauge by passing a hole opener through the borehole intersection (26) in order to finish the drilling of the borehole intersection (26).

Once the U-tube borehole (20) has been drilled, the completion of the U-tube borehole (20) may then be performed using methods and apparatus as described below.

Although preferred embodiments of the method of drilling the intersecting component of the U-tube borehole (20) have been described with reference to the MGT system and the RMRS, it is specifically noted that any suitable ranging methods and apparatus may be used to drill the intersecting component. For example, other methods and apparatus described in SPE Paper 79005 referred to above, including the single wire guidance ("SWG") method and apparatus, could be used.

In addition, the MGT system and the RMRS may be modified for use in the invention. For example, the MGT system may be adapted to provide for a magnet assembly in the target borehole (22) instead of a solenoid, and the RMRS may be modified to provide for a solenoid in the drill string instead of a magnet assembly. Furthermore, the rotating magnet used in the MGT system may be comprised of one or more permanent magnets or one or more electromagnets.

The drilling of the U-tube borehole (20) has been described with reference to drilling an approaching "toe to toe" borehole intersection (26) between the target borehole (22) and the intersecting borehole (24) such that the borehole intersection (26) is located between the surface location (108) of the target borehole (22) and the surface location (116) of the intersecting borehole (24). In other words, when viewed from above, the surface location (108) of the target borehole (22) and the surface location (116) of the intersecting borehole (24) define a circular area and the borehole intersection (26) is located within the circular area.

The methods and apparatus of the invention may, however, be applied to the drilling of a U-tube borehole (20) having any configuration between the target borehole (22) and the intersecting borehole (24).

As one example, the intersecting borehole (24) may be drilled in the same general direction as the target borehole (22) such that the vertical section (32) of the intersecting borehole (24) is located between the vertical section (28) of the target borehole (22) and the borehole intersection (26). In this example, the borehole intersection (26) is located outside of a circular area defined by the surface location (108) of the target borehole (22) and the surface location (116) of the intersecting borehole (24). This configuration may be useful for drilling a U-tube borehole (20) in which the main purpose is to extend the reach of the directional section (30) of the target borehole (22) by connecting it with the directional section (34) of the intersecting borehole (24).

As a second example, the intersecting borehole (24) may be drilled relative to the target borehole (22) such that the borehole intersection (26) is not located in the same vertical plane as the vertical section (28) of the target borehole (22) and the vertical section (32) of the intersecting borehole (24). This configuration may be useful for drilling a group of U-tube boreholes (20) to provide a "matrix" covering a specified subterranean area. In this example, the borehole intersection (26) may be located either within or outside of a circular area defined by the surface location (108) of the target borehole (22) and the surface location (116) of the intersecting borehole (24).

The invention as it relates to the drilling of a U-tube borehole (20) may be utilized for any type of U-tube borehole (20), including those with relatively shallow or relatively deep borehole intersections (26), or those with relatively short and relatively long directional sections (30, 34).

The invention may be utilized in the drilling of a U-tube borehole (20) having relatively long directional sections (30, 34) in situations where torque and drag on the drill string become significant issues.

For such a U-tube borehole (20), the drilling of the U-tube borehole (20) preferably utilizes a rotary steerable drilling device. The use of a rotary steerable drilling device eliminates or minimizes static friction in the U-tube borehole (20), thus potentially reducing torque and drag. Although any type of rotary steerable device may be used to drill such a U-tube borehole (20), a preferred rotary steerable drilling device is the GeoPilot™ rotary steerable system which is available from Halliburton Energy Services, Inc. Features of the GeoPilot™ rotary steerable drilling device are described in U.S. Pat. No. 6,244,361 (Comeau et al) and U.S. Pat. No. 6,769,499 (Cargill et al).

Additionally or alternatively, for such a U-tube borehole (20), the drilling of the U-tube borehole (20) preferably utilizes a bottom hole assembly ("BHA") configuration such as the SlickBore™ matched drilling system from Halliburton Energy Services, Inc., principles of which are described in U.S. Pat. No. 6,269,892 (Boulton et al), U.S. Pat. No. 6,581,699 (Chen et al) and U.S. Patent Application Publication No. 2003/0010534 (Chen et al). The use of such a BHA configuration facilitates the creation of a U-tube borehole (20) that is relatively more straight, smooth and even in comparison with conventional boreholes, thus potentially reducing torque and drag.

Preferably, where either or both of the target borehole (22) and the intersecting borehole (24) is comprised of an extended reach borehole with a relatively long directional section (30, 34), the drill string includes both a rotary steerable drilling device and a BHA configuration as described in the preceding paragraph.

Alternatively, the U-tube borehole (20) may be drilled in whole or in part using a drilling system such as the Anaconda™ well construction system available from Halliburton Energy Services, Inc. Principles of the Anaconda™ well construction system are described in Marker, Roy, Haukvik, John, Terry, James B., Paulk, Martin D., Coats, E. Alan, Wilson, Tom, Estep, Jim, Farabee, Mark, Berning, Scott A. and Song, Haoshi, Anaconda: Joint Development Project Leads to Digitally Controlled Composite Coiled Tubing Drilling System, Society of Petroleum Engineers (SPE), Paper 60750, 2000 and U.S. Pat. No. 6,296,066 (Terry et al). The use of such a drilling system may also serve to reduce torque and drag, and may be further utilized in the completion of the U-tube borehole (20) as described herein.

2. U-Tube Borehole Completion

With respect to the completion of the U-tube borehole (20), as shown in FIG. 1C, prior to commencing the drilling of the intersection between the target borehole (22) and the intersecting borehole (24), at least a portion of each of the target and intersecting boreholes (22, 24) may be cased, and preferably cemented, using conventional or known techniques.

As shown in FIGS. 1A and 1C for a single U-tube borehole (20), the target borehole (22) extends from a first surface location (108) to a distal end (110) downhole. Further, the target borehole (22) includes a casing string (112) which preferably extends from the first surface location (108) towards the distal end (110) for a desired distance. Further, in the preferred embodiment, the target borehole (22) is preferably cemented back to the first surface location (108) between the casing string (112) and the surrounding formation. However, cementing of the target borehole (22) may be performed, where desired, following the intersection of the target and intersecting boreholes (22, 24).

Preferably, the portion of the target borehole (22) at or adjacent the distal end (110) downhole is left open hole, in that it is neither cased nor cemented. As discussed previously, it is this open hole portion or section (114) of the target borehole (22) which is typically intended to be intersected by the intersecting borehole (24). The length or distance of this open hole portion (114) of the target borehole (22) is selected to provide a sufficient distance to permit the intersecting borehole (24) to intersect with the target borehole (22) by the above described drilling method before reaching the cased portion of the target borehole (22). The open hole portion (114) may have any desired orientation. However, in the preferred embodiment, as shown in FIGS. 1A and 1C, the open hole portion (114) of the target borehole (22), at or adjacent to the distal end (110) thereof, has a generally horizontal orientation.

Similarly, as shown in FIGS. 1A and 1C for a single U-tube borehole (20), the intersecting borehole (24) extends from a second surface location (116) to a distal end (118) downhole. Further, the intersecting borehole (24) also includes a casing string (112) which preferably extends from the second surface location (108) towards the distal end (118) for a desired distance, wherein the distal end (118) is in proximity to the open hole portion (114) of the target borehole (22) prior to the commencement of the drilling of the borehole intersection (26), as detailed above. In the preferred embodiment, the intersecting borehole (24) is preferably cemented back to the second surface location (116) between the casing string (112) and the surrounding formation. However, cementing of the intersecting borehole (24) may be performed, where desired, following the intersection of the target and intersecting boreholes (22, 24).

Preferably, the portion of the intersecting borehole (24) at or adjacent the distal end (118) downhole is also left open hole, in that it is neither cased nor cemented. As discussed previously, it is from this open hole portion or section (120) of the intersecting borehole (24) that drilling of the borehole intersection (26) commences. The open hole portion (120) of the intersecting borehole (24) may have any desired length or distance. Further, the open hole portion (120) may have any desired orientation, as discussed above, which is compatible with the method for drilling the intersection. In the preferred embodiment, as shown in FIGS. 1A and 1C, the open hole portion (120) of the intersecting borehole (24), at or adjacent to the distal end (118) thereof, has a generally horizontal orientation.

Each of the target and intersecting boreholes (22, 24) are cased, and may be subsequently cemented, in a conventional or known manner. Further, the casing string (112) in each of the target and intersecting boreholes (22, 24) may be comprised of any conventional or known casing material. Preferably, conventional steel pipe or tubing is utilized. However, the casing string (112), or at least a part of it, may be comprised of a softer material, which is readily drillable and which is substantially weaker than the surrounding formation and/or the drill bit. For example, the casing string (112) may be comprised of a relatively weaker composite material such as plastic, Kevlar™, fiberglass or impregnated carbon based fibers. Further, the casing string (112) may be comprised of a metal which is relatively softer than the drill bit cutters or teeth, such as aluminum. As discussed previously, the intersection preferably occurs within the open hole portion (114) of the target borehole (22). However, where the casing string (112) in the target borehole (22) is comprised of a relatively weak or soft material, the intersection may in fact occur in the cased portion of the target borehole (22).

Following the making of the intersection, as described above, a borehole intersection (26) is provided which preferably extends between the open hole portion (120) of the intersecting borehole (24) and the open hole portion (114) of the target borehole (22), as shown in FIG. 1C. If desired, a bore hole opener or underreamer may be utilized to expand or open up the intersecting borehole (24), as well as either or both of the adjacent open hole portions (120, 114) of the intersecting and target boreholes (24, 22) respectively, if desired.

Following the drilling of the intersection, a continuous open hole interval (124) extends between the cased portion of the target borehole (22) and the cased portion of the intersecting borehole (24), wherein the open hole interval (124) is comprised of the borehole intersection (26) and the open hole portions (120, 114) of each of intersecting and target boreholes (24, 22). If desired, the open hole interval (124) may be left as an open hole. However, preferably, the open hole interval (124) is completed in a manner which is suitable for the intended functioning or use of the U-tube borehole (20) and which is compatible with the surrounding formation. For example, the open hole interval (124) may be completed by the installation of a steel pipe such as a further casing string, a liner, a slotted liner or a sand screen which extends across the open hole interval (124) linking the cased portions of each of the target and intersecting boreholes (22, 24). Further, once a liner or like structure is extended through the open hole interval (124), the open hole interval (124) may be cemented, where feasible and as desired.

For purposes of illustration, various alternative methods and apparatus are described below for completion of the open hole interval (124) with reference to a "liner." However, it is understood that the description of the various completion methods and apparatus with reference to a "liner" is equally applicable to the installation of any and all of a tubular member, a conduit, a pipe, a casing string, a liner, a slotted liner, a coiled tubing, a sand screen or the like provided to conduct or pass a fluid or other material therethrough or to extend a cable, wire, line or the like therethrough, except as specifically noted. In addition, the liner may be comprised of a single, integral or unitary liner extending for a desired length or the liner may be comprised of a plurality of liner sections or portions connected, affixed or attached together, either permanently or detachably, to provide a liner of a desired length. Further, a reference to cement or cementing of a borehole includes the use of any hardenable material or compound suitable for use downhole.

Figure 1D:
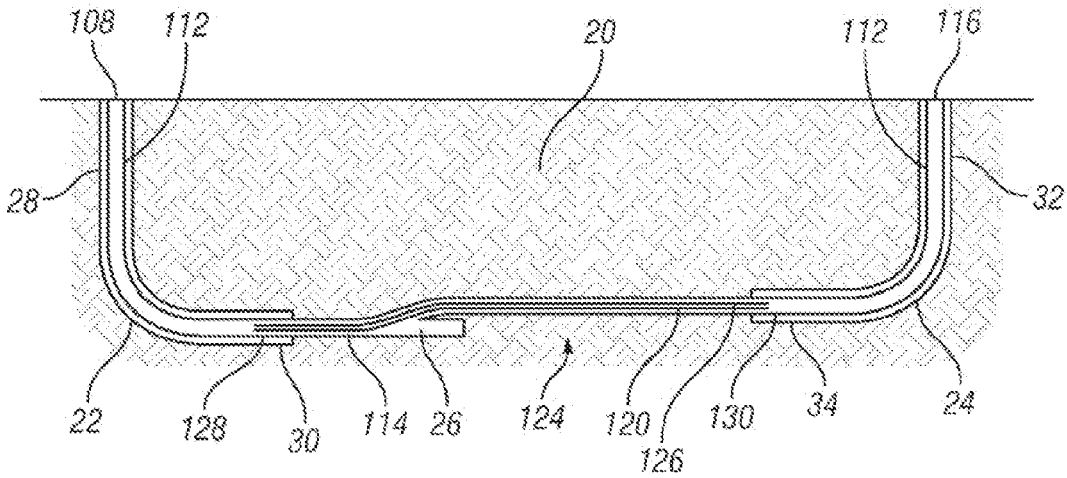

Referring to FIG. 1D, the open hole interval (124) may be completed with a liner (126) which is extended through the open hole interval (124). Using conventional or known techniques, the liner (126) may be inserted from either the first surface location (108) through the target borehole (22) or the second surface location (116) through the intersecting borehole (24) for placement in the open hole interval (124). More particularly, the liner (126) may be inserted and "pushed" through either the target borehole (22) or the intersecting borehole (24) for placement in the open hole interval (124). Alternately, the liner (126) may be inserted through one of the target borehole (22) and the intersecting borehole (24), while a further borehole tool or drilling apparatus is inserted through the other of the target borehole (22) and the intersecting borehole (24) for connecting with the liner (126) in order that the liner (126) is "pulled" through the boreholes (22, 24) for placement in the open hole interval (124).

Opposed ends of the liner (126) are preferably comprised of conventional or known liner hangers and/or other suitable seal arrangements or sealing assemblies in order to permit the opposed ends of the liner (126) to sealingly engage the casing string (112) of each of the target and intersecting boreholes (22, 24) and to prevent the entry of sand or other materials from the formation.

In the preferred embodiment, the liner (126) includes a bottom end liner hanger (128) and a top end liner hanger (130) at opposed ends thereof. With reference to FIG. 1D, the liner (126) is shown as being inserted into the open hole interval (124) from the intersecting borehole (24). Further, the distal ends of each of the cased and cemented portions of the target and intersecting boreholes (22, 24) preferably includes a compatible structure, such as a casing liner hanger shoe or casing shoe (not shown), for engaging or connecting with the liner hanger to maintain the liner (126) in the desired position in the open hole interval (124).

As well, it is preferable to design or select a bottom end liner hanger (128) which is smaller than the top end liner hanger (130) so that the bottom end liner hanger (128) is capable of passing through the distal end of the casing string (112) of the intersecting borehole (24) and subsequently connecting with and sealingly engaging inside the casing string (112) of the target borehole (22). If the bottom end liner hanger (128) is not smaller than the top end liner hanger (130), the bottom end liner hanger (128) may jam in the casing liner hanger shoe provided in the casing string (112) of the intersecting borehole (24) and prevent or inhibit the entry of the liner (126) into the open hole interval (124).

However, it should be noted that a bottom end liner hanger (128) may not be necessary. More particularly, the top end liner hanger (130) may be utilized on its own to anchor the liner (126). In this case, rather than a bottom end liner hanger (128), a bottom end sealing mechanism or sealing assembly (not shown) could be utilized in its place. Conversely, a top end liner hanger (130) may not be necessary. More particularly, the bottom end liner hanger (128) may be utilized on its own to anchor the liner (126). In this case, rather than a top end liner hanger (130), a top end sealing mechanism or sealing assembly (not shown) could be utilized in its place.

In other words, only one of the top or bottom end liner hangers (130, 128) is required at one end of the liner (126), wherein the other end of the liner (126) preferably includes a sealing mechanism or sealing assembly. Finally, either or both of the top and bottom end liner hangers (130, 128) may also perform a sealing function in addition to anchoring the liner (126) in position. Alternately, a separate sealing mechanism or sealing assembly may be associated with either or both of the top and bottom end liner hangers (130, 128).

In the event that the cased portions of the target and intersecting boreholes (22, 24) have been previously cemented to the surface, the open hole interval (124) may not be capable of being cemented following the installation of the liner (126) therein. However, in the event that the cased portions of the target and intersecting boreholes (22, 24) have not been previously cemented to the surface, the open hole interval (124) may be cemented following the installation of the liner (126) therein by conducting the cement through the annulus defined between the casing string (112) and the surrounding formation.

Alternatively, where desired, the liner (126) may be extended to the surface at either or both of the opposed ends thereof. In other words, the liner (126) may continuously extend from the open hole interval (124) to either or both of the first and second surface locations (108, 116). Thus, rather than simply extending across the open hole interval (124), the liner (126) may be extended from one of the first and second surface locations (108, 116) and across the open hole interval (124). In addition, where desired, it may be further extended from the open hole interval (124) to the other of the first and second surface locations (108, 116).

In this instance, the liner (126) may be maintained in position in the open hole interval (124) by the extension of the liner (126) to the surface at either or both of the ends thereof. Thus, this configuration of the liner (126) may be utilized as an alternative to the utilization of a liner hanger or like structure at one or both of the opposed ends of the liner (126). Cement or an alternative suitable hardenable material or compound could then be utilized to seal the annular space defined between the outer diameter of the liner (126) and the adjacent inner diameter of the casing string (112) or the formation.

Further alternative completion methods are described below with reference to FIGS. 2A-5C and 7-9. In each of the following alternatives, a single liner (126) is not run into the open hole interval (124) from either the target borehole (22) or the intersecting borehole (24). Rather, the liner (126) is comprised of a first liner section (126*a*) and a second liner section (126*b*) which are coupled downhole to comprise the complete liner (126). Specifically, the first liner section (126*a*) and the second liner section (126*b*) are run or inserted from the target borehole (22) and the intersecting borehole (24) to mate, couple or connect at a location within the U-tube borehole (20). Each of the liner sections (126*a*, 126*b*) may be comprised of a single, unitary member or component or a plurality of members or components interconnected or attached together in a manner to form the respective liner section (126*a*, 126*b*).

Thus, each of the first and second liner sections (126*a*, 126*b*) has a distal connection end (132). The distal connection end (132) is the downhole end of the liner section which is adapted for connection with the other liner section. In particular, the first liner section (126*a*) is comprised of a first distal connection end (132*a*) and the second liner section (126*b*) is comprised of a second distal connection end (132*b*).

Each of the liner sections (126*a*, 126*b*) may be run through either of the boreholes (22, 24) to achieve the connection. However, for illustration purposes only, unless otherwise indicated, the first liner section (126*a*) is installed or run from the first surface location (108) into the target borehole (22), while the second liner section (126*b*) is installed or run from the second surface location (116) into the intersecting borehole (24).

The first and second liner sections (126*a*, 126*b*), and particularly their respective distal connections ends (132*a*, 132*b*), may be mated, coupled or connected at any desired location or position within the U-tube borehole (20) including within the target borehole (22), the intersecting borehole (24), the borehole intersection (26) or any location within the open hole interval (124). The particular location will be selected depending upon, amongst other factors, the particular coupling mechanism being utilized, the length of each of the first and second liner sections (126*a*, 126*b*) and the manner or method by which each of the first and second liner sections (126*a*, 126*b*) is being passed, pulled or pushed through its respective borehole (22, 24).

For instance, the connection between the liner sections (126*a*, 126*b*) may be made within an open hole portion of the U-tube borehole (20), such as the open hole portion (114) of the target borehole (22), the open hole portion (120) of the intersecting borehole (24) or the open hole interval (124) therebetween. Alternatively, if desired, the connection between the liner sections (126*a*, 126*b*) may be made within a previously existing casing string (112) or tubular member or pipe within one of the boreholes (22, 24).

However, preferably, and as shown in FIGS. 2A through 5C, the connection between the first and second liner sections (126*a*, 126*b*) is made or positioned within an open hole portion of the U-tube borehole (20) such as the open hole portion (114) of the target borehole (22), the open hole portion (120) of the intersecting borehole (24) or the open hole interval (124).

The utilization of connectable or coupled first and second liner sections (126*a*, 126*b*), as shown in FIGS. 2A-5C and 7-9, may be advantageous as compared to the use of a single liner (126) as shown in FIG. 1D.

In particular, the distance between the first and second surface locations (108, 116) is typically limited by, amongst other factors, the drag experienced in pushing or pulling the liner (126) from one of the surface locations into position across the open hole interval (124). This drag may be reduced by utilizing two liner sections (126, 126*b*), wherein the liner sections each comprise only a portion of the necessary total liner length. Thus, the drag experienced by each of the liner sections (126*a*, 126*b*) individually as it is being pushed or pulled from its respective surface location will tend to be reduced as compared to that of a single liner (126). For example, where the connection between the liner sections (126*a*, 126*b*) is made approximately mid-way within the open hole interval (124), one only has to deal with the drag of pushing or pulling each of the liner sections (126*a*, 126*b*) approximately half way through the U-tube borehole (20) to make the connection and thereby line the open hole interval (124).

As a result, the use of two connectable liner sections (126*a*, 126*b*) potentially allows for a longer distance between the first and second surface locations (108, 116), while still permitting the lining of the open hole interval (124).

Further, whether installing a single liner (126) or two liner sections (126*a*, 126*b*) to be coupled downhole, extended reach drilling techniques and equipment may be utilized to install a liner for the completion of the extended reach borehole. For example, a single liner (126) or two liner sections (126*a*, 126*b*) may be positioned within the U-tube borehole (20) with the assistance of a downhole tractor system such as that utilized as part of the Anaconda™ well construction system which is available from Halliburton Energy Services, Inc. Principles of the Anaconda™ well construction system are described in the following references: Roy Marker et. al., "Anaconda: Joint Development Project Leads to Digitally Controlled Composite Coiled Tubing Drilling System", SPE Paper No. 60750 presented at the SPE/IcoTA Coiled Tubing Roundtable held in Houston, Tex. on Apr. 5-6, 2000; and U.S. Pat. No. 6,296,066 issued Oct. 2, 2001 to Terry et. al.

As well, the liner or liner sections may be comprised of a composite coiled tubing, such as that described in SPE Paper No. 60750 and U.S. Pat. No. 6,296,066 referred to above. The composite coiled tubing has been found to be neutrally buoyant in drilling fluids and thus readily "floats" through the borehole and into position. Thus, the neutral buoyancy of the coiled tubing reduces drag problems encountered in the placement of the liner, as compared with conventional steel tubing, permitting the liner to be installed in longer reach wells.

Alternately, the liner may be comprised of an expandable liner or expandable casing, such that a monobore liner may be provided within the U-tube borehole (20). In this case, one or more expandable liners or liner sections may be utilized. Thus, the expandable liner may be placed in the desired position downhole in a conventional or known manner, such as by using the above noted downhole tractor system. The liner is subsequently expanded, which permits the passage of further liners or liner segments through the expanded section to extend the monobore liner through the length of the borehole. The liner may be expanded using any conventional or known methods or equipment, such as by using fluid pressure within the liner.

Whether the liner is expandable or not (such as a conventional steel liner), the placement of the liner may be aided by providing a generally neutrally buoyant liner, as described for the coiled tubing. For instance, the ends of the liner may be sealed, such as with drillable plugs, to seal a fluid therein which provides the neutral buoyancy. The specific fluid will be selected to be compatible with the drilling fluids and conditions downhole in order to allow the liner to be neutrally buoyant within the borehole. Preferably, the fluid is comprised of an air/water mixture. Once the liner is in position, the plugs may be drilled out to release the air/water mixture from the liner and to permit the liner to drop into place. Such air/water mixtures can be contained within specific drillable segments of the liner (126) length to distribute the buoyancy capacity more evenly.

In order to utilize the connectable liner sections (126*a*, 126*b*), the first and second liner sections (126*a*, 126*b*) are preferably not initially cemented within their respective boreholes. In other words, preferably, neither of the liner sections (126*a*, 126*b*) is cemented or otherwise sealed in place prior to the connection or coupling being made therebetween.

Referring to FIGS. 2A-5C and 7-9, the ends of the first and second liner sections (126*a*, 126*b*) opposed to the distal connection ends (132*a*, 132*b*) are not depicted. However, these ends may be anchored and sealed if necessary using suitable liner hangers, seal assemblies or cement after the mating or coupling process is completed.

Further and in the alternative, the ends of the first and second liner sections (126*a*, 126*b*) opposed to the distal connection ends (132*a*, 132*b*) may extend to the surface. Thus, more particularly, the end of the first liner section (126*a*) opposed to the distal connection end (132*a*) thereof and/or the end of the second liner section (126*b*) opposed to the distal connection end (132*b*) thereof may extend to the surface within its respective borehole (22, 24). Accordingly, the first liner section (126*a*) may extend from its distal connection end (132*a*) to the first surface location (108) within the target borehole (22), while the second liner section (126*b*) may extend from its distal connection end (132*b*) to the second surface location (116) within the intersecting borehole (24).

As a further alternative, if desired and where feasible, one of the first and second liner sections (126*a*, 126*b*) may be installed, and sealed or cemented in position, prior to the connection or coupling of the liner sections (126*a*, 126*b*) downhole. Once the initial liner section is installed in the desired position, the other or subsequent one of the first and second liner sections (126*a*, 126*b*) is then installed through its respective borehole (22, 24) and run to mate with the previously installed liner section. The subsequently installed liner section may then be cemented in position, if desired and where feasible.

As indicated, the first and second liner sections (126*a*, 126*b*) may be mated at any desired location or position within the target borehole (22), the intersecting borehole (24) or the open hole interval (124). Thus, the distal connection end (132) of the initially installed liner section (126*a* or 126*b*) may be positioned at any desired location downhole in the U-tube borehole (20) depending upon the desired connection or mating point. However, preferably, the distal connection end (132) of the initially installed liner section is located at, adjacent or in proximity to the distal or most downhole end of the existing casing string (112) of its respective borehole (22 or 24). The other or subsequently installed liner section is then installed through its respective borehole (22, 24) and run across the open hole interval (124) to mate with the initially installed liner section.

Thus, for example, the first liner section (126*a*) may be run from the first surface location (108) and through the target borehole (22) such that its distal connection end (132*a*) is placed in proximity to the distal or most downhole end of the existing casing string (112) of the target borehole (22). The second liner section (126*b*) is subsequently run from the second surface location (116), through the intersecting borehole (24) and across the open hole interval (124) such that its distal connection end (132*b*) mates with the distal connection end (132*a*) of the first liner section (126*a*).

Further, in order to facilitate the connection between the distal connection ends (132*a*, 132*b*), the initial liner section may be installed such that its distal connection end (132) extends from the casing string (112) into the open hole portion of the borehole. As a result, the connection between the liner sections (126*a*, 126*b*) is made within the open hole portion, preferably at a location in proximity to the end of the casing string (112). Alternatively, if desired, the initial liner section may be installed such its distal connection end (132) does not extend from the casing string (112), but is substantially contained within the casing string (112). As a result, the connection between the liner sections (126*a*, 126*b*) is made within the casing string (112) of one of the boreholes (22, 24), preferably at a location in proximity to the end of the casing string (112).

Each of the distal connection ends (132*a*, 132*b*) of the first and second liner sections (126*a*, 126*b*) respectively may be comprised of any compatible connector, coupler or other mechanism or assembly for connecting, coupling or engaging the liner sections (126*a*, 126*b*) downhole in a manner permitting fluid communication or passage therebetween. In particular, each of the distal connection ends (132) is capable of permitting the passage of fluids or a fluid flow therethrough. Thus, when connected, coupled or engaged, the liner sections (126*a*, 126*b*) are capable of being in fluid communication with each other such that a flow path may be defined therethrough from one liner section to the other.

In addition, one or both of the distal connection ends (132*a*, 132*b*) may be comprised of a connector, coupler or other mechanism or assembly for sealingly connecting, coupling or engaging the liner sections (126*a*, 126*b*). Alternately, the connection between the liner sections (126*a*, 126*b*) may be sealed following the coupling, connection or engagement of the distal connection ends (132*a*, 132*b*).

Referring to FIGS. 2A-4D and 7-9, one of the first and second distal connection ends (132*a*, 132*b*) is comprised of a female connector (134), while the other of the first and second distal connection ends (132*a*, 132*b*) is comprised of a compatible male connector (136) adapted and configured for receipt within the female connector (134). Either or both of the female and male connectors (134, 136) may be connected, attached or otherwise affixed or fastened in any manner, either permanently or removably, with the respective connection end (132). For instance, the connector (134 or 136) may be welded to the connection end (132) or a threaded connection may be provided therebetween. Alternatively, either or both of the female and male connectors (134, 136) may be integrally formed with the respective connection end (132).

The female connector (134), which may also be referred to as a "receptacle," may be comprised of any tubular structure or tubular member capable of defining a fluid passage (140) therethrough and which is adapted and sized for receipt of the male connector (136) therein. Similarly, the male connector (136), which may also be referred to as a "stinger" or a "bull-nose," may also be comprised of any tubular structure or tubular member capable of defining a fluid passage (140) therethrough and which is adapted and sized for receipt within the female connector (134). Thus, the male connector (136) may be comprised of any tubular pipe, member or structure having a diameter smaller than that of the female connector (134) such that the male connector (136) may be received within the female connector (134).

Further, referring to FIGS. 2A-3B, a seal, sealing device or seal assembly (138) is associated with one of the male or female connectors (136, 134) and adapted such that the male connector (136) is sealingly engaged with the female connector (134). Thus, the seal assembly (138) prevents or inhibits the passage or leakage of fluids out of the liner sections (126*a*, 126*b*) as the fluid flows through the connectors (134, 136). Referring to FIGS. 4A-4D, the connection between the female and male connectors (134, 136) is sealed with cement or other hardenable material. Referring to FIGS. 7-8, a seal assembly (not shown) may be provided between the female and male connectors (134, 136), if desired, or the connection between the female and male connectors (134, 136) may be sealed with cement or other hardenable material. Finally, referring to FIG. 9, the engaged surfaces of the female and male connectors (134, 136) provide a seal therebetween, such as a metal-to-metal seal.

Figure 2A:
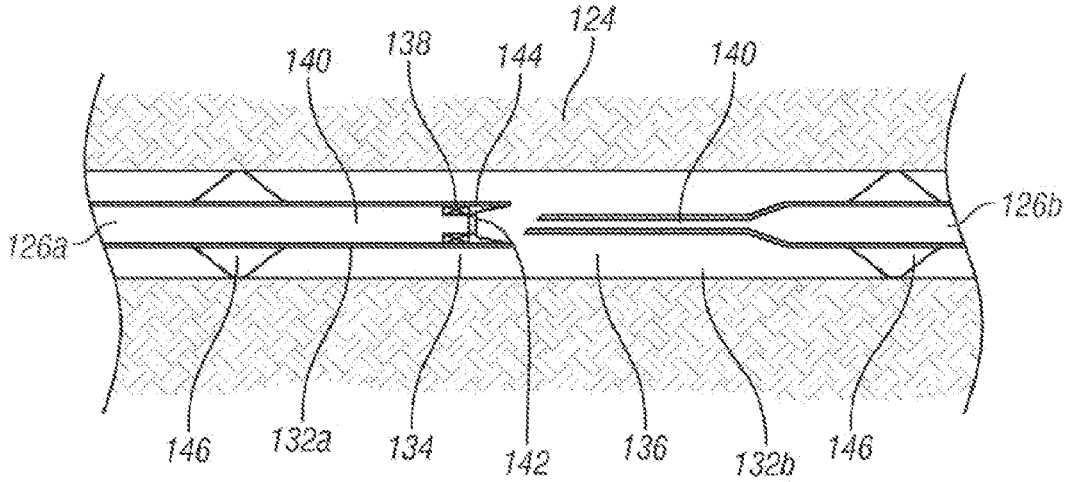
FIG. 2, consisting of FIG. 2A and FIG. 2B, is a schematic depiction of a method and apparatus for completing a U-tube borehole according to a preferred embodiment of the invention, using two connectable liner sections.
Figure 2B:
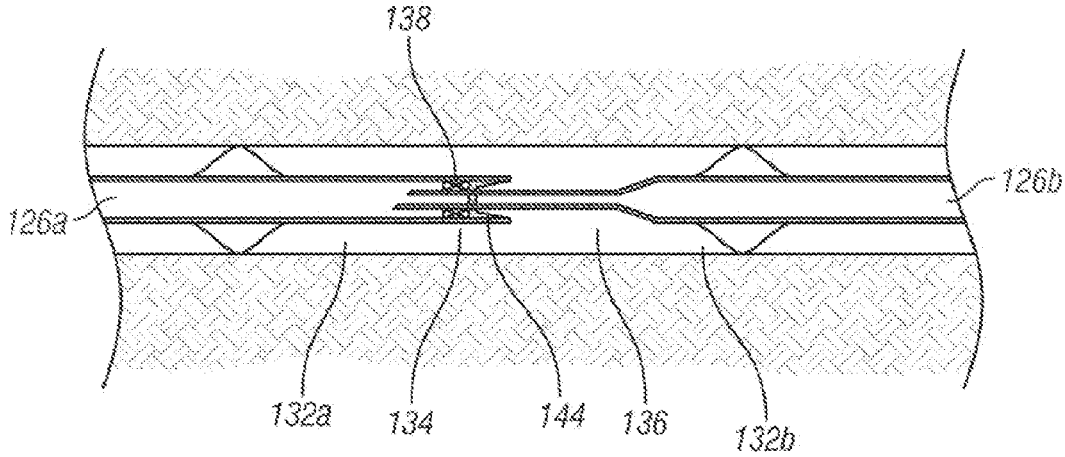

Referring more particularly to FIGS. 2A and 2B, the seal assembly (138) is associated with the female connector (134). More particularly, the seal assembly (138) is comprised of an internal seal assembly mounted, affixed, fastened or integrally formed with an internal surface of the female connector (134). Any compatible internal seal assembly may be used which is suitable for sealing with the male connector (136) received therein.

Further, the female connector (134) also preferably includes a breakable debris barrier (142) for inhibiting the passage or entry of debris within the female connector (136) as the liner section is being conveyed through the borehole. When the male connector (136) contacts the breakable debris barrier (142), the barrier (142) breaks to permit the male connector (136) to pass therethrough to seal with the seal assembly (138). Thus, the breakable debris barrier (142) may be comprised of any suitable structure and breakable material, but is preferably comprised of a glass disk or a shearable plug. The plug may be held in position by radially placed shear pins, wherein the pins are sheared and the plug is displaced by the stinger or male connector (136). The plug subsequently falls out of the way as the male connector (136) engages within the female connector (134).

Finally, the female connector (136) also preferably includes a suitable guiding structure or guiding member for facilitating or assisting the proper entry of the male connector (136) within the female connector (134). Preferably, the female connector (136) includes a guiding cone (144) or like structure to assist the proper entry of the male connector (136) within the female connector (134) and its proper engagement with the seal assembly (138).

FIG. 2A shows the male connector (136) or stinger in alignment with the female connector (134) prior to the coupling of the first and second liner sections (126*a*, 126*b*). FIG. 2B shows the engagement of the stinger (136) with the debris barrier (142) and the subsequent sealing of the internal seal assembly (138) of the female connector (134) with the outer diameter of the stinger (136). As a result, a barrier of continuous pipe is created from one surface location to the other. In other words, the connection of the first and second liner sections (126*a*, 126*b*) provides a continuous liner or continuous conduit or fluid path between the first and second surface locations (108, 116).

Referring to FIGS. 2A-2B, one or more centralizers (146) or centralizing members or devices, which may be referred to as "casing centralizers," are preferably provided along the length of each of the liner sections (126*a*, 126*b*). Although a centralizer (146) may not be required, a plurality of centralizers (146) are typically positioned along the lengths of each of the first and second liner sections (126*a*, 126*b*). Further, in order to facilitate the connection between the male and female connectors (136, 134), at least one centralizer (146) is preferably associated with each of the male and female connectors (136, 134). In particular, the centralizer (146) may be attached, connected or integrally formed with the male or female connector (136, 134) or the centralizer (146) may be positioned proximate or adjacent to the male or female connector (136, 134).

As a result, the centralizers (146), as shown in FIGS. 2A-2B, may perform many functions. First, the centralizers (146) may assist with the alignment of the connectors (136, 134) to facilitate the making of the connection therebetween. Second, the centralizers (146) may protect the male connector or stinger (136) from being scraped or damaged as it is being tripped into the borehole. Damage to the sealing surface of the stinger (136) may prevent or inhibit its proper sealing within the seal assembly (138). Third, the centralizers (146) may assist in keeping debris from entering the fluid passage (140) of the stinger (136). Fourth, the centralizers (146) may also assist in keeping debris from accumulating on the debris barrier (142), which may lead to its premature breakage or interference with the passage of the stinger (136) therethrough.

Any type or configuration of centralizer capable of, and suitable for, performing one or more of these desired functions may be used. Referring to FIGS. 2A-2B, the centralizers (146) are shown as bows. However, any other suitable type of conventional or known centralizer may be used, such as those having spiral blade bodies and straight blade bodies.

Figure 3A:
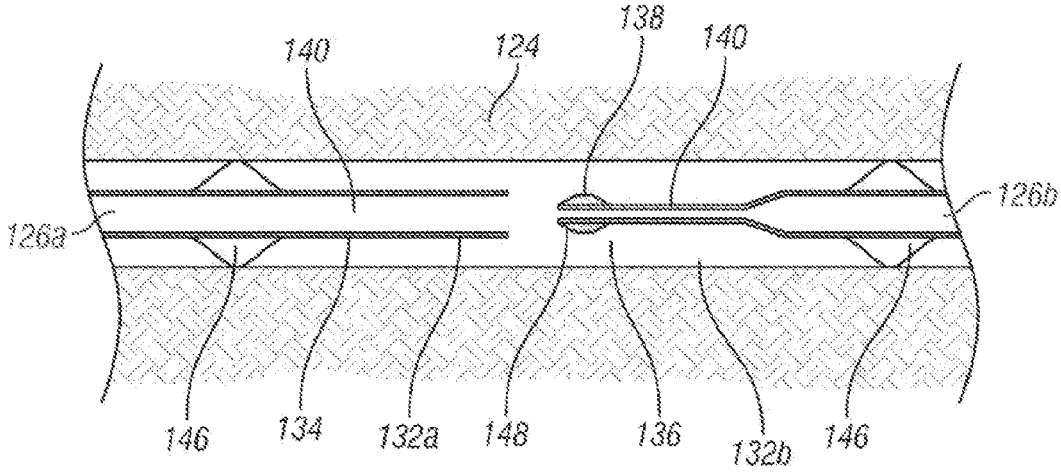
FIG. 3, consisting of FIG. 3A and FIG. 3B, is a schematic depiction of a variation of the method and apparatus of FIG. 2.
Figure 3B:
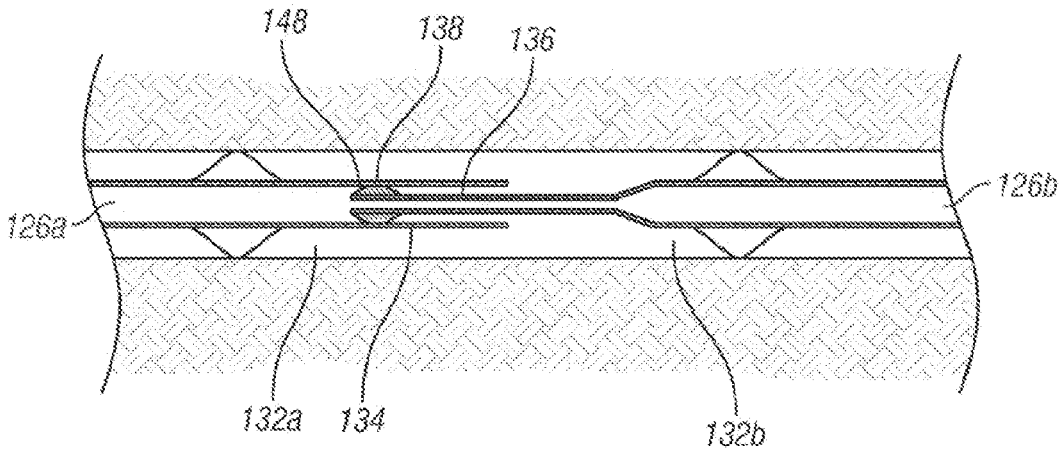

Referring to FIGS. 3A and 3B, the seal assembly (138) is associated with the male connector (136). More particularly, the seal assembly (138) is comprised of an external seal assembly mounted, affixed, fastened or integrally formed with an exterior surface or outer diameter of the male connector or stinger (136). Any compatible external seal assembly may be used which is suitable for sealing within the female connector (134) as it passes therein.

Preferably, the seal assembly (138) is comprised of a resilient member mounted about the end of the stinger (136). The resilient member is sized and configured to facilitate entry within the female connector (134) and to sealingly engage with the internal surface thereof. Preferably, the resilient member is comprised of an elastomer.

Further, the seal assembly (138) defines a leading edge (148), being the first point of contact or engagement of the seal assembly (138) with the adjacent end of the female connector (134) as the connection is being made. Preferably, the leading edge (148) of the seal assembly (138) is comprised of a material capable of protecting the elastomer of the seal assembly (138) from damage while passing through the borehole and within the female connector (134). For instance, the leading edge (148) may be comprised of metal (not shown) to protect the elastomer from being torn away. However, the diameter of the metal comprising the leading edge (148) is selected such that it does not exceed the diameter of the elastomer and such that it does not dimensionally interfere with the bore or fluid passage (140) of the female connector (134). The leading edge (148) may also be shaped or configured to facilitate or assist with the proper entry of the male connector (136) within the female connector (134).

FIG. 3A shows the male connector (136) or stinger in alignment with the female connector (134) prior to the coupling of the first and second liner sections (126*a*, 126*b*). FIG. 3B shows the engagement of the stinger (136) within the female connector (134) and the sealing of the exterior surface of the stinger (136) with the interior surface of the female connector (134) by the elastomeric seal assembly (138) located therebetween. Thus, the seal assembly (138) prevents the entry of debris within the liner sections (126*a*, 126*b*) and the flow of fluids out of the liner sections (126*a*, 126*b*). Further, as with FIGS. 2A-2B, a barrier of continuous pipe is created from one surface location to the other. In other words, the connection of the first and second liner sections (126*a*, 126*b*) in this manner also provides a continuous liner or continuous conduit or fluid path between the first and second surface locations (108, 116).

Referring to FIGS. 3A-3B, one or more centralizers (146) or centralizing members or devices, as described previously, may similarly be provided along the length of each of the liner sections (126*a*, 126*b*). Although a centralizer (146) may not be required, a plurality of centralizers (146) are typically positioned along the lengths of each of the first and second liner sections (126*a*, 126*b*). Further, in order to facilitate the connection between the male and female connectors (136, 134), at least one centralizer (146) is preferably associated with each of the male and female connectors (136, 134). In particular, the centralizer (146) may be attached, connected or integrally formed with the male or female connector (136, 134) or the centralizer (146) may be positioned proximate or adjacent to the male or female connector (136, 134).

As a result, the centralizers (146), as shown in FIGS. 3A-3B, may perform many functions similar to those described previously. First, the centralizers (146) may assist with the alignment of the connectors (136, 134) to facilitate the making of the connection therebetween. Second, the centralizers (146) may protect the seal assembly (138) mounted about the male connector or stinger (136) from being scraped or damaged as it is being tripped into the borehole. Damage to the seal assembly (138) may prevent or inhibit its proper sealing within the female connector (134). Third, the centralizers (146) may assist in keeping debris from entering the fluid passages (140) of the connectors (134, 136).

Once again, any type or configuration of centralizer capable of, and suitable for, performing one or more of these desired functions may be used. Referring to FIGS. 3A-3B, the centralizers (146) are shown as bows. However, any other suitable type of conventional or known centralizer may be used.

Referring to FIGS. 4A-4D, a seal assembly is not provided between the male and female connectors (136, 134). Rather, the connection between the female and male connectors (134, 136) is sealed with a sealing material, preferably a cement or other hardenable material. In this case, one or both of the male and female connectors (136, 134) preferably includes a plug (150) or plugging structure to block the passage of the sealing material away from the connector and into the associated liner section towards the surface. In other words, the plug (150) defines an uppermost or uphole point of passage of the cement through the liner section.

Referring to FIGS. 4A-4D, the male connector (136) may provide an "open" end for passage of fluids therethrough. Alternately, the end of the male connector (136) may include a bull-nose (not shown) having a plurality of perforations therein to permit the passage of fluids therethrough, and which preferably provides a relatively convex end face to facilitate the passage of the male connector (136) within the female connector (134). As a further alternative, the end of the male connector (136) may be comprised of a drillable member, such as a convex drillable plug or a convex perforated bull-nose.

Preferably, as shown in FIGS. 4A-4D, the plug (150) is positioned within the female connector (134) in relatively close proximity to the distal connection end (132) or downhole end of the female connector (134). However, the plug may be positioned at any location within the female connector (134) or along the length of the associated liner section. Alternately, although not shown, the plug (150) may positioned within the male connector (136) in relatively close proximity to the distal connection end (132) or downhole end of the male connector (136), or at any location within the male connector (136) or along the length of the associated liner section.

Thus, the particular positioning of the plug (150) may vary as desired or required to achieve the desired sealing of the connection. Any type of conventional or known plug may be used so long as the plug (150) is comprised of a drillable material for the reasons discussed below. In addition, the plug (150) may be retained or seated in the desired position using any structure suitable for such purpose, such as a downhole valve or float collar.

Figure 4A:
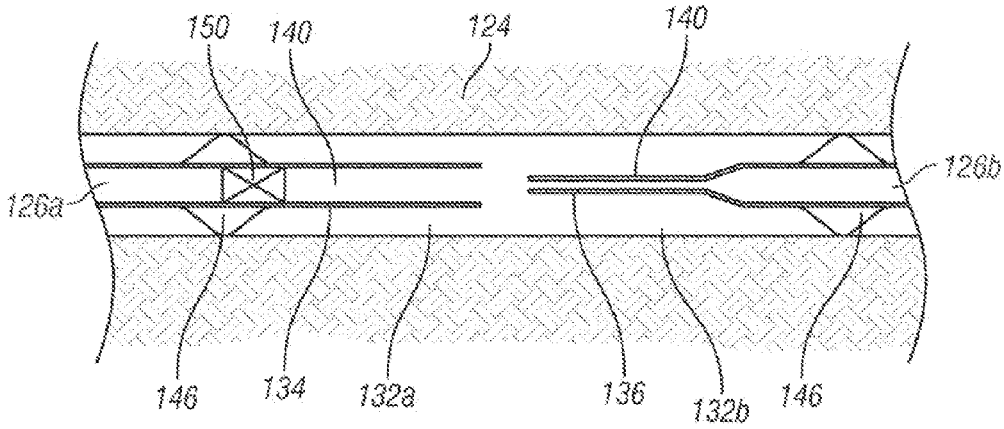
FIG. 4, consisting of FIGS. 4A through 4D, is a schematic depiction of a further variation of the method and apparatus of FIG. 2.
Figure 4B:
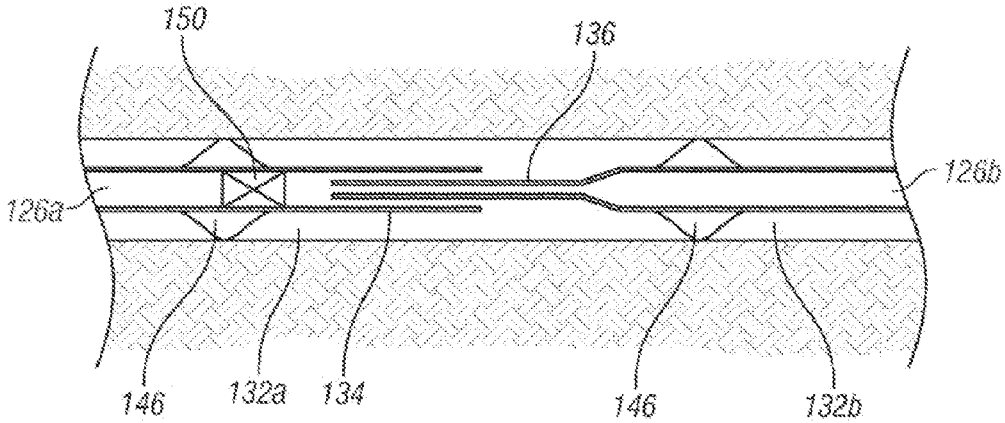

FIG. 4A shows the placement of the plug (150) within the female connector (134) and the alignment of the male and female connectors (136, 134) prior to coupling. FIG. 4B shows the male connector or stinger (136) engaging the female connector or receptacle (134). However, a communication path is still present to the annulus through the space defined between the inner surface of the female connector (134) and the outer surface of the male connector (136).

Utilizing conventional or known cementing methods and equipment, cement is conducted through the liner section associated with the male connector (136). The cement passes out of the male connector (136), into the female connector (134) and through the space defined therebetween to the annulus. Once a desired amount of cement has been conducted to the annulus between the liner sections and the surrounding borehole wall or formation, a further plug (150) or plugging structure is conducted through the liner section associated with the male connector (136). The further plug (150) may be retained or seated in the desired position within the male connector (136), using any suitable structure for such purpose, such as a downhole valve or float collar. The further plug (150) blocks the passage of the cement away from the connector (136) and back up the associated liner section towards the surface. As described previously for the initial plug, any type of conventional or known plug may be used as the further plug (150) so long as the plug is comprised of a drillable material.

In addition, as indicated previously, the plug (150) may be positioned in the male connector (136). Thus, the cement would pass out of the female connector (134), into the male connector (136) and through the space defined therebetween to the annulus. Once a desired amount of cement has been conducted to the annulus between the liner sections and the surrounding borehole wall or formation, a further plug (150) or plugging structure would be conducted through the liner section associated with the female connector (134). The further plug (150) may be retained or seated in the desired position within the female connector (136) to block the passage of the cement away from the connector (134) and back up the associated liner section towards the surface.

Figure 4C:
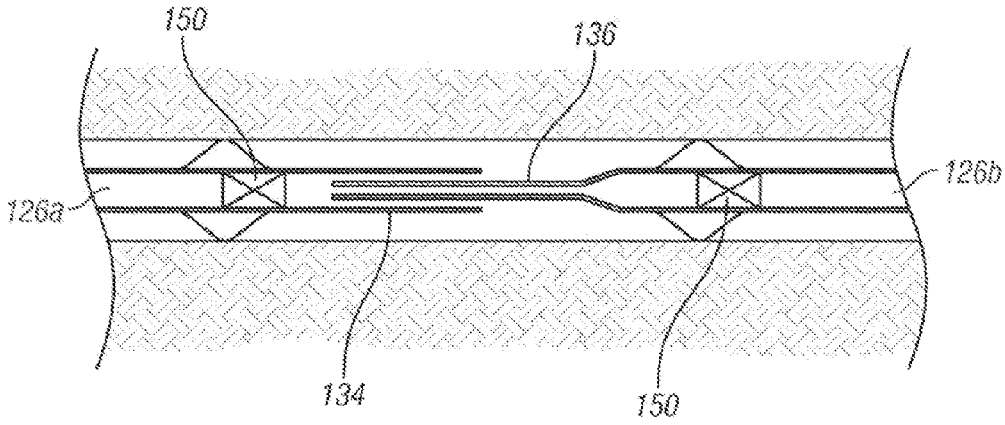
Figure 4D:
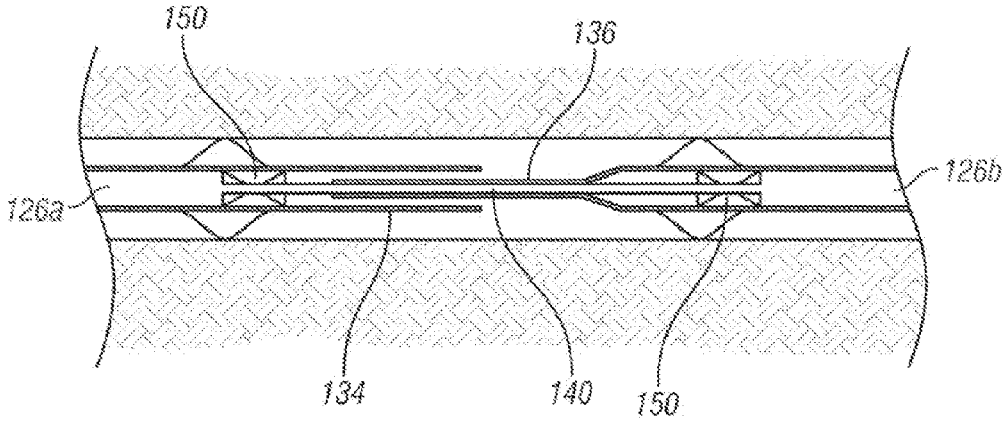

As shown in FIG. 4C, following the cementing of the junction or connection between the first and second liner sections (126*a*, 126*b*), the cement is held in position by the plugs (150) located within, or otherwise associated with, each of the male and female connectors (136, 134). Referring to FIG. 4D, the plugs (150) are subsequently drilled out to permit communication between the first and second liner sections (126*a*, 126*b*) while still preventing the entry of debris or other materials from the formation and annulus.

Again, as shown in FIGS. 4A-4D, one or more centralizers (146) or centralizing members or devices, as described previously, may be provided along the length of each of the liner sections (126*a*, 126*b*). Although a centralizer (146) may not be required, a plurality of centralizers (146) are typically positioned along the lengths of each of the first and second liner sections (126*a*, 126*b*). Further, at least one centralizer (146) is preferably positioned proximate or adjacent to each of distal connection ends (132) of the first and second liner sections (126*a*, 126*b*). Referring to FIGS. 4A-4D, the centralizers (146) are shown as bows. However, any other suitable type of conventional or known centralizer may be used.

A similar sealed connection may be achieved by cementing the junction or connection between the adjacent ends of the first and second liner sections (126*a*, 126*b*), and particularly between the distal connection ends (132) thereof, without the use of the compatible male and female connectors (136, 134) as described above.

Rather than inserting the male connector (136) within the female connector (134), the respective distal connection ends (132) of each of the first and second liner sections (126*a*, 126*b*) would simply be positioned in relatively close proximity to each other. In this case, the distance between the respective distal connection ends (132) may be about 3 meters, but is preferably less than about two meters. The greater the accuracy that can be achieved in aligning the distal connection ends (132), the lesser the distance that may be provided between the ends (132). Most preferably, if the alignment can be achieved with a high degree of accuracy, the distance between the distal connection ends (132) is preferably only several inches or centimeters.

The junction or connection between the adjacent ends of the first and second liner sections (126*a*, 126*b*) may then be cemented using known or conventional cementing methods and equipment. Once cemented, the cemented space between the distal connection ends (132), and any cement plugs, may be drilled out. Preferably, the drilling assembly is inserted through the second liner section (126*b*) from the intersecting borehole (24) to drill through the cement plug or plugs, through the cemented space and into the first liner section (126*a*) to the target borehole (22). Preferably, a relatively stiff bottomhole assembly ("BHA") is used for this method as a flexible assembly would tend to easily drill off the plug and into the formation resulting in a loss of the established connection.

As indicated, any feasible or suitable method may be utilized to cement the annulus between the liner and the borehole wall or formation. For instance, both of the first and section liner sections (126*a*, 126*b*) may be plugged. The cement would then be conducted or pumped down the annulus of either the target borehole (22) or the intersecting borehole (24), and subsequently up the annulus of the other one of the target and intersecting boreholes (22, 24). For instance, the cement may be conducted or pumped down the annulus of the intersecting borehole (24), and subsequently up the annulus of the target borehole (22). In this case, the target borehole (22) may be shut in or sealed to prevent leakage or spillage of the cement in the event of equipment failure downhole.

Alternatively, a bridge plug (not shown) may be installed or placed within the space or gap between the distal connection ends (132) of the first and second liner sections (126*a*, 126*b*). Once the bridge plug is in position, each of the target and intersecting boreholes (22, 24) would be cemented separately by conducting the cement through the respective liner section and up the annulus, or vice versa. In this case, each of the boreholes would preferably be set up with shut in or sealing capability to prevent leakage or spillage of the cement in the event of failure of the cementing equipment downhole. Once cemented, the intervening space and the bridge plug would be drilled out to connect the first and second liner sections (126*a*, 126*b*).

Figure 5A:
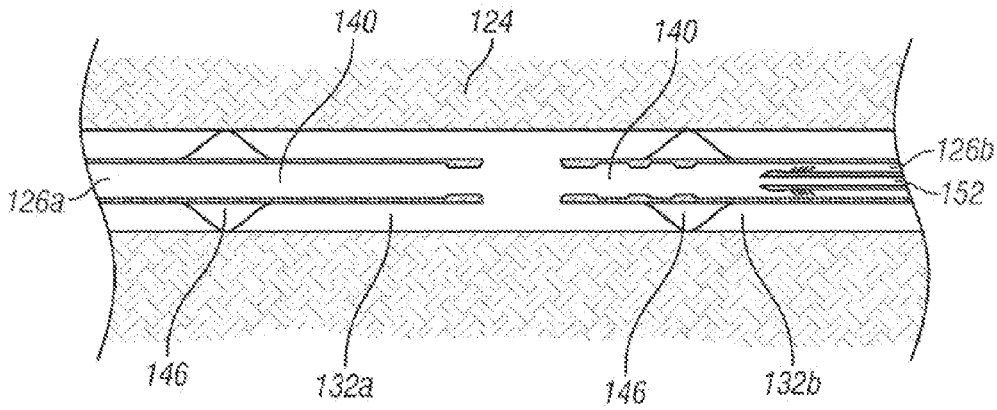
FIG. 5, consisting of FIGS. 5A through 5C, is a schematic depiction of a further variation of the method and apparatus of FIG. 2, in which a bridge pipe is used to provide the connection between the two connectable liner sections.
Figure 5B:
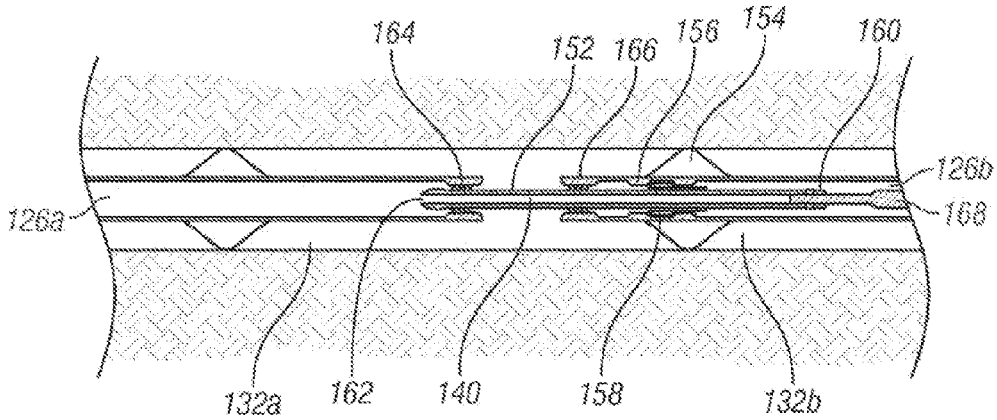
Figure 5C:
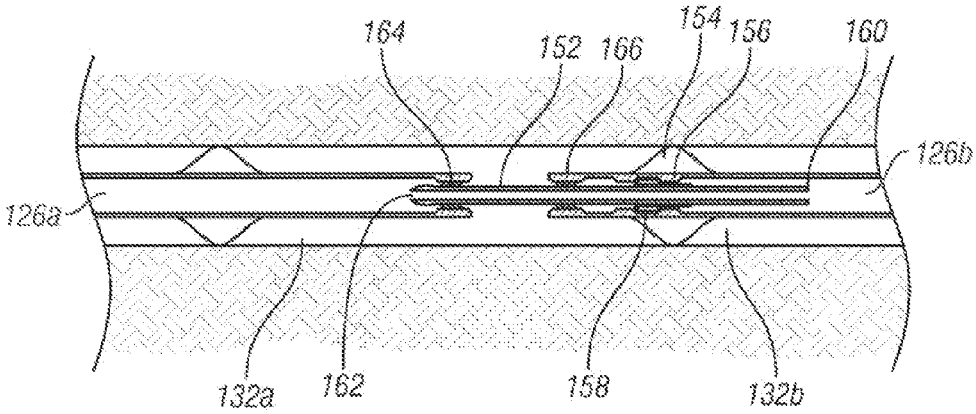

Finally, referring to FIGS. 5A-5C, a bridge pipe (152) may be used to connect between the adjacent distal connection ends (132) of the first and second liner sections (126*a*, 126*b*). The bridge pipe (152) may be comprised of any tubular member or structure capable of straddling or bridging the space or gap between the adjacent distal connection ends (132) of the first and second liner sections (126*a*, 126*b*), and which provides a fluid passage (140) therethrough. Further, where desired, the bridge pipe (152) may be slotted or screened to allow gas or fluids to enter the bridge pipe (152).

The bridge pipe (152) may be placed and retained in position using any suitable running or setting tool for placing the bridge pipe (152) in the desired position downhole and using any suitable mechanism for latching or seating the bridge pipe (152) within the ends of the liner sections to retain the bridge pipe (152) in position. Where desired, the bridge pipe (152) may also be retrievable.

Referring to FIG. 5A, the bridge pipe (152) is installed through one of the first or second liner sections (126*a*, 126*b*). For illustration purposes only, FIG. 5A shows the installation of the bridge pipe (152) through the second liner section (126*b*). However, it may also be installed through the first liner section (126*a*). Further, although any suitable latching, seating or retaining structure or mechanism may be used, a latching mechanism or latch assembly (154) is preferably provided for retaining the position of the bridge pipe (152).

The latching mechanism or latch assembly (154) may be associated with either the first or second liner sections (126*a*, 126*b*). However, preferably, the latching mechanism (154) is associated with the liner section through which the bridge pipe (152) is being installed. Thus, with reference to FIGS. 5A-5C, the latching mechanism (154) is associated with the second liner section (126*b*) and the bridge pipe (152) to provide the engagement therebetween. More particularly, the liner section (126*b*) preferably provides an internal profile or contour for engagement with a compatible or matching external profile or contour provided by the bridge pipe (152).

Referring particularly to FIG. 5A, the latching mechanism (154) is preferably comprised of a collet (156) associated with the liner section (126*b*) and configured for receiving the bridge pipe (152) therein. The collet (156) has an internal latching or engagement profile or contour for engagement with the bridge pipe (152) to retain the bridge pipe (152) in a desired position within the liner section (126*b*). Although the collet (156) may be placed at any location along the second liner section (126*b*), the collet (156) is preferably positioned within the second liner section (126*b*) at, adjacent or in proximity to the distal connection end (132) thereof.

The latching mechanism (154) is also preferably comprised of one or more latch members (158) associated with the bridge pipe (152) and configured to be received within the collet (156). Each latch member (158) has an external latching or engagement profile or contour which is compatible with the internal profile or contour of the collet (156). Thus, the bridge pipe (152) is retained in position within the second liner section (126*b*) when the latch members (158) are engaged within the matching collet (156).

The latching mechanism (154) may be the same as, or similar to, the keyless latch assembly described in U.S. Pat. No. 5,579,829 issued Dec. 3, 1996 to Comeau et. al. However, preferably the latching mechanism (154) includes a "no-go" or fail-safe feature or capability such that the latch members (158) cannot be pushed or moved past the collet (156), causing the bridge pipe (152) to be accidentally pushed out beyond the distal connection end (132) of the second liner section (126*b*). Thus, the latching mechanism (154) is preferably the same as, or similar to, the fail-safe latch assembly described in U.S. Pat. No. 6,202,746 issued Mar. 20, 2001 to Vandenberg et. al.

The bridge pipe (152) has a length defined between an uphole end (160) and a downhole end (162). The length of the bridge pipe (152) is selected to permit the bridge pipe (152) to extend between the distal connection ends (132) of the first and second liner sections (126*a*, 126*b*). The latch members (158) may be positioned about the bridge pipe (152) at any position along the length thereof. However, preferably, the latch members (158) are positioned at, adjacent or in proximity to the uphole end (160) of the bridge pipe (152). As a result, when the uphole end (160) of the bridge pipe (152) is engaged with the collet (156) at the distal connection end (132) of the second liner section (126*b*), the downhole end (162) can extend from the distal connection end (132) of the second liner section (126*b*) and within the distal connection end (132) of the first liner section (126*a*), thus bridging the open hole gap or space therebetween.

Further, the bridge pipe (152) is preferably comprised of at least two sealing assemblies which are spaced apart along the length of the bridge pipe (152). When the bridge pipe (152) is properly positioned and the latching mechanism (154) is engaged, a first sealing assembly (164) provides a seal between the external surface of the bridge pipe (152) and the adjacent internal surface of the distal connection end (132) of the first liner section (126*a*). A second sealing assembly (166) provides a seal between the external surface of the bridge pipe (152) and the adjacent internal surface of the distal connection end (132) of the second liner section (126*b*). Thus, the bridge pipe (152) may be used to seal the annulus from the liner sections (126*a*, 126*b*) over the interval or space between the distal connection ends (132) of the first and second liner sections (126*a*, 126*b*).

Each of the first and second sealing assemblies (164, 166) may be comprised of any mechanism, device or seal structure capable of sealing between the bridge pipe (152) and the internal surface of the liner section. For instance, a band or collar of an elastomer material may be provided about the external surface of the bridge pipe (152) which has a sufficient diameter or thickness for achieving the desired seal. Further, an inflatable seal, such as those conventionally used in the industry, may be used. To inflate the seals, one only turns on the pumps and the differential pressure will force the seal to expand and seal against the inner diameter of the liner sections. However, preferably, each of the sealing assemblies (164, 166) is comprised of a plurality of elastomer sealing cups or swab cups mounted about or with the external surface of the bridge pipe (152), as shown in FIGS. 5B and 5C.

Where the frictional forces of the seal or sealing assemblies is sufficient to retain the bridge pipe (152) in the desired position, the use of the latching mechanism (154) may be optional.

As indicated, the bridge pipe (152) may be placed in position using any suitable running or setting tool for placing the bridge pipe (152) in the desired position downhole. However, referring to FIG. 5B, an insertion and retrieval tool is preferably utilized, such as a conventional or known Hydraulic Retrieval Tool ("HRT") (168) typically used in multi-lateral boreholes for placing a whipstock into a latch assembly. Thus, the uphole end (160) of the bridge pipe (152) preferably includes a structure or mechanism compatible for connection with the HRT (168), such as one or more connection holes for receiving one or more pistons comprising the HRT (168).

Thus, as shown on FIG. 5B, the HRT (168) is releasably connected with the uphole end (160) of the bridge pipe (152) and the HRT (168) is then used to push the bridge pipe (152) into place downhole. Once in the desired position, the HRT (168) releases the bridge pipe (152) and is retrieved to the surface, as shown in FIG. 5C.

In the event of failure of the seal provided by the bridge pipe (152), the bridge pipe (152) is preferably retrievable. In particular, the HRT (168) may be run downhole and re-connected with the uphole end (160). The bridge pipe (152) is then pulled in an uphole direction with the HRT (168) until the latching mechanism (158) collapses or releases, thus allowing the bridge pipe (152) to move out of position and back to surface. Drill pipe or coil tubing is typically used to set or remove the bridge pipe (152) with the HRT (168). The HRT (168) remains connected with the uphole end (160) of the bridge pipe (152) so long as there is no fluid being pumped to the HRT (168). Once the pumps are turned on, the fluid causes the HRT (168) to retract its pistons holding the bridge pipe (152). The HRT (168) may then be pulled back far enough to clear the connection holes provided on the side of the bridge pipe (152). FIG. 5C shows the bridge pipe (152) in place. To retrieve the bridge pipe (152), the process is simple reversed.

As well, as shown in FIGS. 5A-5C, one or more centralizers (146) or centralizing members or devices, as described previously, may be provided along the length of each of the liner sections (126*a*, 126*b*). Although a centralizer (146) may not be required, a plurality of centralizers (146) are typically positioned along the lengths of each of the first and second liner sections (126*a*, 126*b*). Further, at least one centralizer (146) is preferably positioned proximate or adjacent to each of distal connection ends (132) of the first and second liner sections (126*a*, 126*b*). Referring to FIGS. 5A-5C, the centralizers (146) are shown as bows. However, any other suitable type of conventional or known centralizer may be used.

Referring to FIGS. 7A-8B, compatible male and female connectors (136, 134) comprise the distal connection ends (132) of the liner sections (126*a*, 126*b*), wherein any suitable latching mechanism or latch assembly (154) is provided therebetween to retain the male connector (136) in position within the female connector (134). The latching mechanism or latch assembly (154) is associated with each of the female connector (134) and the male connector (136) such that the latching mechanism (154) engages as the male connector (136) is passed within the female connector (134). More particularly, the female connector (134) preferably provides an internal profile or contour for engagement with a compatible or matching external profile or contour provided by the male connector (136). Preferably, the latching mechanism (154) is of a type not requiring any specific orientation downhole for its engagement.

Referring particularly to FIGS. 7A-8B, similar to that described previously for the bridge pipe (152), the latching mechanism (154) is preferably comprised of a collet (156) associated with the female connector (134) and configured for receiving the male connector (136) therein. The collet (156) has an internal latching or engagement profile or contour for engagement with the male connector (136) to retain the male connector (136) in a desired position within the female connector (134).

The latching mechanism (154) is also preferably comprised of one or more latch members (158), preferably associated with the male connector (136) and configured to be received within the collet (156). Each latch member (158) has an external latching or engagement profile or contour which is compatible with the internal profile or contour of the collet (156). In addition, each latch member (158) is preferably spring loaded or biased outwardly such that the latch member (158) is urged toward the collet (156) for engagement therewith. Thus, the male connector (136) is retained in position within the female connector (134) when the latch members (158) are engaged within the matching collet (156).

Further, the latching mechanism (154) is preferably releasable to permit the disengagement of the latch member (158) from the collet (156) as desired. In particular, upon the application of a desired axial force, the spring or springs of the latch member (158) are compressed and the latch member (158) is permitted to move out of engagement with the collet (156).

The latching mechanism (154) may be the same as, or similar to, the keyless latch assembly described in U.S. Pat. No. 5,579,829. However, preferably the latching mechanism (154) includes a "no-go" or fail-safe feature or capability such that the latch members (158) cannot be pushed or moved past the collet (156). Thus, the latching mechanism (154) is preferably the same as, or similar to, the fail-safe latch assembly described in U.S. Pat. No. 6,202,746.

Further, referring to FIGS. 7A-8B, the leading edge or bull-nose (137) of the male connector (136) is adapted for receipt within the female connector (134). More particularly, the bull-nose (137) is preferably shaped, sized and configured to facilitate or assist with the proper entry of the bull-nose (137) within the female connector (134) to permit the engagement of the latching mechanism (154). In addition, the shape, size or configuration of the bull-nose (137) may be varied depending upon the size, and particularly the diameter, of the latch member or members (158) associated with the male connector (136).

Figure 7A:
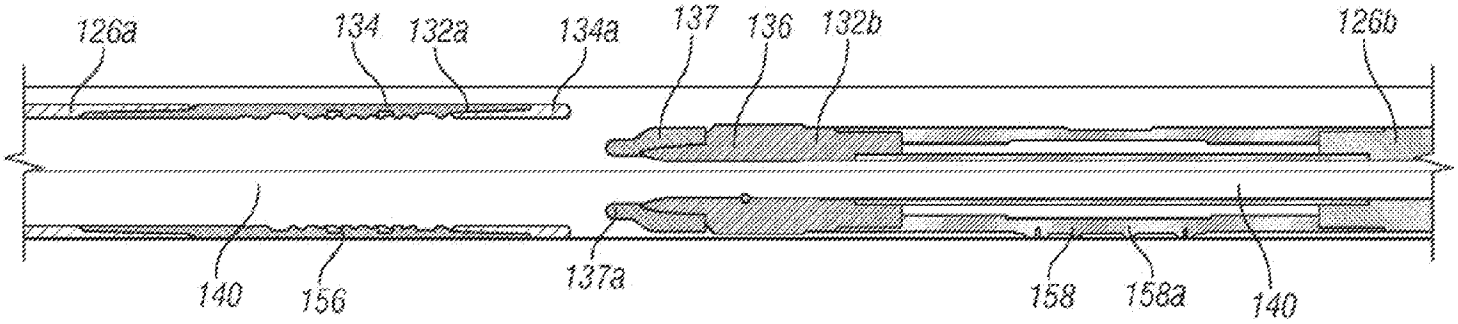
FIG. 7A depicts the connector in an unlatched position and FIG. 7B depicts the connector in a latched position.
Figure 7B:
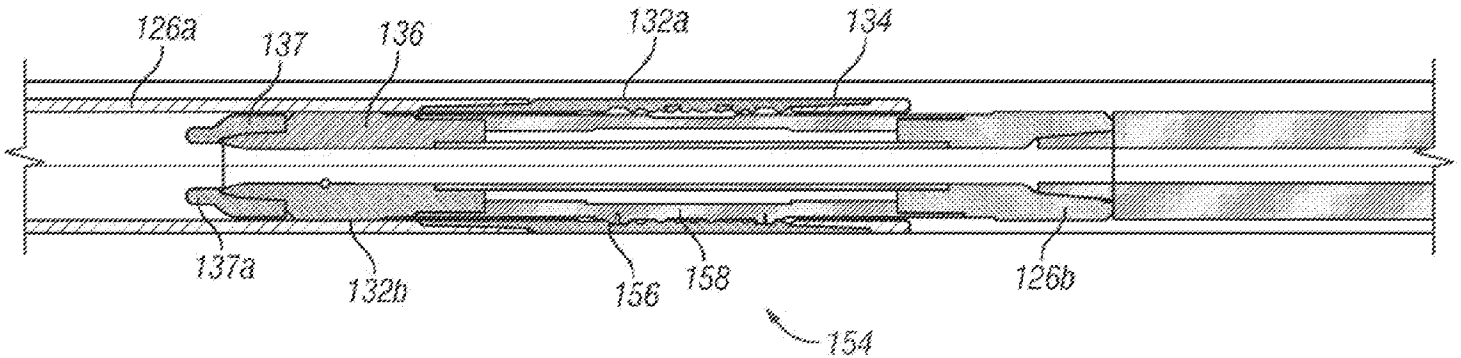

For instance, referring to FIGS. 7A and 7B, based upon the assumption that the collet (156) and the latch member (158) of the female and male connectors (134, 136) respectively will be positioned on the low side of the borehole during the coupling thereof, the bull-nose (137) may be provided with an area of decreased diameter (137*a*) for guiding the bull-nose (137) within the female connector (134).

FIG. 7A shows the bull-nose (137) in alignment with the female connector (134) prior to the coupling of the first and second liner sections (126*a*, 126*b*). The bull-nose (137) is aligned such that the area of decreased diameter (137*a*) of the bull-nose (137) will be guided within the female connector (134) upon contact therewith. FIG. 7B shows the engagement of the latch member (158) of the male connector (136) within the collet (156) of the female connector (134), thereby providing a continuous liner or continuous conduit or fluid path between the first and second liner sections (126*a*, 126*b*).

Alternatively, referring to FIGS. 8A and 8B, based again upon the assumption that the collet (156) and the latch member (158) of the female and male connectors (134, 136) respectively will be positioned on the low side of the borehole during the coupling thereof, the latch member (158) may be provided with an increased or enlarged diameter (158*a*). The enlarged diameter (158*a*) of the latch member (158) tends to urge the bull-nose (137) a spaced distance away or apart from the adjacent borehole wall. As a result, the bull-nose (137) is held a spaced distance from the borehole wall and in better alignment with the female connector (134), thus facilitating the guiding of the bull-nose (137) therein.

Figure 8A:
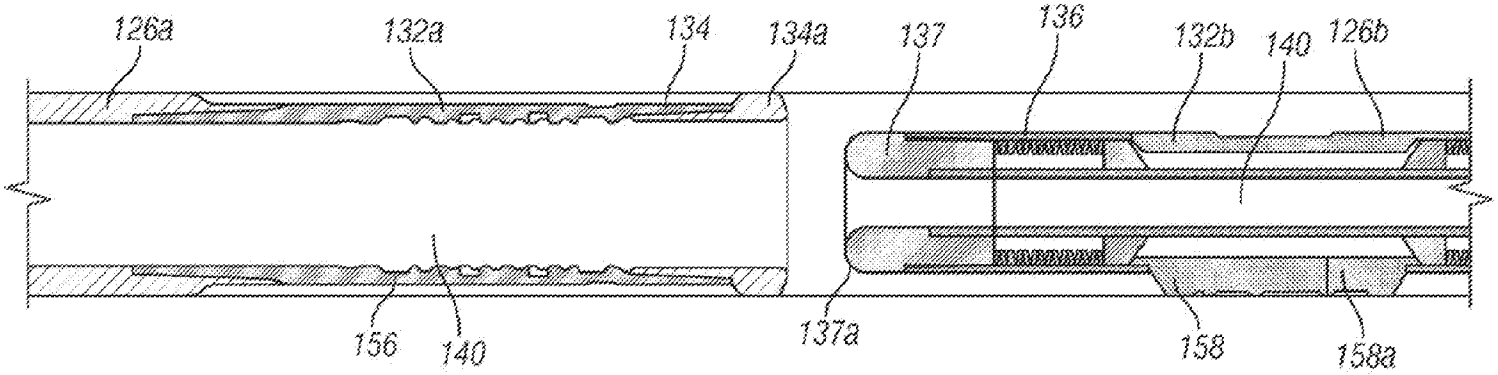
FIG. 8A depicts the connector in an unlatched position and FIG. 8B depicts the connector in a latched position.
Figure 8B:
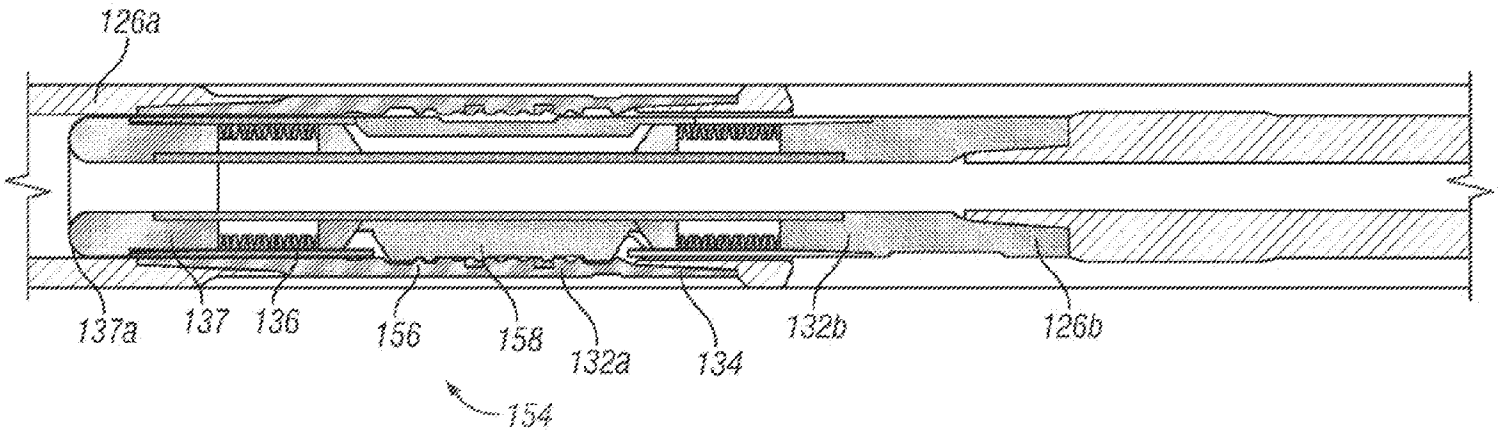

FIG. 8A shows the bull-nose (137) spaced apart from the borehole wall in alignment with the female connector (134) prior to the coupling of the first and second liner sections (126*a*, 126*b*). The bull-nose (137) is aligned such that the bull-nose (137) may be guided within the female connector (134) upon contact therewith. FIG. 8B shows the engagement of the enlarged latch member (158) of the male connector (136) within the collet (156) of the female connector (134), thereby providing a continuous liner or continuous conduit or fluid path between the first and second liner sections (126*a*, 126*b*).

Figure 9A:
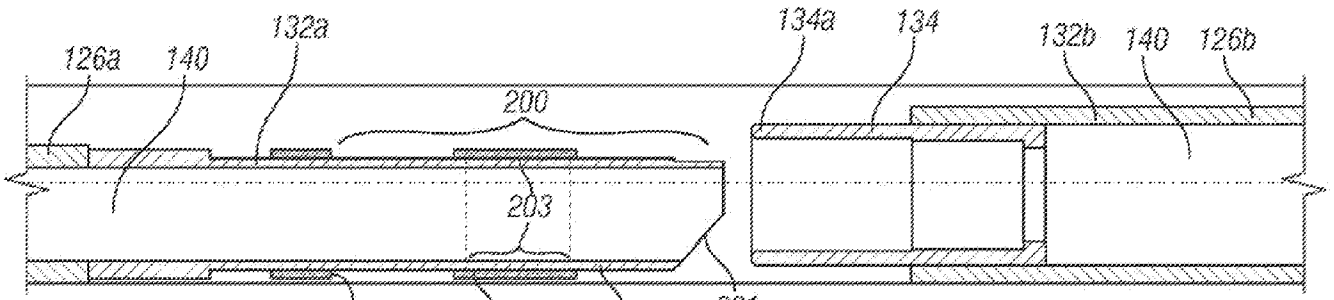
FIG. 9A depicts the connector in an uncoupled position and FIG. 9B depicts the connector in a coupled position.
Figure 9B:
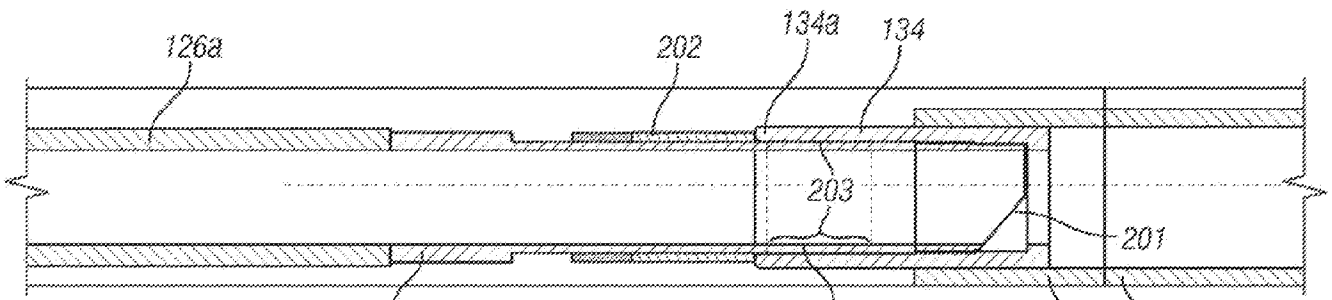
Figure 10:
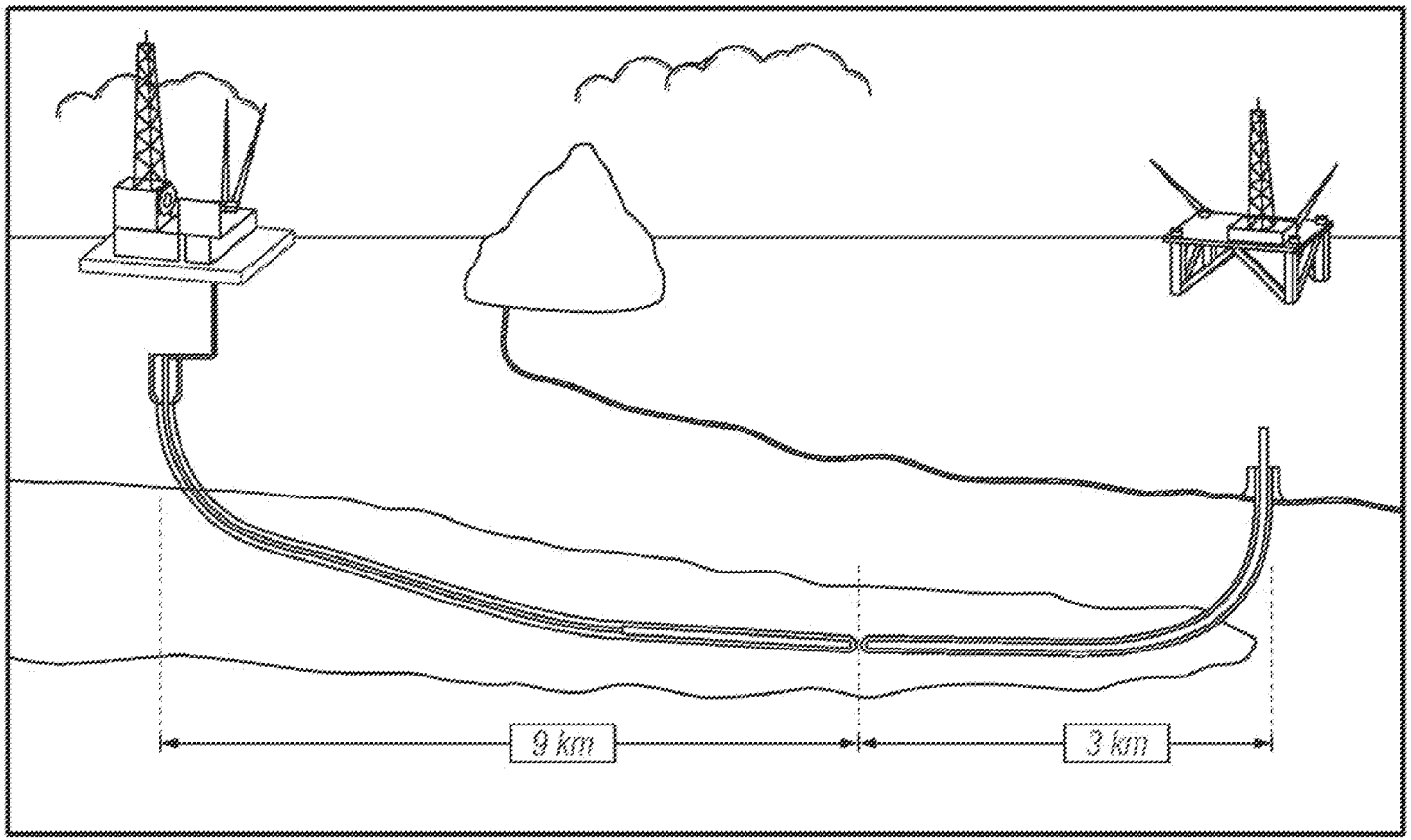
FIG. 10 is a schematic depiction of a U-tube borehole extending between two offshore drilling platforms as an undersea pipeline in circumstances where a conventional pipeline is impractical.
Figure 11A:
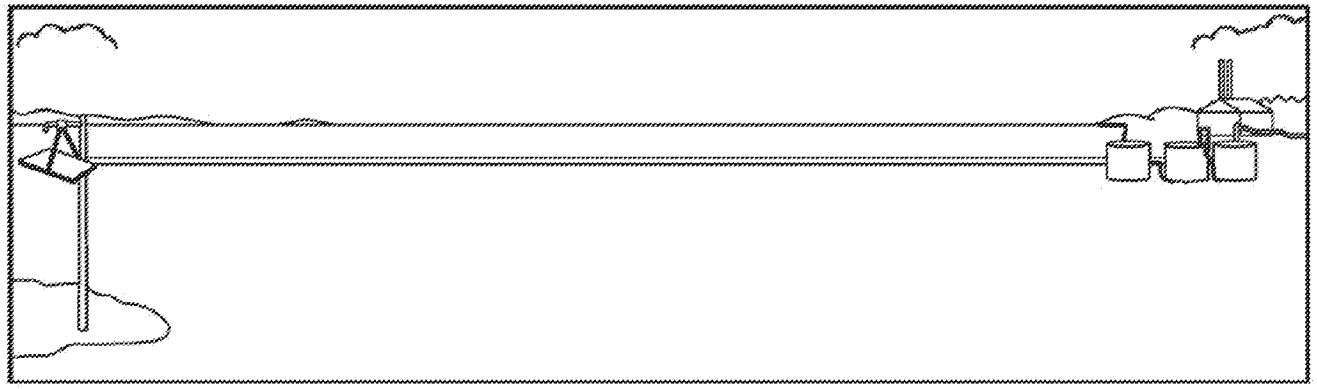
FIG. 11A depicts the above-ground pipeline and FIG. 11B depicts the U-tube borehole pipeline.
Figure 11B:
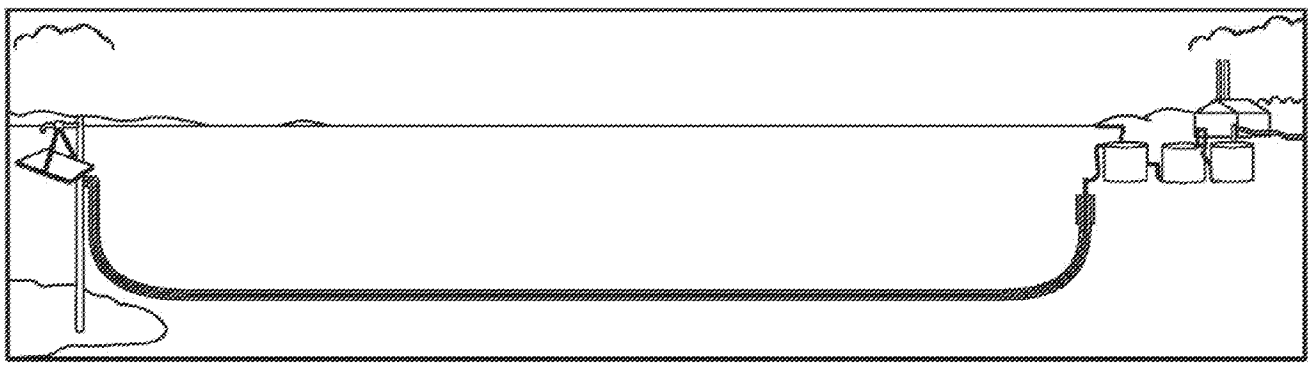
Figure 12:
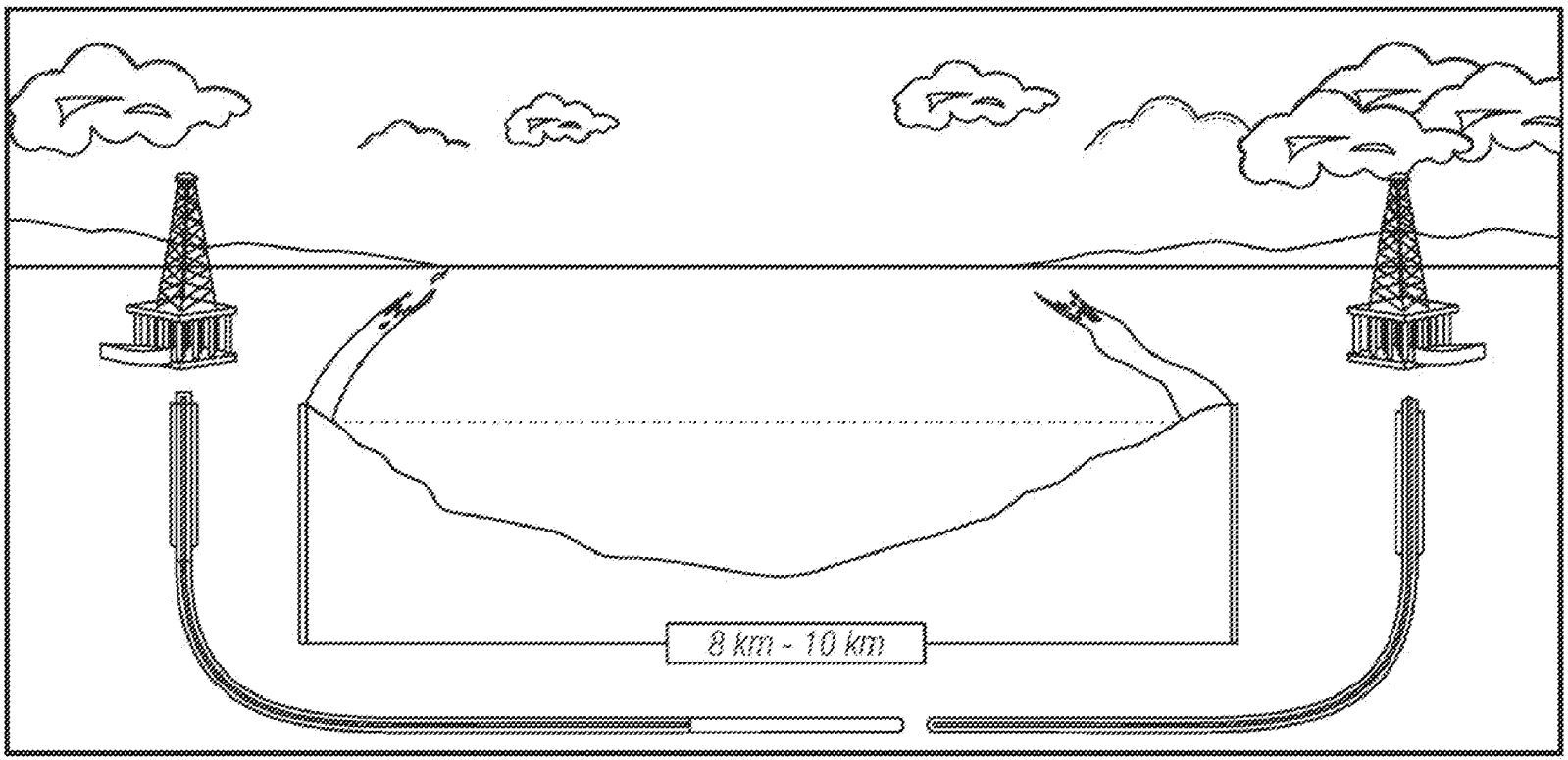
FIG. 12 is a schematic depiction of a U-tube borehole being drilled under a river or gorge.
Figure 13:
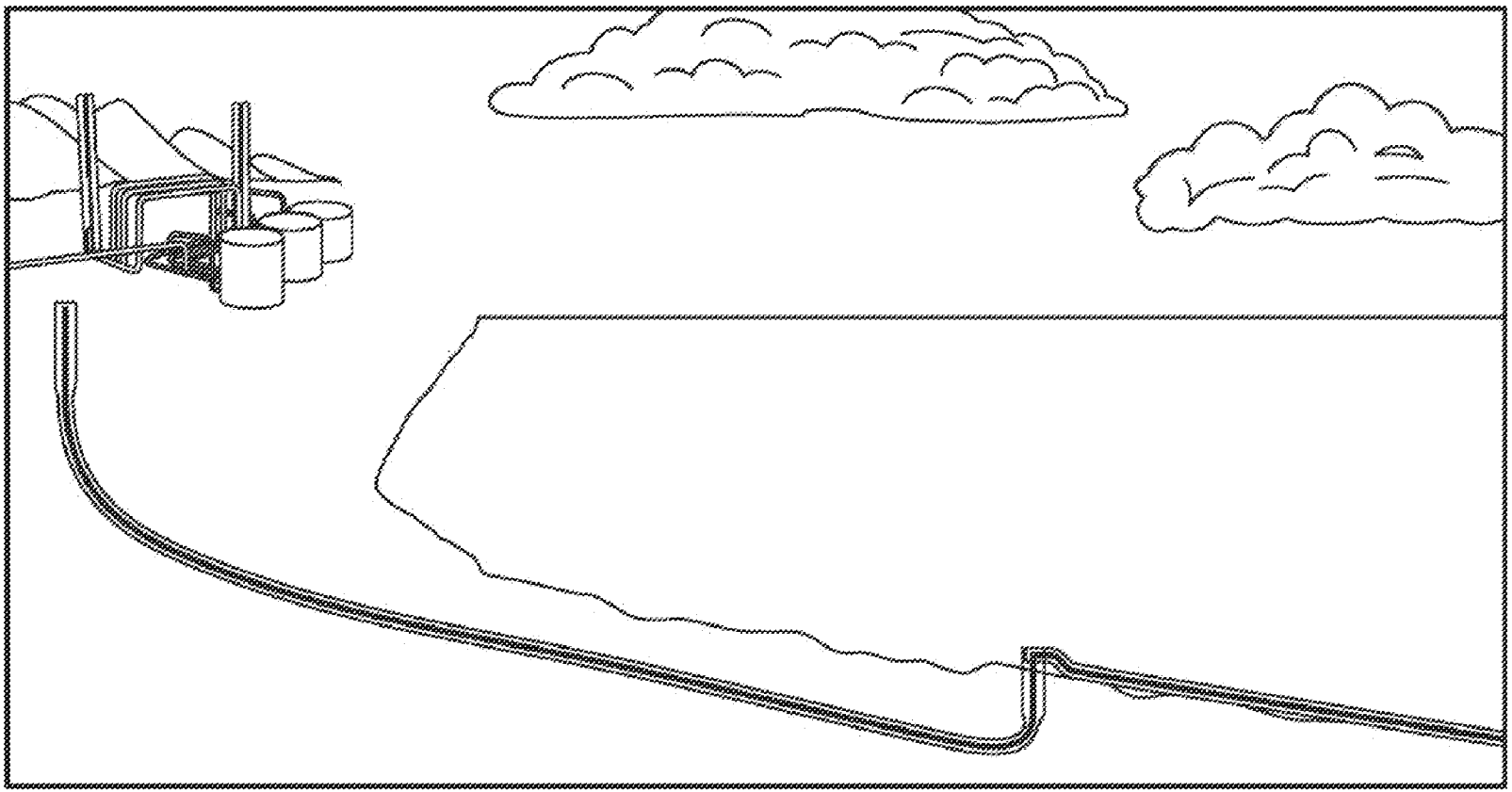
FIG. 13 is a schematic depiction of a U-tube borehole pipeline providing a connection between an offshore pipeline and an onshore installation.

Referring to FIGS. 9A and 9B, compatible male and female connectors (136, 134) again comprise the distal connection ends (132) of the liner sections (126*a*, 126*b*). Each of the male and female connectors (136, 134) is sized, shaped and configured such that the leading section or portion (200) of the male connector (136) is closely received within the female connector (134). Further, a leading edge (201) of the male connector (136) is preferably shaped or configured to assist or facilitate the guiding of the male connector (136) within the female connector (134). Preferably, the leading edge (201) is angled or sloped, as shown in FIG. 9A.

In addition, a movable sleeve or movable plate (202) is preferably mounted or positioned about the leading section (200). The movable sleeve (202) may be movably mounted or positioned about the leading section (200) in any manner permitting its axial movement longitudinally along the leading section (200) in the described manner.

In particular, prior to coupling of the male and female connector (136, 136), the movable sleeve (202) is positioned about a sealing portion (203) of the leading section (200) which is intended to engage and seal with the female connector (134). As the leading section (200) is moved within the female connector (134), a leading edge (134*a*) of the female connector (134) abuts against or engages the movable sleeve (202) and causes it to move axially along the leading section (200) of the male connector (136). As a result, the sealing portion (203) of the leading section (200) is exposed for engagement with the adjacent surface of the female connector (134). Thus, the sealing portion (203) is maintained in a relatively clean condition prior to its engagement with the female connector (134), thereby facilitating the seal between the adjacent surfaces. Axial movement of the movable sleeve (202) is preferably limited by the abutment of the sleeve (202) with a shoulder (204) provided about the male connector (136).

FIG. 9A shows the leading edge (201) of the male connector (136) in alignment with the female connector (134) prior to the coupling of the first and second liner sections (126*a*, 126*b*). If necessary, the male connector (136) may be rotated to position the angled or sloped portion of the leading edge (201) on the low side of the borehole to facilitate the guiding of the male connector (136) within the female connector (134). FIG. 9B shows the engagement of the leading edge (134*a*) of the female connector (134) with the movable sleeve (202), and the subsequent engagement of the leading section (200) of the male connector (136) within the female connector (134) once the movable sleeve (202) is moved to expose the clean sealing portion (203) underneath. The engagement of the adjacent surfaces of the male and female connectors (136, 134) preferably provides a hydraulic seal therebetween.

Finally, in the completion of the U-tube borehole (20), various packers, packing seals, sealing assemblies and/or anchoring devices or mechanisms may be required in an annulus provided between the inner surface of an outer pipe, such as a liner, tubing or casing, or the inner surface of a borehole wall and the adjacent outer surface of an inner pipe, such as a liner, tubing or casing.

In each of these instances, the inner pipe may be comprised of an expandable pipe, such as an expandable liner or expandable casing. Alternately, in each of these instances, either or both of the inner and outer pipes may be comprised of a deformed memory metal or a shape memory alloy, as discussed further below.

With respect to the expandable pipe, following the placement of the inner pipe, the inner pipe may be expanded, using conventional or known methods and equipment, to engage the adjacent outer pipe or borehole wall and seal the annulus therebetween. In other words, the expansion of the inner pipe provides the function of a barrier seal. Further, the engagement of the inner pipe with the outer pipe or borehole wall provides the function of an anchoring mechanism.

Alternatively or in addition to the expandable pipe, the outer surface of the inner pipe may be coated with an expandable material, such as an expandable compound or elastomer or an expandable gel or foam, which expands over a period of time to engage the adjacent outer pipe or borehole wall. In other words, rather than expanding the inner pipe itself, the coating on the outer surface of the inner pipe expands over time to provide the sealing and anchoring functions as described above. This may obviate the need for cementing of the borehole.

Preferably, the expandable material is selected to be compatible with the anticipated downhole conditions and the required functioning and placement of the inner pipe. For instance, elastomer may be sensitive to exposure to hydrocarbons, causing it to swell. Similarly, heat and/or esters or other components of the drilling mud may cause the coating to swell.

As a further alternative or in addition to the above, either or both of the inner and outer pipes may be comprised of a deformed memory metal or a shape memory alloy. Preferably, the inner pipe is comprised, at least in part, of the memory metal or shape memory alloy, which is particularly positioned or located at the area or areas required or desired to be sealed with the outer pipe. In other words, the sealing interface between the inner and outer pipes is comprised, at least in part, of the memory metal or shape memory alloy.

Any conventional or known and suitable memory metal or shape memory alloy may be used. However, the memory metal is selected to be compatible with the anticipated downhole conditions and the required functioning and placement of the inner and outer pipes. Memory metals or shape memory alloys have the ability to exist in two distinct shapes or configurations above and below a critical transformation temperature. Such memory shape alloys are further described in U.S. Pat. No. 4,515,213 issued May 7, 1985 to Rogen et. al., U.S. Pat. No. 5,318,122 issued Jun. 7, 1994 to Murray et. al., and U.S. Pat. No. 5,388,648 issued Feb. 14, 1995 to Jordan, Jr.

Thus, the inner pipe comprised of the deformed memory metal may be placed within the outer pipe. Following the placement of the inner pipe within the outer pipe, heat is applied to the sealing interface in order to heat the memory metal to a temperature above its critical transformation temperature and thereby cause the deformed memory metal of the inner pipe to attempt to regain its original shape or configuration. Thus, the inner pipe is expanded within the outer pipe and takes the shape of the desired sealing interface. As a result, a tight sealing engagement is provided between the inner and outer pipes.

The sealing interface may be heated using any conventional or known apparatus, mechanism or process suitable for, or compatible with, heating the memory metal above its critical transformation temperature, including those mechanisms and processes discussed in U.S. Pat. No. 4,515,213, U.S. Pat. No. 5,318,122 and U.S. Pat. No. 5,388,648. For instance, a downhole apparatus may be provided for heating fluids which are passing through or by the sealing interface. Alternately, an electrical heater or heating apparatus may be used.

As well, alternatively or in addition to the deformed memory metal, either or both of the inner or outer pipes, at the location of the desired or required sealing interface, may include a coating of an elastomer or an alternate sealing material to aid in, assist or otherwise facilitate the sealing at the sealing interface. Further, either or both of the inner or outer pipes, at the location of the desired or required sealing interface, may include one or more seals, sealing assemblies or seal devices to aid in, assist or otherwise facilitate the sealing at the sealing interface. For instance, one or more O-rings may be utilized, which O-rings are selected to resist or withstand the heat required to be applied to the deformed memory metal.

Similarly, each of the male connector (136) and the bridge pipe (152) described above may be comprised of an expandable member, may include an expandable coating or may be comprised of a deformed memory metal. Accordingly, for example, the male connector (136) may be expanded within the female connector (134) to provide a seal therebetween. Alternately, the male connector (136) may include an expandable coating for sealing within the female connector (134). By way of further example, the bridge pipe (152) may be expandable within the distal connections ends (132) of the liner sections (126*a*, 126*b*) to provide the necessary seal. Alternately, the bridge pipe (152) may include an expandable coating for sealing with each of the distal connections ends (132). Further, any or all of the male connector (136), the bridge pipe (152) and the female connector (134) may be comprised of a deformed memory metal at the desired sealing interface.

3. U-Tube Network Configurations

Utilizing the above described drilling and completion methods, various configurations of interconnected U-tube boreholes (20) may be constructed. Specifically, a series of interconnected U-tube boreholes (20) or a network of U-tube boreholes (20) may be desirable for the purpose of creating an underground, trenchless pipeline or subterranean path or passage or a producing/injecting well over a great span or area, particularly where the connection occurs beneath the ground surface.

For instance, a plurality of U-tube boreholes (20) may be constructed, which are interconnected at the surface using one or more surface pipelines or other fluid communication systems or structures. For example, each U-tube borehole (20) will extend, or be defined, between the first surface location (108) and the second surface location (116). Thus, to interconnect the U-tube boreholes (20), the surface pipeline is provided between the second surface location (116) of a previous U-tube borehole (20) and the first surface location (108) of a subsequent U-tube borehole (20). If necessary, a surface pump or pumping mechanism may be associated with one or more of the surface pipelines to pump or produce fluids through each successive U-tube borehole (20).

However, the use of surface connections or surface pipelines is not preferable. In particular, two separate vertical holes are required to be drilled to the surface to effect the surface connection. In other words, the previous U-tube borehole (20) must be drilled to the surface, being the second surface location (116), and the subsequent U-tube borehole (20) must also be drilled to the surface, being the first surface location (108), in order to permit the connection to be made by the pipeline between the first and second surface locations (108, 116). The drilling of two separate vertical holes to the surface is costly and largely unnecessary, particularly where the two separate holes are being drilled at approximately the same surface location simply to permit them to be connected together.

A relatively cheaper method is to connect the U-tube borehole (20) together using a single main bore and a lateral branch below the ground. Referring to FIGS. 6A-6D, to drill the second or subsequent U-tube borehole (20), either the target borehole (22) or the intersecting borehole (24) is drilled from a lateral junction in the first or previous U-tube borehole (20). Thus, a single vertical or main borehole extends to the surface to provide a surface location for each of the two U-tube boreholes (20) connected by the lateral junction.

For example, with reference to FIGS. 6A-6D, an underground pipeline or series of producing or injecting wells is shown. In particular, a plurality of U-tube boreholes (20*a*, 20*b*, 20*c*, 20*d*) are shown connected or networked together to form a desired U-tube network (174). The U-tube boreholes (20) forming the U-tube network (174) may be drilled and connected together in any order to create the desired series of U-tube boreholes (20). However, in each case, the adjacent U-tube boreholes (20) are preferably connected downhole or below the surface by a lateral junction (176). A combined or common surface borehole (178) extends from the lateral junction (176) to the surface. In other words, each of the adjacent U-tube boreholes (20) is extended to the surface via the combined surface borehole (178).

Thus, the resulting U-tube network (174) is comprised of a plurality of interconnected U-tube boreholes (20), wherein the U-tube network (174) extends between two end surface locations (180) and includes one or more intermediate surface locations (182). Each intermediate surface location (182) extends from the surface via a combined surface borehole (178) to a lateral junction (176). Typically, each of the end surface locations (180) is associated or connected with a surface installation such as a surface pipeline (170) or a refinery or other processing or storage facility.

Depending upon the particular configuration of the U-tube network (174), the combined surface borehole (178) may or may not permit fluid communication therethrough to the intermediate surface location (182) associated therewith. In other words, fluids may be produced from the network (174) to the surface at one or more intermediate surface locations (182) through the combined surface borehole (178). Alternately, the combined surface borehole (178) of one or more intermediate surface locations (182) may be shut-in by a packer, plugged or sealed in a manner such that fluids are simply communicated from one U-tube borehole (20) to the next through the lateral junction (176) provided therebetween.

The lateral junction (176) may be comprised of any conventional or known lateral junctions which are suitable for the intended purpose, as described herein. Further, the lateral junction (176) is drilled or formed using conventional or known techniques in the industry. For example, a simple form of a lateral junction (176) may be provided by an open hole sidetrack where there is no pipe in either of the 3 boreholes that make up the junction point. The complexity of the lateral junction (176) may also be increased based on various means which are well known by those skilled in the art. In essence, any complexity or type of lateral junction (176) may be used which is suitable for the intended purpose. If pipe or tubing is to be used then the lateral junction equipment is preferably included in the pipe if required to enable the lateral branch to be created as per the usual or conventional practices in lateral borehole creation.

Referring to the configuration of FIGS. 6A-6D, each U-tube borehole (20*a*-20*d*) is preferably drilled from each side, i.e. via a target borehole (22) and an intersecting borehole (24), and connected in the middle to form the U-tube borehole (20) as previously discussed. However, the complete U-tube borehole (20) could alternately be drilled from one side to exit at surface on the other side using standard river crossing methods, if technical and safety issues permit. Each borehole being drilled may be based on any structure type, such as an offshore well or a land well, and may be completed with varying sizes of casing and liner as desired or required for a particular application.

Although not shown, sections or portions of the casing or liner within the boreholes may be surrounded by cement, as is the standard practice in oil well drilling and which is well understood by those skilled in the art. Other sections or portions of the casing or liner may be left with an uncemented or open hole annulus between the casing or liner and the formation wall.

Still further sections or portions may include a liner or casing with holes or slots therein to allow fluids and/or gases to flow in either direction across the casing/liner boundary. Typically, this is achieved with a sand screen, a slotted liner/slotted casing or a perforated casing. Further still, some sections or portions of the borehole may not require a casing or liner inserted in the borehole at all because the higher up or more uphole sections of casing and cement have effectively sealed the lower or more downhole sections from leaking outside of the borehole. Such sections are said to be left as open hole. This is typically done in very consolidated and competent downhole formations where borehole collapse is not likely.

Figure 6A:
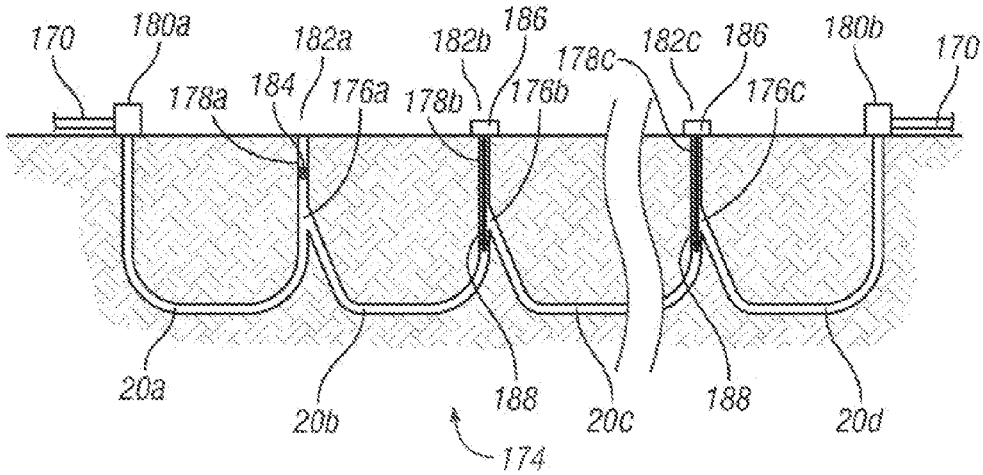
FIG. 6, consisting of FIGS. 6A through 6D, is a schematic depiction of different configurations for a plurality of interconnected U-tube boreholes, according to preferred embodiments of the invention.

Referring to FIG. 6A, a surface installation comprising a surface pipeline (170) is connected with a first end surface location (180*a*) of the U-tube network (174). The surface pipeline (170) may be connected with first end surface location (180*a*) from any number of sources on the surface. For instance, the source of the surface pipeline (170) may be a connection to another borehole, a refinery, an oil rig or production platform, a pumping station or any other source of fluid, gas or a mixture of both. In this instance, the pipeline is shown above the earth. The earth is marked as a hatched area and contains at least 1 formation type and is typically made of a plurality of formation types. The top of the earth as shown may be either surface land or the bottom of a body of water such as a lake or sea floor. Although the land is shown flat it may be made up of any configuration or topography. The surface may also include one or more transition areas between water covered areas and relatively dry land such as a shore line.

The surface pipeline (170) enters a structure or equipment that provides a connection point to the first U-tube borehole (20*a*) in order to permit the communication of gases or fluids to the underground U-tube network (174). Where desired or required, this connection point can also double as a place for a pumping station to aid in pushing the gases and/or fluids through the U-tube network (174). The structure might also contain a wellhead or a simple connection to the downward going or downwardly oriented pipe or a continuation of the pipe going underground depending on the various safety, environmental and other regulatory codes and the nature of the U-tube network (174). Although the angle of entry of the U-tube boreholes (20) into the ground is shown to be vertical, those skilled in the art would understand that any downward angle or angle of entry may be used, such as horizontally or angled upwardly into the face of a cliff for example.

The first U-tube borehole (20*a*) is preferably completed with a liner (not shown) in the manner described above. Thus, the liner extends through the U-tube borehole (20*a*) along the previously drilled path. If the U-tube borehole (20*a*) is a producing or injecting well, the U-tube borehole (20*a*) may include a plurality of lateral junctions leading off to other parts of the formation to allow for a broader area sweep of fluid flow. For instance, the U-tube borehole (100) may include a plurality of lateral junctions or multi-lateral junctions which extend the potential reach of the well through the formation. In any event, at some point, the liner of one U-tube borehole (20*a*) joins or is connected with the liner of a subsequent of further U-tube borehole (20*b*) drilled from a different location.

It is also important to note that the previous lateral junctions could also join up with other boreholes drilled from other surface locations and each of the liners or pipes therein could also have a similar pattern of lateral boreholes and liners leading off to other boreholes drilled from other surface locations. Thus, an intricate web or network of connecting boreholes and liners/pipes may be created underground. This may be particularly useful for increasing the area of reservoir recovery. In other words, any desired configuration of networking U-tube boreholes (100) may be provided. Further, a plurality of U-tube boreholes (100) may each be joined with a central borehole or collecting borehole which extends to the surface for production to a well platform, either on land or at sea.

However, for the purpose of illustrating the construction of an underground pipeline within a U-tube network (174), the following examples will focus on a relatively simple network (174) including one start point, being the first end surface location (180*a*), one end point, being the second end surface location (180*b*), and at least two U-tube boreholes (20*a-d*) connecting them together. Further, various means or mechanisms are provided for moving substances such as fluid(s), gas(es) or steam, or any combination thereof, to name a few, along the length of the underground pipeline provided by the U-tube network (174).

As described previously, the target borehole (22) and the intersecting borehole (24) of each U-tube borehole (20) are connected by a borehole intersection (26). The actual point of connection is typically located in a horizontal section of the target borehole (22), but could be done virtually anywhere along either borehole length. The point of connection is not shown in FIGS. 6A-6D. Further, as described previously, the U-tube borehole (20) may be completed by the insertion of a liner (126) or the insertion of a first and second liner section (126*a*, 126*b*) for coupling or connection downhole. Alternately, the U-tube borehole (20) may be completed in any other conventional or known manner as desired or required for the particular application of the U-tube network (174).

To connect the first U-tube borehole (20*a*) with a second or subsequent U-tube borehole (20*b*), a lateral borehole or directional section, as discussed above, is drilled from a lateral junction (176), positioned downhole of a first intermediate surface location (182*a*). The lateral borehole or directional sectional is drilled towards a second intermediate surface location (182*b*). Similarly, at the second intermediate surface location (182*b*), a borehole is drilled toward the lateral borehole. The lateral borehole drilled from the lateral junction (176) and the borehole drilled from the second intermediate surface location (182*b*) are intersected and connected as described previously.

In this example, the first intermediate surface location (182*a*) has sufficient pressure to negate the need for a pump or pumping station to boost the pressure of the flowing fluid or gas or to facilitate the fluid flow therethrough. Thus, in this example, once the first and second U-tube boreholes (20*a*, 20*b*) are connected, the first intermediate surface location (182*a*), and the combined surface borehole (178) associated therewith, really serve no further purpose. As a result, a packer (184) or other plug or sealing mechanism may be placed uphole of the lateral junction (176) within the combined surface borehole (178) to divert fluid flow between the U-tube boreholes (20*a*, 20*b*) rather than allowing the flowing material to come to the surface. If desired, the combined surface borehole (178) may be cemented on top of or above the packer (184) as a permanent plug and the surface location may be reclaimed back to its natural condition or state. This configuration, including the use of the packer (184) may be especially useful if icebergs scraping the seabed are a concern as the flow of fluid can be isolated far below the surface out of reach of any damage caused by the icebergs. Further, this configuration and the use of a packer (184) may be continued within subsequent U-tube boreholes (20) for as far as the pump pressure is capable of transferring fluids at an acceptable rate through the U-tube network (174).

Although the lateral borehole, or directional section of the borehole, drilled from the lateral junction (176) is shown extending from a generally vertical section of the intersecting borehole (24) comprising the first U-tube borehole (20*a*), the lateral borehole may be drilled from any point or location within the first U-tube borehole (20*a*). For instance, the lateral borehole may be drilled from a generally horizontal section of the first U-tube borehole (20*a*) to reduce the amount of pressure needed to move the fluid along the U-tube network (174).

Further, as shown in FIG. 6A, the first intermediate surface location (182*a*) is connected directly or indirectly with the second intermediate surface location (182*b*). For instance, the lateral borehole or directional section extending from the lateral junction (176*a*) downhole of the first intermediate surface location (182*a*) may be connected with the combined surface borehole (178*b*) extending downhole of the second intermediate surface location (182*b*). Alternately, the lateral borehole may be connected with a further lateral borehole extending from a lateral junction (176*b*) downhole of the second intermediate surface location (182*b*). Similarly, the combined surface borehole (178*a*) extending downhole of the first intermediate surface location (182*a*) may be connected with a lateral borehole extending from a lateral junction (176*b*) downhole of the second intermediate surface location (182*b*). Finally, the combined surface borehole (178*a*) extending downhole of the first intermediate surface location (182*a*) may be connected with the combined surface borehole (178*b*) extending downhole of the second intermediate surface location (182*b*).

At some point, the U-tube network (174) may require an increase in fluid pressure. In this instance, a pumping station (186) or surface pump may need to be located at one or more of the intermediate surface locations (182). Referring to FIG. 6A, as an example, a pumping station (186) is located at the second and third intermediate surface locations (182*b*, 182*c*).

Referring particularly to the second surface location (182*b*) of FIG. 6A, fluid or gases flow up the center of a production tubing (188) that seals the second U-tube borehole (20*b*) from the second lateral junction (176*b*). The fluid travels up to surface through the production tubing (188) and is pumped back down the annular cavity between the production tubing (188) and the wall of the combined surface borehole (178*b*). The annular cavity communicates with the lateral borehole extending from the second lateral junction (176*b*) to comprise the third U-tube borehole (20*c*). Thus, the fluid or gases travel into the third U-tube borehole (20*c*) given that the path back down into the second U-tube borehole (20*b*) is sealed. This process and configuration may be repeated as many times as necessary until the underground pipeline provided by the U-tube network (174) reaches its end point.

The end point of the U-tube network (174) is shown as the second end surface location (180*b*) and may be connected or associated with another series of U-tube boreholes (20), a refinery, a production platform or transfer vessel such as a tanker. In the example depicted, another pumping station (186) is provided with an exiting surface pipeline (170).

It is understood that fluid flow through the U-tube network (174) may also be conducted in a reverse direction from the second end surface location (180*b*) to the first end surface location (180*a*).

Figure 6B:
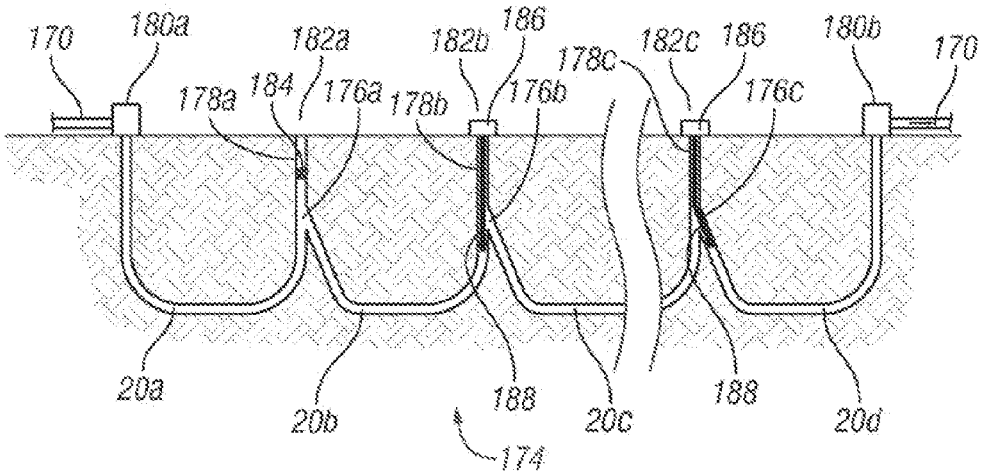

FIG. 6B provides a further or alternate placement of the production tubing (188) within a lateral borehole extending from the lateral junction (176). Referring particularly to the third intermediate surface location (182*c*) of FIG. 6B, the production tubing (188) is placed through the lateral borehole comprising the fourth U-tube borehole (20*d*). The production tubing (188) in this example seals the third lateral junction (176*c*) from the fourth U-tube borehole (20*d*). Further, the third U-tube borehole (20*c*) communicates with the annular cavity between the production tubing (188) and the wall of the third combined surface borehole (178*c*). Thus, fluid or gases flow up the annular cavity to the pumping station (186). The fluid or gases are then pumped back down the production tubing (188) and into the fourth U-tube borehole (20*d*). This process and configuration may also be repeated as many times as necessary until the underground pipeline provided by the U-tube network (174) reaches its end point.

Once again, it is understood that fluid flow through the U-tube network (174) may also be conducted in a reverse direction in this configuration from the second end surface location (180*b*) to the first end surface location (180*a*).

Figure 6C:
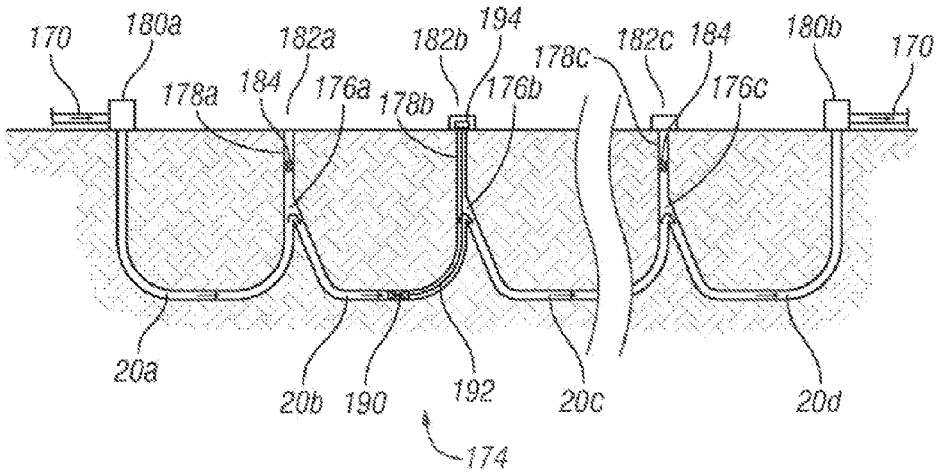
Figure 6D:
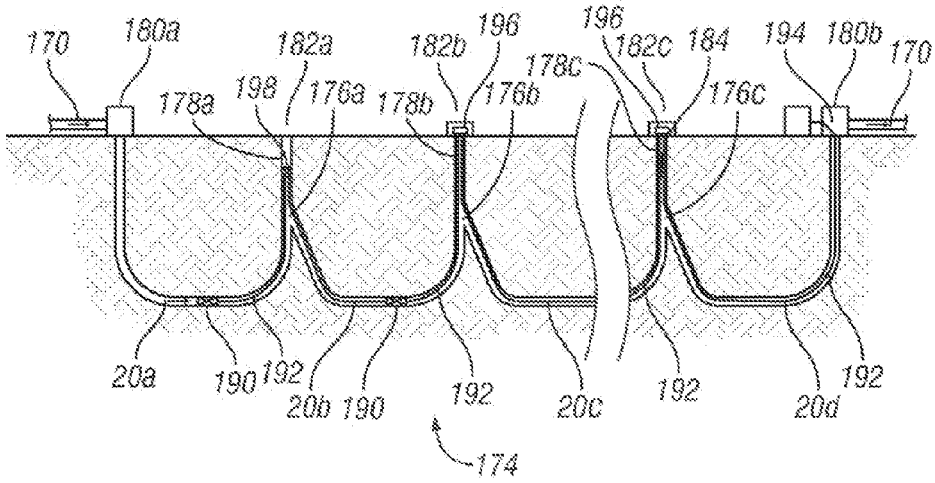

In addition to, or instead of, one or more surface pumping stations, FIGS. 6C and 6D show the use of one or more downhole pumps, preferably electrical submersible pumps ("ESPs").

Referring to FIG. 6C, the second U-tube borehole (20*b*) has a pump or compressor (190) installed therein to boost or facilitate the flow pressure and move the materials of fluids along the U-tube network (174). Any suitable downhole pump or compressor may be utilized. In addition, the downhole pump or compressor may be powered in any suitable manner and by any compatible power source. As indicated, the pump or compressor (190) is preferably an electrical submersible pump or ESP. Thus, in this example, an electrical cable (192) is run from a surface power source (194) to power the ESP (190). As the pumps are provided downhole, each of the intermediate surface locations (182) are preferably sealed by a packer (184) or other sealing or packing structure.

Further, where necessary, a step down transformer (not shown) may be associated with one or more of the ESPs (190) to allow for compatible voltages and currents to be provided to the ESP (190) from the power source to energize the motor of the ESP (190). The transformer may be positioned at any location and may be associated with the ESP (190) in any manner permitting its proper functioning. Preferably, the transformer is positioned downhole in proximity to the ESP (190), and more preferably the transformer is attached or mounted with the ESP (190). The transformer can tap off the electrical cable (192) deployed to the ESP (190).

Suitable ESPs for this application are manufactured by Wood Group ESP, Inc. The ESP (190) is provided with a seal or sealing assembly between the exterior surface of the pump (190) and the adjacent wail of the U-tube borehole (20*b*) to prevent leakage back around the pump (190). Further, an anchoring mechanism, such as the latching mechanism described previously, may be used to seat the pump (190) in place within the U-tube borehole (20*b*) and to allow for its later retrieval for maintenance. Preferably, the pump (190) may be inserted and retrieved from either side of the U-tube borehole (20*b*), i.e. from either the first or second intermediate surface locations (182*a*, 182*b*), depending upon the manner of connection of the electrical cable (192) with the pump (190). To provide the most flexibility, the downhole end of the cable (192) is preferably stabilized in a latch assembly, as described earlier, with a electrical connection stinger to mate up to the ESP (190). Conventional ESP's are rate constrained (by size of the motor). Therefore, the ESP will need to be selected depending upon the desired output capacity.

Alternately, production tubing (188) and sucker rods, if needed, can be run as shown in 6A and 6B with the top of the borehole sealed to place and power pumps of all various sorts such as positive displacement pumps, ball valve sucker rod pumps or any other type of pump typically used for enhancing lift. Again, since the top of the borehole is sealed the fluid would be moved into the next U-tube borehole (20). Preferably, there would be an exit point in the production tubing (188), such as slots above the pump, to allow fluid to exit the production tubing (188) and flow into the next U-tube borehole (20). Also, seals would preferably be provided around the pump and production tubing (188) to the inner wall of the U-tube borehole (20) to prevent backflow around the pump to the intake, which could seriously reduce the resultant flow rate.

However, the use of ESPs presents some unique advantages in this U-tube network (174). FIG. 6D shows the placement of a plurality of ESPs in the U-tube network (174), wherein the ESPs are preferably powered from a single surface power source (194). For example, as shown in FIG. 6D, an ESP (190) is positioned within each of the first and second U-tube boreholes (20*a*, 20*b*). Power is supplied to each of the ESPs (190) from a single surface power source (194) positioned at the one of the end surface locations (180). Further, the power is conducted downhole to the ESP (190) by one or more electrical cables (192) extending through the U-tube network (174).

As discussed above, where necessary, a step down transformer (not shown) may be associated with one or more of the ESPs (190) to allow for compatible voltages and currents to be provided to each ESP (190) from the main electrical cable (192) or one or more electrical cables (192) associated with the surface power source (194).

The method or configuration of FIG. 6D negates the need for power generation at each surface location or power transmission on the surface or by some other path. Running power lines or electrical cables to the U-tube surface locations, such as one or more intermediate surface locations (182), can be just as risky as running a surface pipeline. Hence the safest place for the electrical cable (192) to be run is in the U-tube borehole (20) itself or in another U-tube borehole that could parallel the U-tube borehole (20) for the pipeline provided by the U-tube network (174).

The electrical cable (192) for the ESP (190) may be installed in the U-tube borehole (20) in any manner and by any method or mechanism permitting an operative connection with the ESP (190) downhole such that the ESP (190) is powered thereby. For instance, the electrical cable (192) may be pushed into the U-tube borehole (20) from one side with the aid of sinker rods. Further, the electrical cable (192) may be pulled into the desired position through one side of the U-tube borehole (20) using a borehole tractor, as discussed previously. One could then come in from the other side of the U-tube borehole (20) and latch onto the end of the electrical cable (192) to pull the electrical cable (192) the rest of the way through the U-tube borehole (20) and back up to the other surface location.

Referring to FIG. 6D, the electrical cable (192) will include one or more connection points along the length thereof as the electrical cable (192) is extended from the surface power source (196) to each of the ESPs (190) in succession. The points of connection may be comprised of any suitable electrical connectors or connector mechanisms for conducting electricity therethrough. For instance, one or more surface electrical connectors (196) may be provided. For example, referring to FIG. 6D, a surface electrical connector (196) for connecting the electrical cable (192) and for supporting the electrical cable (192) in the U-tube borehole (20) is positioned at each of the second and third intermediate surface locations (182*b*, 182*c*).

Alternately or in addition, one or more downhole electrical connectors (198) may be used. The downhole electrical connector (198) is comprised of a packer seal, such as the packer (184) described previously, and an electrical connection module. The packer seal may be comprised of the electrical connection module such that an integral or single unit or device is provided, wherein the packer seal provides an internal connection for the electrical cable (192). Alternately, the electrical connection module may be provided as a separate or distinct unit or component apart from the packer seal, wherein the electrical connection module is placed either above or below the packer seal, preferably in relatively close proximity thereto.

To place the downhole electrical connector (198), the connection is preferably made up on the surface in the assembly. The downhole electrical connector (198), including the packer seal and the electrical connection module, is then lowered into the U-tube borehole (20) allowing the electrical cable (192) to hang loose. The packer seal is then set within the U-tube borehole (20), preferably at a point above the lateral junction (176). Preferably, the downhole electrical connector (198) is retrievable in the event that maintenance, repair or replacement is required. Therefore, the packer seal is preferably comprised of a retrievable packer.

For example, referring to FIG. 6D, a downhole electrical connector (198) for connecting the electrical cable (192) and for supporting the electrical cable (192) in the U-tube borehole (20) is positioned within the first combined surface borehole (178*a*) above the first lateral junction (176*a*).

Thus, referring to FIG. 6D, at the first intermediate surface location (182*a*), a downhole electrical connector (198) is provided within the first combined surface borehole (178*a*) to both seal the first combined surface borehole (178*a*) and to provide an electrical connection for the electrical cable (192). At the second intermediate surface location (182*b*), the second combined surface borehole (178*b*) is sealed at the surface and a surface electrical connector (196) is provided to allow the electrical power to loop back down to the next U-tube borehole (20*c*). At the third intermediate surface location (182*c*), a packer (184) is positioned within the third combined surface borehole (178*c*) to seal the third combined surface borehole (178*c*). However, the electrical connection is provided at the surface by a surface electrical connector (196). Finally, at the second end surface location (180*b*), the surface power source (194) is provided which allows power to be transmitted into the U-tube network (174) along the interconnected series of electrical cables (192). However, alternately, a plurality of power sources may be provided from a plurality of surface locations.

In the examples shown in FIG. 6D, the ESP (190) may again be installed using a latching mechanism, as described previously, or the ESP (190) may be hung from surface with the aid of rods or tubing. The ESP (190) is preferably provided with an electrical wet connect for connection of the ESP (190) with the electrical cable (192) downhole. Further, referring to the ESP (190) in the second U-tube borehole (20*b*) of FIG. 6D, an electrical wet connect is provided on both sides of the ESP (190) allowing the electrical cable (192) to sting into the ESP (190) from either or both sides.

Other conventional or known methods or techniques may be used for providing power to the ESPs (190) downhole. In addition, as an alternative to the use of electrical cables (192), electrical signals may be conducted to the ESP (190) through wires embedded in the liner (126), casing or tubing extending through the U-tube boreholes (20). For instance, embedded wires are used in the composite coiled tubing described in SPE Paper No. 60750 and U.S. Pat. No. 6,296,066 referred to above. The embedded wires or conductors may be used to provide power and data telemetry, such as operational instructions, to the ESP (190). This approach would obviate the need to run electrical cables through all or portions of the U-tube network (174)

As well, regardless of whether surface pumping stations (186) or downhole pumps or ESPs (190) are used, the number of pumps and the distance between the pumps will be determined largely by the pressure required to be generated in the U-tube boreholes (20) to move the fluids through the U-tube network (174).

Further, as described herein, each of the U-tube boreholes (20) typically involves the connection of the target and intersecting boreholes (22, 24) in a toe to toe manner. In other words, the intersection is drilled between the target and intersecting boreholes (22, 24). However, alternatively, the target borehole (22) need not be intersected near its toe, but rather in the direction of the heel of the target borehole (22). This configuration for connecting the boreholes results in a "daisy-chaining" effect which may permit the drilling of extended reach wells. More particularly, the intersecting borehole (24) is drilled from the surface to provide a generally vertical section and a generally horizontal section. The generally horizontal section of the intersecting borehole (24) is intersected with the target borehole (22) at or in proximity to the heel of the target borehole (22), or at location along a generally horizontal section of the target borehole (22). Following the intersection, the generally vertical section of the intersecting borehole (24) to the surface may be sealed or shut in. As a result, each intersecting borehole (24) provides a generally horizontal extension to the previous borehole. The end result is the creation of a U-tube network (174) having an extended reach or extended length horizontal portion.

Furthermore, battery powered guidance transmitters can be installed in the target borehole (22) which continue to transmit once activated, transmits after a certain delay period or listens for an activation signal from a source in the BHA of the intersecting borehole (24). Such transmitters can be installed in side pockets of the liner, tubing or casing so they don't interfere with the flow and drilling path. Alternatively, such transmitters can be made to be retrievable from the intersecting borehole (24) by having an overshot connection, for example, to make them easier to fish.

Further, several stand alone transmitters can be placed in the open borehole and retrieved in this manner after the intersection if required. The transmitters can also be made drillable such that they can be destroyed with the drill bit after the intersection if necessary. By using stand alone transmitters, the need for a second rig over the target borehole (22) is negated and one only has to have a rig to drill the intersecting borehole (24). This provides a substantial savings especially if the boreholes are being drilled offshore.

The potential applications or benefits of the creation of a U-tube network (174) are numerous. For example, as shown in FIGS. 10-13, underground pipelines comprising one or more U-tube boreholes (20) may be created to carry fluids and gases from one location to another where traversing the surface or the sea floor with an above ground or conventional pipeline presents a relatively high cost or a potentially unacceptable impact on the environment. Further, such pipelines may be used to traverse deep gorges on land or on the sea floor or to traverse a shoreline with high cliffs or environmentally sensitive areas that can not be disturbed. As well, such pipelines may be used in some areas of the world, such as offshore of the east coast of Canada, where icebergs have rendered seabed pipelines impractical in some places.

The following two examples describe the actual drilling and completion of U-tube boreholes (20). Example 1 describes the drilling and completion of a U-tube borehole (20) using the MGT system for magnetic ranging. Example 2 describes the drilling and completion of a U-tube borehole (20) using the RMRS for magnetic ranging.

Example 1

Drilling of a U-Tube Borehole Using an MGT Ranging System

Project Goals and Objectives

The goals of this project were laid out as follows:

1. Apply current directional drilling technology to see if two horizontal wellbores could be intersected end to end. Success was defined as intersecting the two wellbores with the drill bit, and being able to enter the wellbore of the second well with the drilling assembly.
2. Run standard steel casing through the intersection to prove that the two wellbores could be linked with solid tubulars. Success was defined as being able to run regular 7" casing through an 8¾" intersection point without getting the casing stuck in the hole.
3. Join the two casing strings with a connection technique that eliminated sand production. It was agreed that the connection technique used on this first well would be as simple as possible. If this initial trial was successful, future work could be done on a more advanced connection technique.

Reservoir Description/Surface Location

The location selected for testing a method for drilling a U-tube borehole was on land in an unconsolidated sandstone reservoir. The reservoir was only 195 m true vertical depth (TVD).

The original field development plan called for several horizontal wells to be drilled under a river running through the field. It was decided that one of these horizontal wells would be an excellent location to test the drilling method, as only one additional well would need to be drilled and connected to the currently planned well.

Since one well was already planned to be drilled from one side of the river, a second surface location was selected on the opposite side of the river. This placed the two surface locations approximately 430 m from each other.

Technology Selection and Considerations

This project was created more so as a simulation of what could be done on a larger scale later. The intent was to prove that a U-tube borehole could be done using existing reliable technology but in a new way.

Since it was decided that drilling had to occur from two separate locations, this first decision suggested the appropriate method of survey technique to be used to create the borehole intersection between the two boreholes.

Steam Assisted Gravity Drainage (SAGD) wells must be placed with great accuracy with respect to one another, so the most obvious survey method to consider was a system which is used for drilling SAGD wells. One survey method developed for SAGD operations utilizes the MGT system.

The error from the MGT system is not cumulative as is the error from traditional surveying instruments. The MGT system provides a measurement of relative placement between the transmitter (the solenoid) and the receiver (the MWD probe containing magnetometer sensors) which is not susceptible to accumulated error. The MGT system is comparable to taking absolute measurement by using a measuring tape and determining your distance between boreholes every time you stop to measure. The relative position error, although present, is very small and is not cumulative upon successive measurements with increase in measured depth.

The preliminary testing showed that the MGT system worked very well when the modified MWD magnetometer sensors were in the solenoid "sweet spot" (as expected). However, it was not possible to take an accurate measurement when the sensors and the solenoid were placed within 2 m of each other, because the MWD magnetometer sensors would become magnetically saturated. Once saturation occurred, the sensors would not measure the full magnitude of the magnetic field strength being transmitted by the solenoid, thus giving erroneous readings.

While constructing a less powerful solenoid was considered an option (shorter length or weaker Ferro-magnetic core material or both), it was decided to manage the job using the standard MGT solenoid.

The plan for working in close (less than 2 m) using the standard MGT solenoid was to use lower current in the solenoid. Testing was conducted to see if the MGT/MWD probe combination would at least give good directional vectors to confirm the exact direction between the two wells.

Typically the solenoid core is driven into magnetic saturation (with high solenoid current) so that there is less non-linear hysteresis effects that can affect the ranging measurement. However, this is not the case if the solenoid current is lowered so that the solenoid is not magnetically saturated. With reduced current, the non-linear hysteresis of the core material of the solenoid results in unequal magnetic field strength when the polarity is reversed with equal current applied.

Any ranging survey taken in this manner would tell us the direction of one well with respect to the other, but it would not tell us the magnitude of the vectors. This limitation was deemed to be acceptable, as the vector direction was the most important piece of information when the two wells were within 2 m of each other.

Further testing revealed that the solenoid/MWD probe combination also worked reasonably well when the MWD magnetometer sensors were in the end lobe of the magnetic field created by the solenoid, even though it was way outside the solenoid "sweet spot".

Of particular note was that the high side/low side measurements were still very accurate (within +/−0.1 m-0.2 m) while the lateral measurement accuracy ranged from slightly compromised (+/−0.2 m-0.3 m) to greatly compromised (+/−0.3 m-2.0 m), depending on how far away the solenoid was from the sensors. However, it was decided that by controlling the distance the solenoid was from the sensors, the slight inaccuracy of using the solenoid/MWD probe combination outside the solenoid sweet spot would not be detrimental to making a successful well intersection.

Mock Intersection Testing

In order to prepare the directional driller and solenoid/MWD operator for the intersection, it was decided to simulate downhole conditions as closely as possible, and conduct a mock intersection test at surface. This allowed the key operations personnel to practice their communication and decision making skills and gain some "intersection" drilling experience and confidence at the same time.

The tools were set up in the yard and calibrated before the mock test was to begin. The operators were then placed inside an MWD cabin and told to "make the intersection". After each survey taken, the operators would decide what directional correction needed to be made and two assistants would go outside and manually move the solenoid with respect to the MWD probe.

This proved to be a very beneficial exercise, as there were several key learning points which contributed to the success of the project. For example, because the tools are reversed from their normal orientation to one another, the survey data is also reversed (kind of like looking in a mirror). However, with the flip of one switch in the software, most of this information is automatically corrected.

This is not a problem as long as everyone is aware of the survey output and how it can be affected by the software and the switches within the software. However, if this simulation had not been run, and the switch was inadvertently flipped during the actual drilling of the intersection, a failed attempt could have been the result. However, finding out all these nuances ahead of time, allowed us to put additional checks in place to prevent unknown problems.

Well Plan

Completion Method

Since several horizontal wells had already been drilled in the chosen field, the directional well plan for these two wells was essentially the same as previous wells, with the same planned casing strings, of 9⅝" surface casing and 7" production casing/slotted liner. The only difference was that the horizontal section of the borehole would now be left open for an extended period of time while the second borehole was being drilled, and the slotted liner would be run after creating the borehole intersection and the slotted liner would be used to mechanically join the two boreholes.

Since the connection method was a secondary objective of the intersection trial, it was kept as simple as possible. The overlapping mechanical connection used to isolate any possible sand production was simply a needle nosed guide shoe and washcup stinger assembly.

The length of time that the open-hole section was left open was a concern because the horizontal section was drilled in unconsolidated sand. Initial consideration was given to a temporary installation of a composite tubing string in the open-hole section to ensure that the borehole would remain open. It was believed that if the composite tubing became stuck in the borehole, it could be drilled through and the borehole intersection could still be completed successfully. However, it was ultimately felt that the benefit of the composite tubing over regular steel tubing was not worth the risk of the composite tubing breaking into pieces. As a result, regular steel tubing was used as a conduit for pumping down the MGT solenoid and the tubing was removed after the borehole intersection was completed.

Execution

Borehole No. 1

The first borehole was drilled as per normal drilling operations in the field. However, it was requested that the borehole be drilled on as close to a straight azimuth as possible (N15° E), as the second borehole was planned to land directly over top of the first borehole and then be dropped down for the borehole intersection.

The first borehole was drilled to a depth of 80 m in 12¼" hole, and then a 9⅝" casing string was run into the first borehole. The borehole was kicked off at 40 m in the 12¼" hole and the 9⅝" casing shoe was landed at an inclination of approximately 16°.

After the 9⅝" casing was run and cemented, the shoe was drilled out with an 8¾" bit. The entire build section was then drilled with a dogleg severity of about 11°-13° per 30 m and the borehole was landed at 90° at a TVD of about 195 m. After the build section was drilled, the bottom hole assembly was pulled and the horizontal drilling assembly was installed.

The horizontal section of the first borehole was then drilled to a total depth of 476 m.

This horizontal section was drilled 30 m longer than required so that the MGT solenoid could be placed in the toe (in a future operation) and help guide the second borehole into the correct position for the borehole intersection.

After the horizontal section was drilled, a combination of 7" slotted liner and 7" casing was run and cemented around the build section. The 7" casing shoe was landed at a measured depth of 318 m. The rest of the horizontal section was left open hole for the borehole intersection.

A cement basket was positioned above the producing zone to keep the cement in the desired location. The casing was cemented as per plan, and the rig was moved to the location of the second borehole.

A service rig was then moved over the first borehole to run the 2⅞" protective tubing for the solenoid and was kept on standby while drilling the second borehole.

Execution

Borehole No. 2

The second borehole was drilled immediately after the first borehole was drilled, to minimize the amount of time that the open hole section in the first borehole would remain open.

The well plan was essentially the same as for the first borehole, except that the second borehole was drilled directly toward the first borehole on an azimuth of N195° E-180° opposite the first borehole. The 12¼" hole was drilled to a depth of 80 m, and then a 9⅝" casing string was run. The second borehole was kicked off at 40 m in the 12¼" hole and the 9⅝" casing shoe was landed at an inclination of approximately 21°.

After the 9⅝" casing was run and cemented, the shoe was drilled out with an 8¾" bit. The entire build section was then drilled with a standard MWD package until the angle was built to approximately 60° inclination, once again at a dogleg severity of about 11°-13° per 30 m. At this point the bottom hole assembly was pulled out of the second borehole and the MWD probe was made up, surface tested and run into the second borehole. At the same time, the 2⅞" tubing was run to TD in the first borehole, and the MGT solenoid was pumped down on wireline to the end of the horizontal section inside the tubing so that it could be used to guide the final build section of the second borehole.

The final buildup was made by guiding the drilling with the MGT system. It was immediately observed that a TVD correction of 0.5 m was necessary in order to correct the survey error between the two boreholes. This correction was made and the drilling continued while referencing was done with the MGT system and planning was done with directional drilling planning software. The magnetic guidance information was used to update the planning model throughout.

The targeted borehole intersection was at the start of a 55 m straight section that was at 87° in the first borehole (just past a high spot on the horizontal section). On the first attempted intersection, the second borehole was landed at a slightly higher angle than the planned 88° inclination (it was actually 90° inclination) and 2 meters to the right side of the first borehole.

This error on inclination was largely due to the fact that the MWD probe was 16 m behind the bit, and our actual build rate was more than projected at the landing point. This meant that the first borehole was falling away at 87° inclination or diverging at an angle of 3°; which was not discovered until the bottom hole assembly was changed and a further 16 m was drilled.

Being slightly to the right of the first borehole was a result of not being able to build and turn at the same time for fear of landing the second borehole too low, and going into and right out the other side of the first borehole. It was decided to get the entire angle built first, then turn the second borehole to get over the top of the first borehole, and then angle down into the first borehole.

Unfortunately, since the first borehole was falling away and it was necessary to turn the second borehole to the left to get back over the first borehole, a large part of the horizontal section of the first borehole which was available for making the borehole intersection was used only to get into a good position for making the borehole intersection.

Results

The original plan was to drill directly over the first borehole, and then slowly drill downward and intersect the first borehole from above. When this was tried on the first attempt, it was not known when the first borehole would collapse as the bit approached it. For this reason, the solenoid and 2⅞" tubing were installed and removed after every 18 m of drilled section when the bit was within 1.0 m of the first borehole.

This procedure was very time consuming, and time could have been saved by preparing for and using a side-entry sub in the tubing string. Then the tubing and solenoid could be moved back and forth together, without having to pull the solenoid completely out of the first borehole.

Alternatively, the solenoid could be run on coiled tubing to save a lot of rig time; however, modeling would be required to ensure that the coil could reach the borehole intersection. It may not be possible to use coiled tubing if smaller coiled tubing sizes are used, as they may reach lockup prior to reaching the end of the horizontal section.

Finally a downhole tractor system, as previously described, could possibly be adapted to run on a wireline in order to manipulate the solenoid, thus negating the need for the service rig and the tubing string.

By the time the second borehole was lined up for the borehole intersection, the intersection point ended up being at a location where the inclination went from 93° to 87° in the first borehole. This complicated the borehole intersection as we had to correct the inclination accordingly, and continue to use projected inclinations for the borehole intersection. As a result, the first attempted borehole intersection crossed 0.7 m above the first borehole.

Lessons Learned

As previously described, it was initially decided that it would be preferable for the second borehole to approach the first borehole directly over the top of the first borehole and slowly descend into the first borehole. It was for this reason, that more attention was paid to the azimuth while drilling the first borehole, and there was less concern about the inclination. Based upon the experience gained, it is now believed that the first borehole should be drilled as straight as possibly (both in azimuth and inclination) through the planned zone of borehole intersection.

A suitable analogy to performing the borehole intersection would be landing an airplane on a landing strip that is perfectly straight from an aerial view, but which has several hills on it. If an attempt is made to land directly on the top of one hill, and thus approach the runway relatively high, a lot of horizontal distance must be used in order to descend down to the runway because the runway is falling away after the hill. If there is insufficient horizontal distance between hills on the runway, the landing must be aborted in order to avoid crashing into the second hill. Alternatively, if the runway is approached from relatively low in order to avoid crashing into the second hill, the first hill may not be cleared.

In making the borehole intersection, the above analogy in both cases means that the second borehole may cross the first borehole at an undesirably high angle and thus pass right through the other side of it.

If possible, drilling both the first borehole and the second borehole should be performed using near bit inclination measurement tools. This will ensure that the last 100 m of the first borehole is drilled as straight as possible, and it will reduce problems that could occur with having to project ahead during the borehole intersection operations while drilling the second borehole.

After the first attempt, it was decided to plug back and try to sidetrack the second borehole very close to the first attempted intersection point. The reasoning was that the boreholes were very close together at this point, and it would be relatively easy to intersect the first borehole from this point.

An open-hole sidetrack was made, but after a few more intersection well plans were made (done on the fly), it was discovered that the required convergence angle would be too high, and there would be a very strong possibility of the second borehole entering the first borehole and passing right through it. This result would also complicate any further attempts to make the borehole intersection from farther up the second borehole, as the integrity of the first wellbore would have been compromised during the previous attempts.

As a result, it was decided to abandon the borehole intersection attempt at this position, and sidetrack farther up the second borehole. This would allow for correction of both the initial landing, and the direction of the second borehole. It would also keep the borehole intersection farther away from the casing shoe of the first borehole, and provide more space to make a gradual borehole intersection with a low convergence angle between the two boreholes.

The second borehole was therefore open hole sidetracked back at 238 m (73° inclination). The second borehole was then turned slightly so that it was at a convergence angle of approximately 4° with the first borehole. The second borehole was then drilled to within 5 m-10 m of the planned borehole intersection.

At this point, with the MWD probe at 292 m, the ranging surveys showed that the MWD probe was actually 1.70 m to the right and 0.59 m lower than the first borehole. Using the directional drilling program, and projecting 16 m ahead to the bit (at 308 m), it was expected that the bit was about 0.55 m to the right, and 0.0 m high of the first borehole, given the direction being drilled and the corrections made at that time. It was therefore anticipated that the borehole intersection would occur somewhere between a measured depth of 312 m-316 m. At this point the MGT solenoid and the 2⅞" tubing were pulled from the first borehole so that the bit did not collide with them.

The second borehole was then drilled another 6 m (measured depth of 314 m) and circulation was lost. The service rig on location over the first borehole immediately reported flow and shut in the first borehole. The bottom hole assembly was then pushed down the second borehole and the 8¾" bit entered the first borehole with 15,000 lbs slackoff. It was pushed 4 m into the first borehole with slower circulation rates, confirming that the bit was in fact entering the first borehole and not sidetracking. A connection was made and pumps were left off and the bottom hole assembly was pushed another 3 m until it hung up. The pumps were turned back on at reduced circulation rates and the bit was worked down the second borehole. Another connection was made and the bit was worked to a depth of 330 m very quickly. The second borehole was then cleaned up prior to pulling out of hole.

The original plan was to pull out of the second borehole after hydraulic communication was made between the two boreholes, and pick up a smaller 6⅛" bullnose mill and 4¾" bottom hole assembly, to ensure that it would follow the first borehole and not sidetrack.

However, it was decided that one attempt would be made to "push" the full sized 8¾" bit and 6¾" bottom hole assembly into the first borehole with reduced circulation rates. If the bottom hole assembly stopped moving with reduced circulation rates, it would be pulled out of the second borehole as per the drilling plan. This "push" with reduced circulation rates was accomplished successfully, and proved to be a good decision in the circumstances.

A cleanup run was then made with a purpose built guided bullnose which was designed for the connection of the two casing strings and an 8½" integral blade stabilizer placed approximately 20 m from the bullnose. This assembly was used to safely cleanup the borehole intersection area without risking a sidetrack, and it was also stabbed inside the 7" casing shoe of the first borehole. After stabbing the inside of the 7" slotted liner in the first borehole, 2⅞" tubing was run in the first borehole, and the bullnose was tagged at the expected depth. This confirmed that the guided bullnose was indeed inside the 7" slotted liner, and the connection method to be used with the 7" slotted liner would be acceptable.

Execution

Making the Casing Connection

The second borehole was then logged with tubing conveyed logging tools, another cleanout trip was run, and the second borehole was prepared for casing.

The guided bullnose shoe and washcup stinger assembly were made up to 10 m of 4½" tubing. This assembly was then made up to the bottom of the 7" slotted liner and casing string and the casing string was run in the second borehole. The casing ran in the hole normally, and very little additional weight was noticed while passing through the intersection. This indicated that we indeed had a nice smooth transition, with an actual convergence angle of about 4½°-5° between the two wells.

The casing was pushed to total depth, and the stinger was inserted 5 m inside the 7" casing shoe of the first borehole. The upper section of the casing was then cemented in place, as was also done on the first borehole.

Example 2

Drilling of a U-Tube Borehole Using RMRS

This Example details the drilling of a pipeline comprising a U-tube borehole using RMRS as a magnetic ranging system. After months of drilling difficulties, and over 5900 meters of drilled borehole, the borehole intersection was achieved and successful fluid communication between the first borehole and the second borehole was established. A full drift junction between the first borehole and the second borehole was established to facilitate casing the U-tube borehole. Liner was run into both boreholes and placed 3 meters apart, with the liner covering the borehole intersection. Cementing the liner was performed by pumping down the annulus of one of the boreholes, and up the annulus of the other of the boreholes. Conventional drilling bottom hole assemblies were used to clean out the liner's float equipment before the rigs positioned at the surface locations of the two boreholes were moved off location so the well head could be tied into the pipe line created by the drilling of the U-tube borehole.

Project Goals and Objectives

The purpose of drilling the U-tube borehole was to optimize the pipeline routing and minimize environmental impact. This Example discusses the planning and execution of the drilling operations required to complete the toe to toe borehole intersection, which involved multiple drilling product lines and extensive collaboration with the operator of the pipeline.

Due to severe regional surface topography and potential environmental impact, conventional pipeline river crossing sites were not in close proximity to the existing gas fields which required tie-in. Consequently, pipeline routing would have been significantly more expensive and would have taken longer to install than the U-tube borehole. Thus larger gas reserves would have been required to render a conventional pipeline economical.

Components of Sperry-Sun Drilling Services' FullDrift™ drilling suite including rotary steerable (Geo-Pilot™) technology as well as enhanced survey techniques were used to accurately position the wells.

The FullDrift™ drilling suite is based upon a set of drilling tools that provide a smooth borehole with less spiraling and micro-tortuosities, resulting in maximum borehole drift. The components of the FullDrift™ drilling suite include the SlickBore™ matched drilling system, the SlickBore Plus™ drilling and reaming system and the Geo-Pilot™ rotary steerable system.

The SlickBore™ matched drilling system includes a matched mud motor and bit system, which combines a specially designed pin-down, positive displacement motor (PDM) with a box-up, extended gauge polycrystalline diamond compact (PDC) bit. This combination can improve directional control, hole quality and drilling efficiency. Principles of the SlickBore™ matched drilling system are described in U.S. Pat. No. 6,269,892 (Boulton et al), U.S. Pat. No. 6,581,699 (Chen et al) and U.S. Patent Application Publication No. 2003/0010534 (Chen et al).

The Geo-Pilot™ rotary steerable system is described in U.S. Pat. No. 6,244,361 (Comeau et al) and U.S. Pat. No. 6,769,499 (Cargill et al).

The SlickBore Plus™ drilling and reaming system combines the SlickBore™ matched drilling system with Security DBS' near bit reamer (NBR™) technology, and is particularly suited to hole-enlarging drilling operations.

The near bit reamer (NBR™) tool is a specially designed reamer which is used to simultaneously enlarge a borehole up to 20 percent over the pilot-hole diameter. The NBR™ tool may be used just above the drill bit as in the SlickBore Plus™ drilling and reaming system, or further up in the bottom hole assembly, such as above the Geo-Pilot™ rotary steerable system.

Subsequently blowout relief well drilling techniques, and a magnetic ranging system, were employed to precisely guide the boreholes to achieve the borehole intersection.

Planning

Initial planning and implementation began in early 2003, for a spud date of November 2003. After encountering severe borehole stability issues, the first borehole was abandoned and a second borehole was planned with a borehole path that was originally considered to be less favorable because it would take longer to drill. Severe casing wear was also a factor in the abandonment of the first borehole, due to the constant abrasion of the casing by the drill string.

DWOP-Drilling Well on Paper

It was determined by the drilling team, consisting of the operator and drilling service company personnel, that the largest issue with drilling the U-tube borehole was borehole placement, survey accuracy, and borehole path. It was believed that a high angle extended reach build section could be drilled quickly enough that time sensitive shales would not jeopardize the completion of drilling and casing operations, and the subsequent ranging operation. This more risky well path was chosen as the number one option, because it was felt that it could be drilled in fewer days, thus saving days of drilling at high daily operating costs. The second less risky option was to drill vertical and kickoff below the problematic shales and land at 90 degrees at the desired formation. The build section would then be cased with 9⅝" casing and cemented to surface.

To deal with the well placement and survey accuracy Sperry-Sun proprietary survey accuracy management techniques would be utilized to drill the two boreholes as accurately as possible. Once the toe of the boreholes were within 50 meters displacement of each other, a magnetic ranging system would be employed to precisely guide the two wells to the intersection point. The Sperry-Sun FullDrift™ rotary steerable technologies (Geo-Pilot™) would be utilized to reduce well path tortuosity, and hence reduce torque and drag concerns.

Technical Details

Build Section of Both Wells

The plan was to spud the second borehole 10 days after spudding the first borehole. The reason for this was that once the first borehole was at the desired intersect point the lateral would need to be logged for liner placement. Both wells drilled down to kick off point (KOP) without any operational problems. Once into the build section on the first borehole an abrasive formation was encountered. This abrasive formation caused premature bit wear on the diamond enhanced roller cone bits. The bits were experiencing flat crested wear and were under gauge up to one inch after drilling only 20 meters in 20 hours. Numerous reaming runs were required in the build section to keep the hole in gauge. Because of the extra bottom hole assemblies needed in the build section the second borehole outperformed the first borehole. To help compensate for this formation the borehole path was changed to drop down into the formation below sooner so that the rate of penetration (ROP) could be increased. This change caused buckling issues later on in the lateral section. The second borehole only encountered a small fraction of this formation so that both rigs finished their respective build sections within days of each other. The second borehole had to be suspended for ten days so that the first borehole could finish first for reasons already stated.

Rotary Steerable System (Geo-Pilot™ with FullDrift™ and SlickBore™

The Geo-Pilot™ drilling system including the FullDrift™ extended-gauge bits were utilized for the horizontal sections in both boreholes. The Geo-Pilot™ and FullDrift™ technology produces superior borehole quality using extended-gauge bits and point-the-bit steering technology, for higher build rates and full well path control regardless of formation type/strength. The system also incorporates accurate total vertical depth (TVD) control using "At bit" inclination sensors located within 3 feet from bit.

A Sperry-Sun Geo-Span™ real-time communications downlink was also utilized to allow high-speed adjustment and control of deflection and toolface while drilling, thus saving valuable rig time.

The SlickBore™ matched bit and motor system was kept on location for use as a back up to the Geo-Pilot™ system. It has the same FullDrift™ benefits as Geo-Pilot™, being smoother hole and lower vibration, due to the point the bit concept. The smoother hole in turn allowed better hole cleaning, and longer bit runs, combined with lower Torque & Drag (T&D). The SlickBore™ system benefits from a lower lost in hole cost and lower operation costs compared to the Geo-Pilot™. The Geo-Pilot™ offers the advantage of automatic adjustable steering control, so that the wellbore is created as one consistent and smooth curve rather than a series of curved and straight wellbore sections.

The first borehole experienced several drilling challenges such as torque and drag (T&D), resulting in drill string buckling and premature wear of tubulars. As a result of these challenges: 1) low rates of penetration were experienced. 2) because of the abrasive nature of the formation, the drill pipes hard banding was wearing off and had to re-banded to increase life, which resulted in an increased amount of stick slip making drilling operations difficult and ranging operations impossible. 3) in an attempt to increase rate of penetration, weight on bit was also increased, which in turn accelerated drillstring wear and caused premature drill pipe failure. 4) low rates of penetration because of the nature of the formations increased significantly the number of days required to drill the first borehole. 5) hole cleaning and flow rate required continuous monitoring to avoid creating downhole cutting beds from building up causing the pipe to become stuck on trips.

The second borehole didn't encounter as many problems as the first borehole. The rate of penetration was three to four times faster. Because of these factors very little pipe wear and buckling occurred until two hundred meters from the borehole intersection, were the formation changed to what was encountered in drilling the first borehole.

As a result: 1) the first problem encountered in the second borehole was the loss of a string of tools due to what is believed to be a fault which grabbed the drillstring. Fishing operations were not able to free the tools resulting in the loss of an entire bottom hole assembly, and a resulting sidetrack around the lost tools. 2) buckling issues were prevalent throughout the last few hundred meters of both boreholes requiring close monitoring and scrutiny to avoid unnecessary drill string failures. By their very natures, all of the above noted difficulties were related to each other, but independently notable.

BHA Modeling

Torque and drag modeling is a very effective tool in predictive analysis on how a particular bottom hole assembly will perform in a given borehole at a given depth. It can be used to avoid problems, and to design bottom hole assemblies and drill strings to drill in the most efficient manner. Proper bottom hole assembly design, and drill pipe sizing, weight and placement, can mean the difference between reaching the target objective of the borehole, or abandoning the borehole prior to reaching the target zone and completely re-drilling a new borehole.

Once torque, drag, and buckling concerns became an issue in drilling the boreholes, each successive bottom hole assembly was designed and modeled to determine factors such as: 1) what weight on bit could be used to drill with to avoid drillstring buckling, 2) the size, weight and placement of drill pipe in the borehole to minimize the occurrence of buckling and maximize the amount of weight on bit that could be run.

Drill String Wear

Excessive drill pipe wear was seen due to the abrasive formations encountered and the depth of the boreholes. Drillstring rotation in long reach wells is both a blessing and a curse. The rotation reduces the friction in the borehole, but at the same time reduces drill pipe life. Hard banded drill pipe need to be used in the lateral and soft banded drill pipe was used through the curve to limit casing wear. Because of the hard abrasive nature of the formations being drilled, high bit weights were required to maintain a reasonable drilling rate of penetration which accelerated drill pipe wear. A program of regularly inspecting and laying down joints of pipe with excessive wear was set up. Every trip about 30 joints of drill pipe was laid down and new joints were picked up. Unfortunately the visual inspection process was not sufficient to spot all tube wear and a failure in the drill pipe tube resulted in a fishing job. Once the tube failure occurred, the entire drill string was laid down and replaced. The practice of visual inspection of drill pipe is a generally good practice, however was ineffective to spot the tube wear that was occurring due to drill pipe buckling. The replaced new drill string was hard banded to minimize the wear, however, the roughness of the newly welded hard banding created excessive torque in the drillstring. If the new hard banded drill pipe was ground smooth it would have eliminated the stick slip that occurred. This torque caused excessive slip stick in the drill string and another trip occurred in order to lay out the new pipe and pick up pipe that had worn hard banding but was professionally inspected.

Due to the separation between wellheads and depth of the target formation, extended reach drilling techniques were required to minimize pipe torque and hole drag, ensure efficient hole cleaning and extend bit life. Specifically, both point the bit rotary steerable drilling systems and specially designed mud motors using a variation of point the bit technology were run with extended gauge bits. Point the bit technologies offer the advantage of lower torque and drag in comparison with push the bit technologies. Conventional push the bit technologies such as standard mud motor and bit, or push the bit rotary steerable tools, cannot typically create a low enough coefficient of friction to drill extended reach boreholes such as the first borehole and the second borehole. Gyro surveys were run in conjunction with conventional MWD to minimize positioning uncertainty prior to commencing magnetic ranging of the two boreholes.

Survey Accuracy

It is well known that conventional survey methods have systematic inclination and azimuth errors associated with them. The current industry standard for error models were developed by the ISCWSA (International Steering Committee on Wellbore Survey Accuracy), an informally constituted working group of companies charged with producing and maintaining standards relating to wellbore survey accuracy (ISCWSA paper—Hugh S. Williamson et. al., "Accuracy Prediction for Directional MWD", SPE Paper No. 56702 prepared for presentation at the 1999 SPE Annual Technical Conference and Exhibit held in Houston, Tex. on Oct. 3-6, 1999).

The ISCWSA model attempts to define the actual predicted position of the borehole. For the application of intersecting two horizontal boreholes at the toe, it is necessary to define the actual position of the toe of each borehole as accurately as possible in order to minimize the end cost and ensure the success of the ranging operation. During the planning stage, it was felt that it was necessary for one borehole to be located within 35 meters or less laterally from the other borehole at the point ranging begins. Industry standard ellipse calculations, based on ISCWSA error models were calculated to have a lateral uncertainty of +/−43.8 meters with a probability of 94.5% that the boreholes would fall inside the ellipse. This uncertainty was considered to be too large as there was no guarantee that the boreholes would be located close enough together in order for the ranging tools to be effective. A number of techniques were employed in order to reduce uncertainty as much as possible. A discussion of the techniques used follows.

In Field Referencing—In MWD surveys, the value assumed for magnetic declination affects the computed azimuth. Any error in the calculated declination translates into an equivalent error in the MWD azimuth and hence the lateral position of the boreholes. Declination error tends to be the largest component of positional error present in wellbore surveys. ISCWSA error models factor in approximately 0.5 degrees of azimuth error due to declination at 1 standard deviation and 1.0 degrees in azimuth uncertainty (2 Sigma) based on a worldwide average. The local magnetic declination measured at the site of the boreholes differed from the theoretical model used by an average of 1.29°. Had the local magnetic declination not been measured, the two wells would have been shifted by 72.4 meters which may have been beyond the capability of the ranging tools.

Gyroscopic Surveys—were run periodically throughout the boreholes for the purpose of cross referencing and correcting the MWD surveys to increase accuracy prior to borehole intersection. In hole referencing (IHR) or bench mark surveys were completed in order to correct the MWD surveys. An azimuth shift was calculated and applied to the MWD surveys to force the MWD to emulate the accuracy of the gyro.

During analysis of the build section gyro surveys it was discovered that the declination shift had not been applied to the first borehole survey while drilling and that the well position was in error by 1.29 degrees. This demonstrated the effectiveness of a gyro survey as a quality control check on the MWD process.

Magnetic Field Monitoring—was performed during the drilling operation as a further survey quality control technique. A magnetic monitoring station was set up on site for the duration of the project. By monitoring solar activity while drilling the MWD operators were successfully able to determine when magnetic storms caused by solar activity were occurring and affecting the drilling azimuth. Once storm activity subsided, benchmark surveys were conducted and the surveys were corrected when necessary.

Uncertainty Calculated as Drilled

An uncertainty model was developed for the U-tube borehole as it was being drilled which was based upon the initial declination correction, magnetic field monitoring, and correction to the gyro surveys. The calculated uncertainty for each borehole, based on a 2 Sigma or 95.45% confidence level, was as follows in Table 1:

TABLE 1

| Borehole | First Borehole | Second Borehole |
|---|---|---|
| IISCWSA Uncertainty | +/−43.82 m | +/−41.41 |
| As Drilled Uncertainty | +/−16.66 m | +/−15.62 |
| % reduction in Uncertainty | 61.9% | 62.2% |

The combination of the survey improvement techniques utilized resulted in a net 62% improvement in lateral position of the horizontal borehole position. The first series of ranging measurements placed the two boreholes at approximately 15 meters apart, which was well within the lateral uncertainty predicted. The ranging measurements will be discussed in further detail in the next section.

Ranging for Final Well Intersection

The Rotating Magnet Ranging System (RMRS) was employed to enable distance and orientation from the second borehole to the first borehole to be measured. The rotating magnet system collects data as the borehole is being drilled. The magnet sub, being mounted between the bit and the Geo-Pilot™, rotated as the second borehole was being drilled and creating a time varying magnetic field frequency equal to the bit rotational speed. The data was recorded and analyzed vs. depth using a multi frequency magnetometer located in the first borehole.

The Rotating Magnet Ranging System (RMRS) was chosen as the system of choice for this particular application for the following reasons:

1. The time varying magnetic field created is measurable at distances of up to 70 m under ideal conditions when the sensor is located inside a non magnetic section of the bottom hole assembly.
2. Because the signal is generated at the bit, steering control was improved, allowing a very precise borehole intersection to occur.
3. The RMRS allows measurement of convergence or divergence which aided in achieving the borehole intersection.

As the two boreholes come into closer proximity to each other, the signal will get stronger. A determination of orientation can be made relatively quickly once the two boreholes are within signal range. This will enable the second borehole to be steered toward the first borehole.

RMRS Accuracy

The accuracy of the RMRS for this application was 2% of the separation distance between the two boreholes. Most of the inaccuracy in the measurement is not in the physical distance between the boreholes but in the orientation measurement. Orientation is controlled by magnetometer resolution which is typically +/−0.5°. When the ranging data was first detected at 18 m accuracy was not as important as knowing the general convergence direction between the two boreholes. However, the data detected gave the team sufficient data to make initial steering decisions. As the two boreholes approached each other the accuracy improved greatly and allowed tighter control of the borehole intersection process.

Geo-Pilot Sub−4¼" API Regular Box×4½" IF Box

The sub was designed and built to double as a fulldrift sleeve and a rotating magnetic bit sub. This design allowed the ranging to occur without sacrificing the stabilization and steerability characteristics of the Geo-Pilot™. In the case of failure or unavailability of the Geo-Pilot™, a standard RMRS sub was kept on location, to be run with the SlickBore™ System. The FullDrift™RMRS stabilizer was developed to enable the RMRS technology to be used on the Geo-Pilot™ system without changing the designed steering characteristics of the Geo-Pilot™ system.

Wireline Unit

A single conductor electric wire line unit was utilized for the deployment of the RMRS sensor. The wireline RMRS data collection tool was deployed in the first borehole and pumped to the bottom of the first borehole. It was located inside a 55 m section of non-magnetic drill collar, to increase accuracy and enable detection at maximum possible distances.

Real Time Monitoring and Collaboration

Every morning during drilling of the U-tube borehole, representatives from the operator and of the various on-site contractors assembled for a meeting at Halliburton's Real Time Operations Center (RTOC) in Calgary, Alberta to discuss the progress of the U-tube borehole and plan the day's drilling activities. The RTOC enabled full collaboration and communication in a visual environment. The process increased the understanding of the complexity of the project and provided tools to the team which enabled better decision making in this complex real time multi rig environment. The morning meetings were held in the visualization room at the RTOC. Landmark's decision space visualization software was used to visualize the borehole paths and the 3-D seismic data. Real time bottom hole assembly modeling and whirl was done in the meetings and decisions were made concerning bottom hole assembly changes and optimization. The bottom hole assembly configurations were then sent to the drilling rigs. By optimizing bottom hole assembly and drill pipe design, better performance was achieved. Security DBS, was in consultation on bit designs, and an applications design Engineer was made available to inspect the bit wear patterns and make recommendations on what bits to run so as to optimize drilling performance and minimize cost. This environment promoted a great collaborative working environment and provided value to the project.

Lessons Learned

Borehole Planning

Option 1

The initial profile planned for the first borehole was an extended reach high angle borehole. It was originally designed for fast penetration and a profile which minimized total measured depth. The second borehole was initially designed as a conventional horizontal well.

Borehole Planning

Option 2

After the loss of the first borehole due to formation instability and casing wear, two new borehole paths were designed as conventional horizontal boreholes with a planned borehole intersection at the toes of the boreholes. These boreholes each consisted of a vertical section, followed by a standard build section, and then a conventional horizontal section. These boreholes were drilled, but took much longer than originally anticipated due to hard formations encountered in the horizontal sections.

Future Options

In the future first and second boreholes making up a U-tube borehole may be designed to kick off and build inclination to approximately 20 to 30 degrees, which angle may be held until the build to the horizontal section is started. This option would allow the boreholes to be steered towards each other with the potential end result being shorter boreholes, less time to drill, and less hard formations requiring to be drilled.

Emphasis on Torque and Drag

The drilling of future U-tube boreholes should place even more emphasis on bottom hole assembly modeling, drill pipe placement, and borehole path trajectory to minimize both depth and total drag. Continued emphasis on using the Full-Drift™ point the bit technologies, may also yield borehole paths with much less than normal levels of torque and drag.

Finally, in this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The invention claimed is:

1. A method for connecting a first borehole to a second borehole, wherein the first and second boreholes originate at first and second spaced surface locations, comprising the acts of:

drilling an azimuthally-extending directional section of the first borehole extending in a direction closer to the second borehole than the first borehole surface location; and drilling an azimuthally-extending directional section of the second borehole extending in a direction closer to the first borehole than the second borehole surface location, wherein at least the distal portions of the azimuthally-extending directional sections of the first and second boreholes extend in generally aligned relation to one another;

drilling an intersecting borehole component from one of the first and second borehole directional sections to the other borehole directional section, to provide an intersection between the first borehole and the second borehole, wherein drilling the intersecting borehole component comprises forming a sidetrack location, and wherein the sidetrack location comprises at least one of a discontinuity, a radius or a bend.

2. The method of claim 1, wherein the intersecting borehole component is drilled from the first borehole and wherein the distal end of the first borehole directional section is higher than the distal end of the second borehole directional section.

3. The method of claim 2, wherein the distal end of the first borehole directional section and the distal end of the second borehole direction section are substantially vertically aligned with one another.

4. The method of claim 1, wherein the azimuthally-extending directional section of the first borehole extends substantially in a direction toward the second surface location.

5. The method of claim 4, wherein at least a portion of the azimuthally-extending directional section of the first borehole extends generally horizontally.

6. The method of claim 4, wherein the azimuthally-extending directional section of the second borehole extends substantially in a direction toward the first surface location.

7. The method of claim 6, wherein at least a portion of the azimuthally-extending directional section of the second borehole extends generally horizontally.

8. The method of claim 1, wherein the intersecting borehole component comprises a generally S-shaped curve, and wherein the S-shaped curve comprises a first curve having a first radius and an opposing second curve having a second radius and wherein the first curve radius and second curve radius are substantially equal.

9. The method of claim 8, wherein the first curve has a first curve length, wherein the second curve has a second curve length, and wherein the first curve length and the second curve length are substantially equal.

10. The method of claim 1, wherein the act of drilling the intersecting borehole component is performed using a magnetic ranging system to guide the drilling.

11. The method of claim 10, wherein the magnetic ranging system comprises a magnetic guidance tool system, and wherein the distance between the distal ends of the first and second borehole directional sections, before the drilling of the intersecting borehole component, is less than about 30 meters.

12. The method of claim 10, wherein the magnetic ranging system comprises a rotating magnet ranging system, and wherein the distance between the distal ends of the first and second borehole directions sections, before the drilling of the intersecting borehole component, is less than about 70 meters.

13. The method as claimed in claim 10, wherein the distal ends of the first and second borehole directional sections overlap, prior to drilling of the intersecting borehole component.

14. The method of claim 1, wherein the first borehole directional section has a gauge, wherein the intersecting borehole component is drilled from the second borehole directional section, and wherein the intersecting borehole component is initially drilled with a gauge that is smaller than the gauge of the first borehole directional section.

15. The method of claim 14, further comprising the act of, after the initial drilling of the intersecting borehole component, enlarging the gauge of the intersecting borehole component so that the intersecting borehole component has a full gauge relative to the first directional section.

16. The method of claim 15, wherein the act of enlarging the gauge of the intersecting borehole component comprises passing a hole opener through the intersecting borehole component.

17. A method for connecting a first borehole to a second borehole, wherein the first and second boreholes originate at first and second spaced surface locations, comprising the acts of:

drilling an azimuthally-extending directional section of the first borehole extending generally toward the second surface location, the first directional borehole having a gauge; and drilling an azimuthally-extending directional section of the second borehole extending generally toward the first surface location, wherein at least the distal portions of the azimuthally-extending directional sections of the first and second boreholes are within a pre-determined distance of one another;

drilling an intersecting borehole component from the second borehole directional section to the other first borehole directional section, to provide an intersection between the first borehole and the second borehole, wherein drilling the intersecting borehole component comprises forming at least one of a discontinuity, a radius or a bend in the intersecting borehole component, and wherein the intersecting borehole component is initially drilled with a gauge that is smaller than the gauge of the first borehole directional section.

18. The method as claimed in claim 17, further comprising the act of enlarging the gauge of the initially drilled intersecting borehole component so that the intersecting borehole component has a full gauge relative to the first directional section.

19. The method as claimed in claim 18, wherein enlarging the gauge of the intersecting borehole component is comprised of passing a hole opener through the borehole intersection.

* * * * *

UNITED STATES PATENT AND TRADEMARK OFFICE

CERTIFICATE OF CORRECTION

PATENT NO. : 7,878,270 B2
APPLICATION NO. : 12/723021
DATED : February 1, 2011
INVENTOR(S) : Dean Lee et al.

It is certified that error appears in the above-identified patent and that said Letters Patent is hereby corrected as shown below:

On the Title page, in field (75), in "Inventors", in column 1, line 2, delete "Nesto" and insert -- Nestor --, therefor.

In column 68, line 15, in Claim 3, delete "direction" and insert -- directional --, therefor.

Signed and Sealed this
Fifth Day of April, 2011

David J. Kappos

David J. Kappos
*Director of the United States Patent and Trademark Office*